US010906327B2

(12) United States Patent
Kakui et al.

(10) Patent No.: US 10,906,327 B2
(45) **Date of Patent: *Feb. 2, 2021**

(54) PRINTER

(71) Applicant: SATO HOLDINGS KABUSHIKI KAISHA, Tokyo (JP)

(72) Inventors: Yasuyuki Kakui, Saitama (JP); Takayoshi Jinnouchi, Saitama (JP); Hideyuki Maeda, Tokyo (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/605,840

(22) PCT Filed: Sep. 25, 2018

(86) PCT No.: PCT/JP2018/035518

§ 371 (c)(1),
(2) Date: Oct. 17, 2019

(87) PCT Pub. No.: WO2019/065655

PCT Pub. Date: Apr. 4, 2019

(65) Prior Publication Data

US 2020/0047518 A1 Feb. 13, 2020

(30) Foreign Application Priority Data

Sep. 26, 2017 (JP) ..... 2017-185376
Sep. 26, 2017 (JP) ..... 2017-185378
(Continued)

(51) Int. Cl.
*B41J 2/325* (2006.01)
*B41J 17/18* (2006.01)
(Continued)

(52) U.S. Cl.
CPC ..... *B41J 2/325* (2013.01); *B41J 17/18* (2013.01); *B41J 17/24* (2013.01); *B41J 17/32* (2013.01); *B41J 29/12* (2013.01); *B41J 35/28* (2013.01)

(58) Field of Classification Search
CPC ..... B41J 2/32; B41J 2/325; B41J 17/18; B41J 17/24; B41J 17/32; B41J 29/12; B41J 31/10; B41J 35/28; B41J 2202/30
See application file for complete search history.

(56) References Cited

U.S. PATENT DOCUMENTS 5,385,416 A 1/1995 Maekawa et al.
5,653,542 A 8/1997 Sugimoto et al.
(Continued)

FOREIGN PATENT DOCUMENTS

EP 1 293 352 A1 3/2003
EP 2 284 014 A1 2/2011
(Continued)

OTHER PUBLICATIONS

U.S. Appl. No. 16/607,130, filed Oct. 22, 2019, Shioya et al.
(Continued)

*Primary Examiner* — Anh T Vo
(74) *Attorney, Agent, or Firm* — Foley & Lardner LLP

(57) ABSTRACT

A printer includes a printing portion configured to print on a print medium, a ribbon supply shaft configured to hold an ink ribbon to be supplied to the printing portion, a ribbon roll up shaft configured to roll up the used ink ribbon, a printing unit provided swingably, the printing unit having a thermal head that constitutes the printing portion, and a partition member swingably provided in the printing unit, the partition member partitioning the ink ribbon and the print medium, and the ribbon supply shaft is provided in the partition member.

15 Claims, 37 Drawing Sheets

(30) Foreign Application Priority Data

| | | |
|---|---|---|
| Jun. 1, 2018 | (JP) | 2018-106516 |
| Jun. 1, 2018 | (JP) | 2018-106519 |
| Jul. 13, 2018 | (JP) | 2018-133719 |
| Jul. 13, 2018 | (JP) | 2018-133721 |
| Jul. 13, 2018 | (JP) | 2018-133722 |
| Jul. 13, 2018 | (JP) | 2018-133724 |

(51) Int. Cl.

| | |
|---|---|
| ***B41J 17/24*** | (2006.01) |
| ***B41J 17/32*** | (2006.01) |
| ***B41J 29/12*** | (2006.01) |
| ***B41J 35/28*** | (2006.01) |

(56) References Cited

U.S. PATENT DOCUMENTS

| | | | | |
|---|---|---|---|---|
| 6,215,508 | B1 * | 4/2001 | Bryan | B41J 3/4075 347/171 |
| 2003/0047635 | A1 | 3/2003 | Hiraoka et al. | |
| 2005/0281602 | A1 | 12/2005 | Tu | |
| 2007/0212148 | A1 | 9/2007 | Numata et al. | |
| 2008/0193184 | A1 * | 8/2008 | Daisuke | B41J 23/025 400/120.01 |
| 2010/0321458 | A1 * | 12/2010 | Takeda | B41J 25/312 347/197 |
| 2011/0050832 | A1 * | 3/2011 | Aihara | B41J 2/325 347/215 |
| 2011/0058878 | A1 * | 3/2011 | Maeda | B41J 29/02 400/242 |
| 2012/0057917 | A1 * | 3/2012 | Van Britsom | B41J 17/32 400/613 |
| 2015/0145941 | A1 | 5/2015 | Gao et al. | |
| 2015/0165797 | A1 | 6/2015 | Chari et al. | |
| 2015/0165802 | A1 | 6/2015 | Wong et al. | |
| 2016/0325568 | A1 * | 11/2016 | Onodera | B41J 25/304 |
| 2020/0130365 | A1 | 4/2020 | Maeda et al. | |

FOREIGN PATENT DOCUMENTS

| | | | |
|---|---|---|---|
| JP | 61-128052 | U | 8/1986 |
| JP | 05-162405 | A | 6/1993 |
| JP | 07-314866 | A | 12/1995 |
| JP | 2002-241005 | A | 8/2002 |
| JP | 2003-080783 | A | 3/2003 |
| JP | 2004-142113 | A | 5/2004 |
| JP | 2007-230157 | A | 9/2007 |
| JP | 2009-179010 | A | 8/2009 |
| JP | 2009-286000 | A | 12/2009 |
| JP | 2014-046606 | A | 3/2014 |
| JP | 2015-000532 | A | 1/2015 |
| JP | 2015-096336 | A | 5/2015 |
| JP | 2017-503684 | A | 2/2017 |

OTHER PUBLICATIONS

USPTO Office Action, U.S. Appl. No. 16/606,825, dated Jul. 31, 2020, 13 pages.

Extended European Search Report, Application No. 18863074.3, dated Oct. 29, 2020, 9 pages.

Notice of Allowance, U.S. Appl. No. 16/606,825, dated Dec. 14, 2020, 14 pages.

* cited by examiner

PRINTER

TECHNICAL FIELD

The present invention relates to a printer.

BACKGROUND ART

JP2009-179010A discloses a thermal transfer printer including a ribbon supply shaft that holds an ink ribbon to be supplied to a printing portion in a roll form, and a ribbon roll up shaft that rolls up the used ink ribbon, wherein the ink ribbon is heated and inks of the ink ribbon are transferred to a print medium, so that printing is performed.

SUMMARY OF INVENTION

In the above printer, a relative positional relationship between the ribbon supply shaft and the ribbon roll up shaft is determined preferentially in consideration with feed passages of the ink ribbon and size of the printer. Therefore, it cannot always be said that with the positional relationship between both the shafts, the ink ribbon can be easily replaced.

The present invention is achieved in consideration with such a technical problem, and an object of the present invention is to provide a printer in which an ink ribbon is easily replaced.

According to an aspect of the present invention, a printer includes a printing portion configured to print on a print medium, a ribbon supply shaft configured to hold an ink ribbon to be supplied to the printing portion, a ribbon roll up shaft configured to roll up the used ink ribbon, a printing unit provided swingably, the printing unit having a thermal head that constitutes the printing portion, and a partition member swingably provided in the printing unit, the partition member partitioning the ink ribbon and the print medium, wherein the ribbon supply shaft is provided in the partition member.

With this aspect, at the time of replacing the ink ribbon, by swinging the partition member, it is possible to move the ribbon supply shaft to a position where a task can be easily performed. Therefore, the ink ribbon is more easily replaced.

DESCRIPTION OF EMBODIMENTS

First Embodiment

Hereinafter, a printer 100 according to a first embodiment will be described with reference to the attached drawings.

The printer 100 is a thermal transfer printer in which an ink ribbon R is heated and inks of the ink ribbon R are transferred to a print medium M, so that printing is performed. The print medium M is, for example, a label continuous body in which plural labels are continuously temporarily attached to a band-shaped liner sheet.

Figure 1:
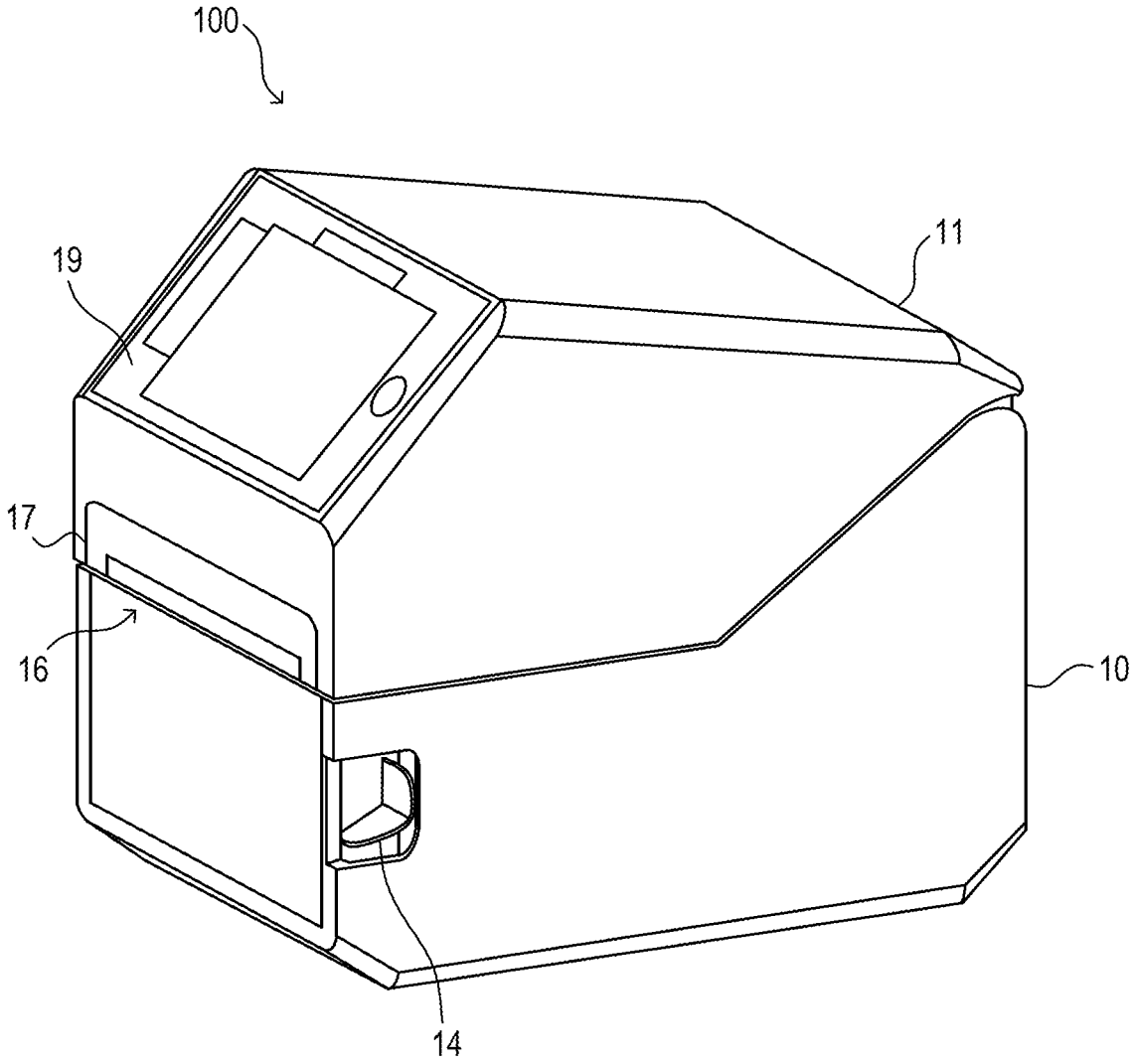
FIG. 1 is a perspective view of a printer according to a first embodiment.
Figure 2:
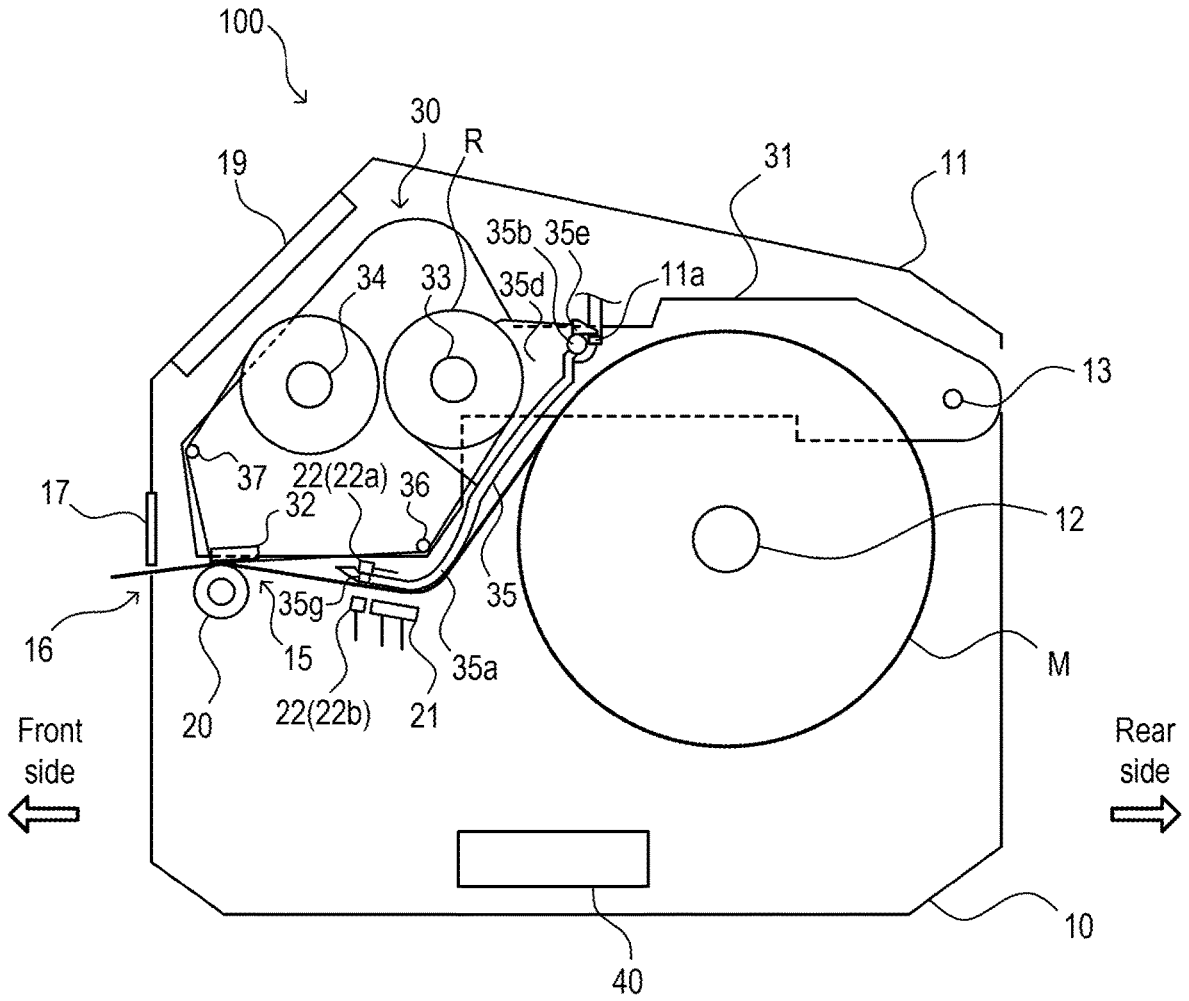
FIG. 2 is a schematic configuration view of the printer according to the first embodiment.

As shown in FIGS. 1 and 2, the printer 100 includes a casing 10, and a cover 11 that covers an opening portion of the casing 10.

As shown in FIG. 2, the print medium M is held on a medium supply shaft 12 in a state where the print medium M is wound in a roll form. Note that as the print medium M, a linerless label or a fanfold medium can also be used.

A one-end side end portion of the cover 11 is supported by a support shaft 13 provided in the casing 10 so that the cover is swingable. By swinging with the support shaft 13 as a supporting point, it is possible to switch the cover 11 between an open state where the opening portion of the casing 10 is opened (see FIG. 4) and a close state where the opening portion is closed (see FIG. 2).

A lock mechanism (not shown) that maintains the close state of the cover 11 is provided in the casing 10. The lock mechanism is cancelled by operating a lever 14 shown in FIG. 1.

Between an other-end side end portion of the cover 11 and the casing 10, an outlet port 16 that discharges the print medium M to which printing is already performed by a printing portion 15 shown in FIG. 2 from the printer 100 is formed.

A cutter 17 facing the outlet port 16 is attached to the cover 11 of the present embodiment. Thereby, it is possible to cut the printed print medium M discharged from the outlet port 16. Note that it is possible to attach various units to the cover 11. As the units, for example, a removal unit that removes labels from a band-shaped liner sheet, and a cutter unit that cuts linerless labels (labels with no band-shaped liner sheet) are included.

An operation unit 19 for operating the printer 100 is also provided in the cover 11. The operation unit 19 has various operation buttons, a display, a near-field communication module, LEDs, etc. The display may be a touch panel.

Inside the printer 100, a printing unit 30 for performing printing to the print medium M, a controller 40 that controls actions of the printer 100, etc. are accommodated.

The printing unit 30 includes a main body portion 31 whose one end side is supported by the support shaft 13 so that the main body portion is swingable, and a thermal head 32 attached to the main body portion 31.

The thermal head 32 constitutes the printing portion 15 that performs printing to the print medium M together with a platen roller 20 provided on the casing 10 side.

The printing unit 30 also includes a ribbon supply shaft 33 that holds the ink ribbon R to be supplied to the printing portion 15 in a roll form, a ribbon roll up shaft 34 that rolls up the used ink ribbon R, a partition member 35 that partitions the ink ribbon R and the print medium M, a guide shaft 36 that defines a feed passage of the ink ribbon R from the ribbon supply shaft 33 to the printing portion 15, and a guide shaft 37 that defines a feed passage of the ink ribbon R from the printing portion 15 to the ribbon roll up shaft 34. The ribbon supply shaft 33 is detachably attached to the partition member 35. The ribbon roll up shaft 34 is detachably attached to the main body portion 31. Note that the ink ribbon R of the present embodiment is an outside wound ink ribbon in which a surface where inks are applied are on the outside.

The print medium M is supplied from the medium supply shaft 12 to the printing portion 15, and nipped between the thermal head 32 and the platen roller 20 together with the ink ribbon R.

When electricity is distributed through to a heating element of the thermal head 32 in a state where the print medium M and the ink ribbon R are nipped between the thermal head 32 and the platen roller 20, the inks of the ink ribbon R are transferred to the print medium M by heat of the heating element, so that printing is performed to the print medium M.

When the platen roller 20 is rotated forward by a platen drive motor (not shown), the print medium M and the ink ribbon R are fed to the downstream side in the feed direction, and the print medium M is discharged to the outside of the printer 100 from the outlet port 16.

The ribbon supply shaft 33 and the ribbon roll up shaft 34 are also respectively driven and rotated by drive motors (not shown).

Figure 3:
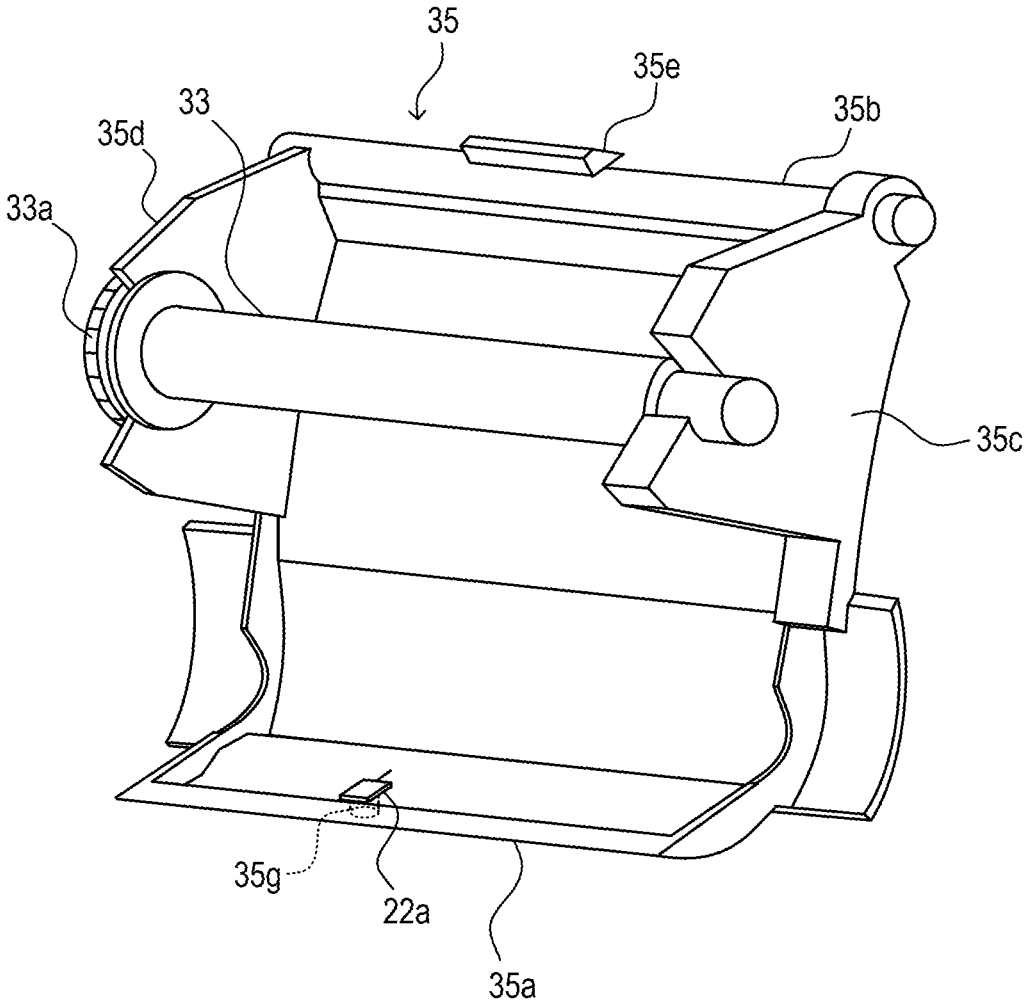
FIG. 3 is a perspective view of a partition member and a ribbon supply shaft.

As shown in FIG. 3, the partition member 35 has a base portion 35*a*, a shaft portion 35*b* provided on the one end side of the base portion 35*a*, support portions 35*c*, 35*d* that rotatably support the ribbon supply shaft 33 in parallel to the shaft portion 35*b*, and an engagement portion 35*e* formed in a center portion of the shaft portion 35*b*.

The partition member 35 is swingably supported on the main body portion 31 by the shaft portion 35*b*.

As shown in FIG. 2, the engagement portion 35*e* is configured to be engaged with an engaged portion 11*a* provided in the cover 11. When the partition member 35 is brought to a position (close position) where the engagement portion 35*e* is engaged with the engaged portion 11*a*, the ribbon supply shaft 33 is accommodated in the main body portion 31. Thereby, the ribbon supply shaft 33 is brought to a ribbon supply position where the ink ribbon R is supplied to the printing portion 15.

In such a way, by engaging the engagement portion 35*e* with the engaged portion 11*a*, the partition member 35 is maintained at the close position where the ribbon supply shaft 33 is placed at the ribbon supply position. The printing unit 30 and the cover 11 are combined with each other.

At the time of performing printing by the printer 100, the cover 11 is brought into the close state, and the engagement portion 35*e* of the partition member 35 is engaged with the engaged portion 11*a* of the cover 11.

Figure 4:
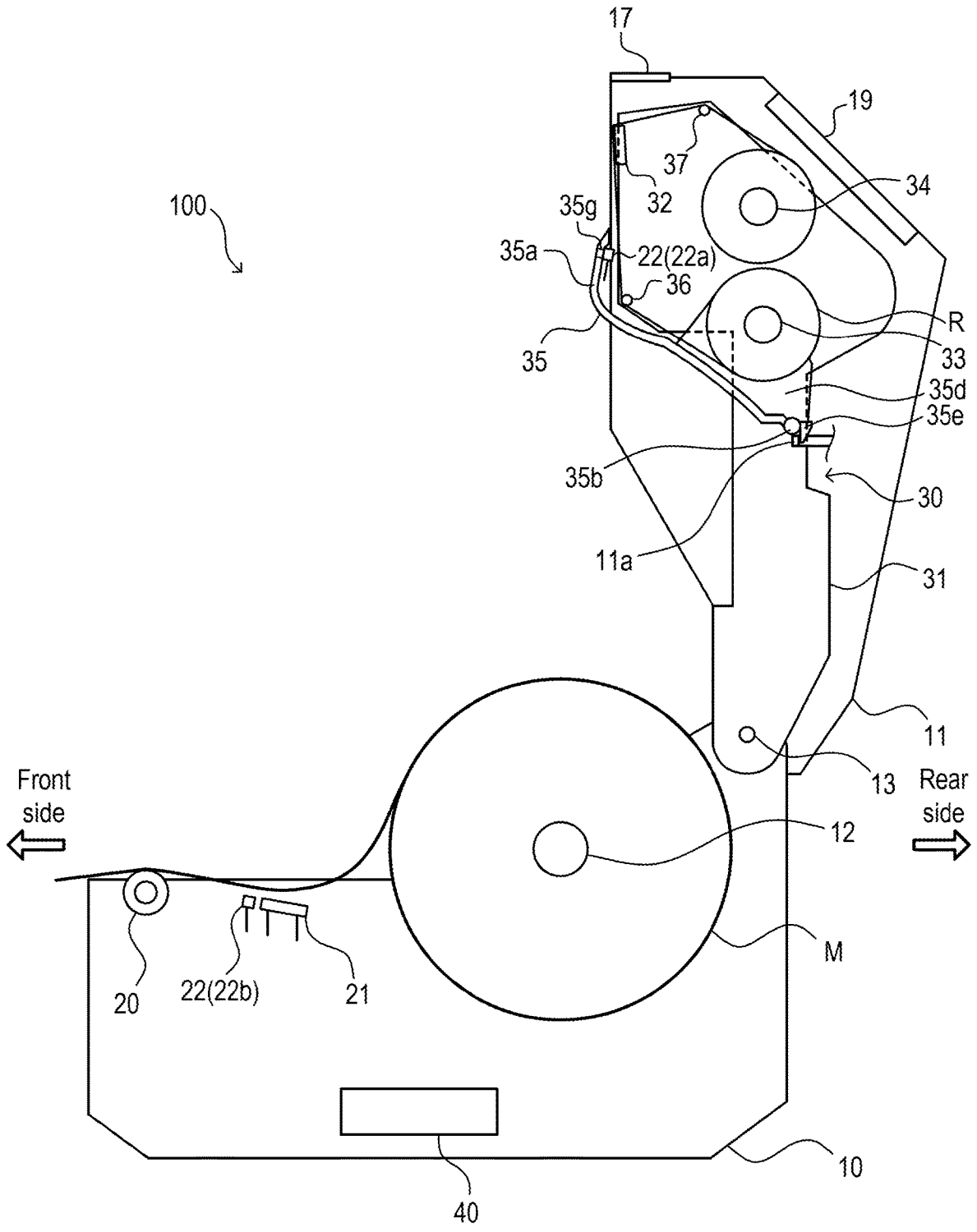
FIG. 4 is a view showing a state where a cover is opened.

Therefore, when the cover 11 is brought into the open state from the close state, the printing unit 30 is swung integrally with the cover 11, and as shown in FIG. 4, the opening portion of the casing 10 is opened.

Thereby, it is possible to perform settings of the print medium M to the printer 100 and maintenance of portions in the casing 10.

Figure 5:
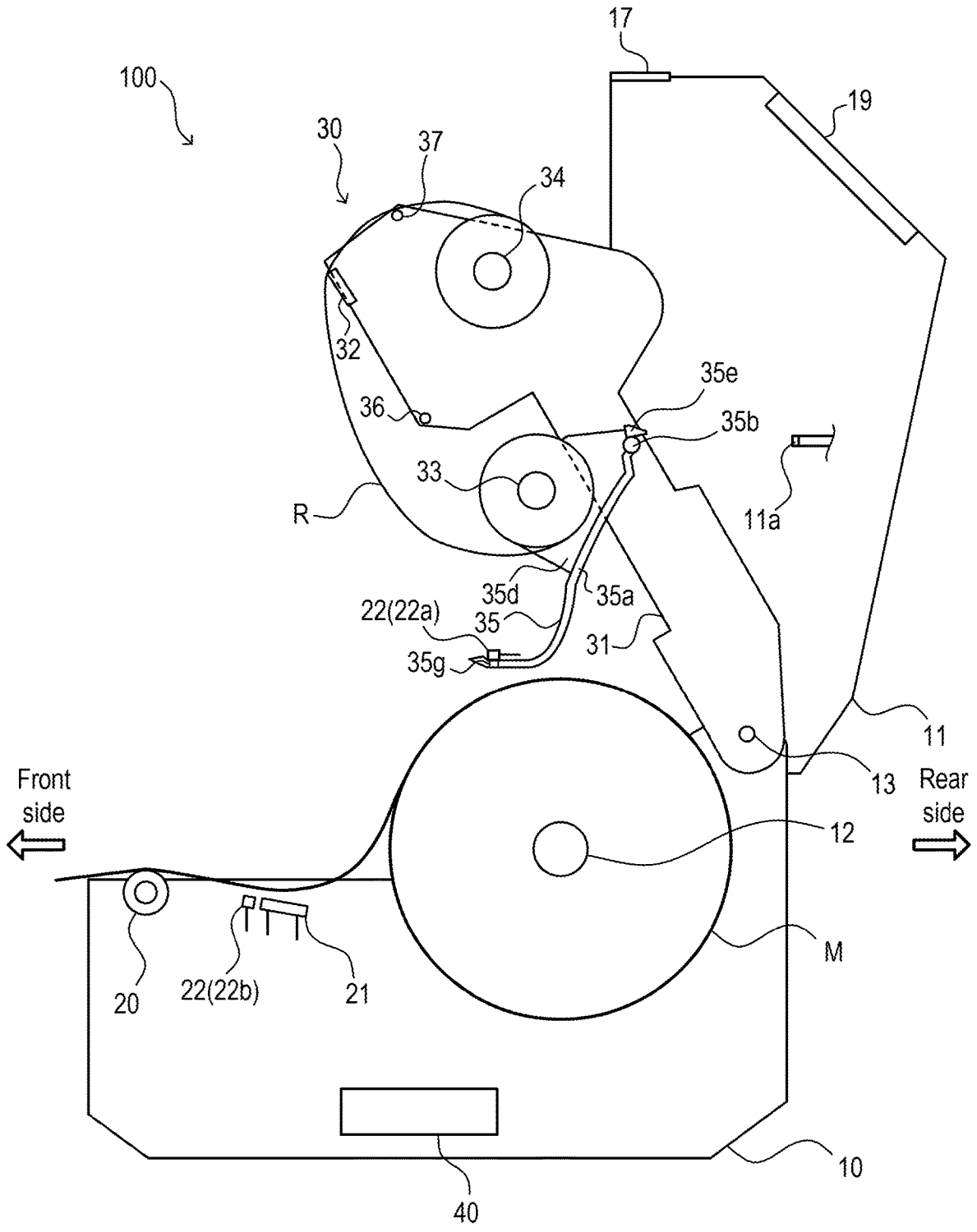
FIG. 5 is a view showing a state where the ribbon supply shaft is placed at a ribbon replacement position.

Further, when engagement between the engagement portion 35*e* and the engaged portion 11*a* is cancelled from the state shown in FIG. 4 and the partition member 35 is swung to the casing 10 side, the partition member 35 is brought to an open position shown in FIG. 5.

Following the state that the partition member 35 is brought to the open position, the ribbon supply shaft 33 and the roll-form ink ribbon R held by the ribbon supply shaft 33 are moved with respect to the ribbon roll up shaft 34, and exposed to the outlet port 16 side of the print medium M.

Thereby, the ribbon supply shaft 33 is brought to a ribbon replacement position where the ribbon supply shaft is attachable to and detachable from the printer 100, and it is possible to perform a task of replacing the ink ribbon R.

In such a way, in the present embodiment, the ribbon supply shaft 33 is movable with respect to the ribbon roll up shaft 34. At the time of replacing the ink ribbon R, it is possible to move the ribbon supply shaft 33 to the position where the task can be easily performed.

The ribbon supply shaft 33 is exposed to the outlet port 16 of the print medium M, that is, to the side of a position where a user performs tasks. Thereby, it is possible to improve workability more.

In a state where the ribbon supply shaft 33 is placed at the ribbon replacement position, as shown in FIG. 5, all the feed passages of the ink ribbon R from the ribbon supply shaft 33 to the ribbon roll up shaft 34 are exposed. Therefore, a task of putting the ink ribbon R from the ribbon supply shaft 33 to the ribbon roll up shaft 34 is more easily performed.

When the partition member 35 is swung to the casing 10 side with torque which is predetermined torque or more, the engagement portion 35*e* and the engaged portion 11*a* are elastically deformed and the engagement between the engagement portion 35*e* and the engaged portion 11*a* is cancelled.

Note that by cancelling the engagement between the engagement portion 35*e* and the engaged portion 11*a*, the printing unit 30 itself is swung to a predetermined position toward the casing 10 side. The predetermined position is a position where a swing regulating portion (not shown) provided in the vicinity of the support shaft 13 in the casing 10 and the main body portion 31 are abutted with each other.

When the printing unit 30 is swung to the casing 10 side with torque which is predetermined torque or more, the swing regulating portion is elastically deformed, the main body portion 31 goes over the swing regulating portion, and the positioning of the printing unit 30 by the swing regulating portion is cancelled.

As shown in FIG. 2, the base portion 35*a* of the partition member 35 extends to a position where the base portion 35*a* opposes a reflection sensor 21 provided in the casing 10. Thereby, a feed passage of the print medium M is formed between the reflection sensor 21 and the part of the partition member 35 opposing the reflection sensor 21.

The reflection sensor 21 is a sensor that detects eye marks which are preliminarily printed on a surface of the print medium M opposite to a printed surface at predetermined intervals. Thereby, it is possible to detect a position of the print medium M in the feed direction.

In the present embodiment, by the partition member 35 guiding the print medium M, the print medium M is stably fed within a fixed distance from the reflection sensor 21. Thereby, it is possible to improve detection precision of the reflection sensor 21.

Note that when the printer 100 is brought into a printable state, that is, into the state shown in FIG. 2, the partition member 35 is automatically brought into a state of guiding the print medium M.

In such a way, since the print medium M is guided by the partition member 35, there is no need for separately providing a guide member for feeding the print medium M within a fixed distance from the reflection sensor 21, and a task of inserting the print medium M into the guide member is also not required.

The printer 100 also includes a light transmission sensor 22 that detects the position of the print medium M in the feed direction.

The light transmission sensor 22 is a sensor having a light emitting unit 22*a* which serves as a light emitting portion that emits predetermined light, and a light receiving unit 22*b* which serves as a light receiving portion that receives the light emitted from the light emitting unit 22*a* and outputs an electric signal corresponding to intensity of the received light.

For example, in a case where the print medium M is a label continuous body in which plural labels are continuously temporarily attached to a band-shaped liner sheet at predetermined intervals, there is an only-liner part between two adjacent labels.

Between the label part and the only-liner part, a transmission amount of the light emitted from the light emitting unit 22*a* is different, and hence the intensity of the light received by the light receiving unit 22*b* is changed. Thereby, the light transmission sensor 22 can detect the position of the print medium M in the feed direction.

In the present embodiment, as shown in FIGS. 2 and 3, the light emitting unit 22*a* is provided on the opposite side of the feed passage of the print medium M in the base portion 35*a*, that is, on the upper surface side of the base portion 35*a*. In the base portion 35*a*, a through hole 35*g* through which the light emitted from the light emitting unit 22*a* passes is formed. Meanwhile, as shown in FIG. 2, the light receiving unit 22*b* is provided on the casing 10 side across the feed passage.

As described above, the task of setting the print medium M in the printer 100 is performed in a state where the printing unit 30 is placed at a non-printing position and the opening portion of the casing 10 is opened.

That is, in the present embodiment, it is possible to set the print medium M in the printer 100 in a state where a portion between the light emitting unit 22*a* and the light receiving unit 22*b* is widely opened. Thus, it is possible to easily perform the task of setting the print medium M in the printer 100. Note that the position of the light emitting unit 22*a* may be exchanged with the position of the light receiving unit 22*b*.

The printer 100 activates any of the reflection sensor 21 and the light transmission sensor 22 in accordance with a type of a print medium M to be used, and detects the position of the print medium M in the feed direction.

For example, in a case where a print medium M provided with no eye marks is used, the printer 100 detects the position of the print medium M by the light transmission sensor 22.

The controller 40 is constituted by a microprocessor, storage devices such as a ROM and a RAM, an input/output interface, buses that connect these members, etc. Print data from external computers, signals from the reflection sensor 21, signals from the light transmission sensor 22, etc. are inputted to the controller 40 via the input/output interface.

The controller 40 executes a print control program stored in the storage device by the microprocessor, and controls electricity distribution to the heating element of the thermal head 32, electricity distribution to the platen drive motor, etc.

Successively, the printing unit 30 will be described in detail with reference to FIGS. 6 and 7 mainly. Note that the ink ribbon R is omitted from FIGS. 6 and 7 for easy understanding.

Figure 6:
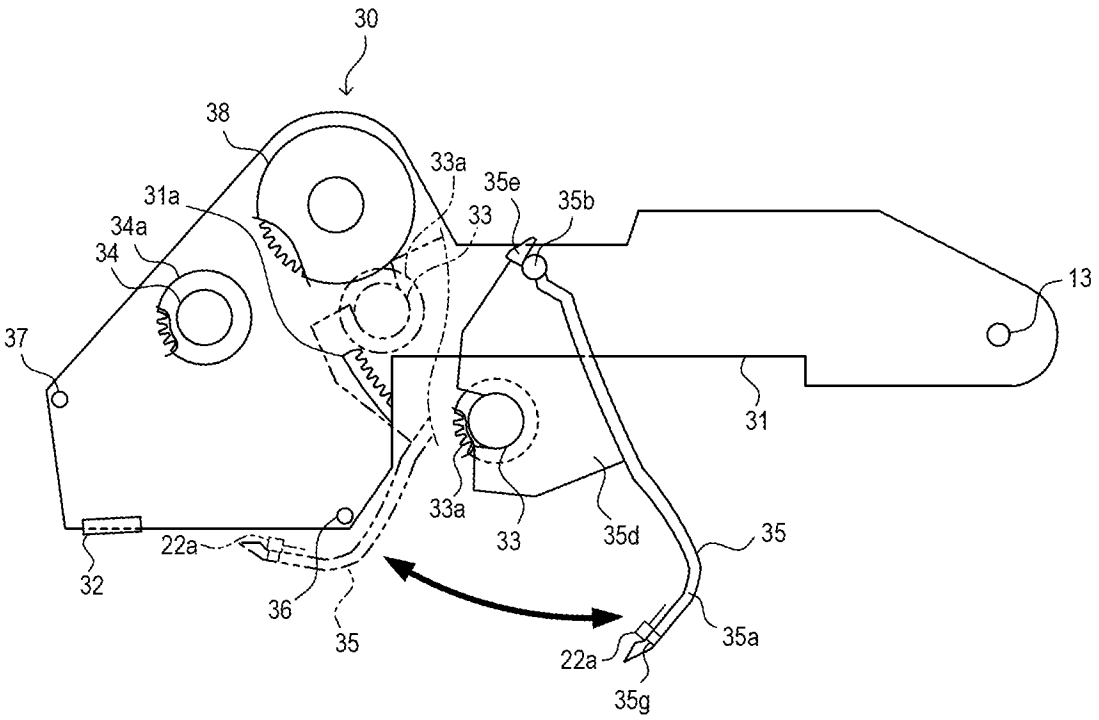
FIG. 6 is a view for explaining a printing unit.

As shown in FIGS. 3 and 6, the ribbon supply shaft 33 has a gear 33*a*.

As shown in FIG. 6, the printing unit 30 includes a gear 38 to mesh with the gear 33*a* in a state where the ribbon supply shaft 33 is placed at the ribbon supply position (double-chain line). The ribbon supply shaft 33 is driven by a supply shaft drive motor (not shown) via the gear 38.

As shown in FIG. 6, the ribbon roll up shaft 34 has a gear 34*a*. The ribbon roll up shaft 34 is driven by a roll up shaft drive motor (not shown) via a gear (not shown).

Rotation of the ribbon supply shaft 33 and the ribbon roll up shaft 34 is controlled by the controller 40 in synchronization with rotation of the platen roller 20. Note that the ribbon supply shaft 33 and the ribbon roll up shaft 34 may be driven by one drive motor.

As described above, the printing unit 30 includes the partition member 35 whose one end side is supported on the main body portion 31 by the shaft portion 35*b* so that the partition member is swingable. The ribbon supply shaft 33 is attached to the partition member 35.

Thereby, as shown in FIG. 6, when the partition member 35 is brought to the close position (double-chain line), the ribbon supply shaft 33 is brought to the ribbon supply position (double-chain line) where the ink ribbon R is supplied to the printing portion 15. When the partition member is brought to the open position (solid line), the ribbon supply shaft 33 is brought to the ribbon replacement position (solid line) where the ribbon supply shaft 33 is attachable to and detachable from the printer 100. Note that a lock mechanism (not shown) for holding the ribbon supply shaft 33 is provided in the partition member 35. By cancelling lock by the lock mechanism at the ribbon replacement position, the ribbon supply shaft 33 can be detached from the printer 100.

Figure 7:
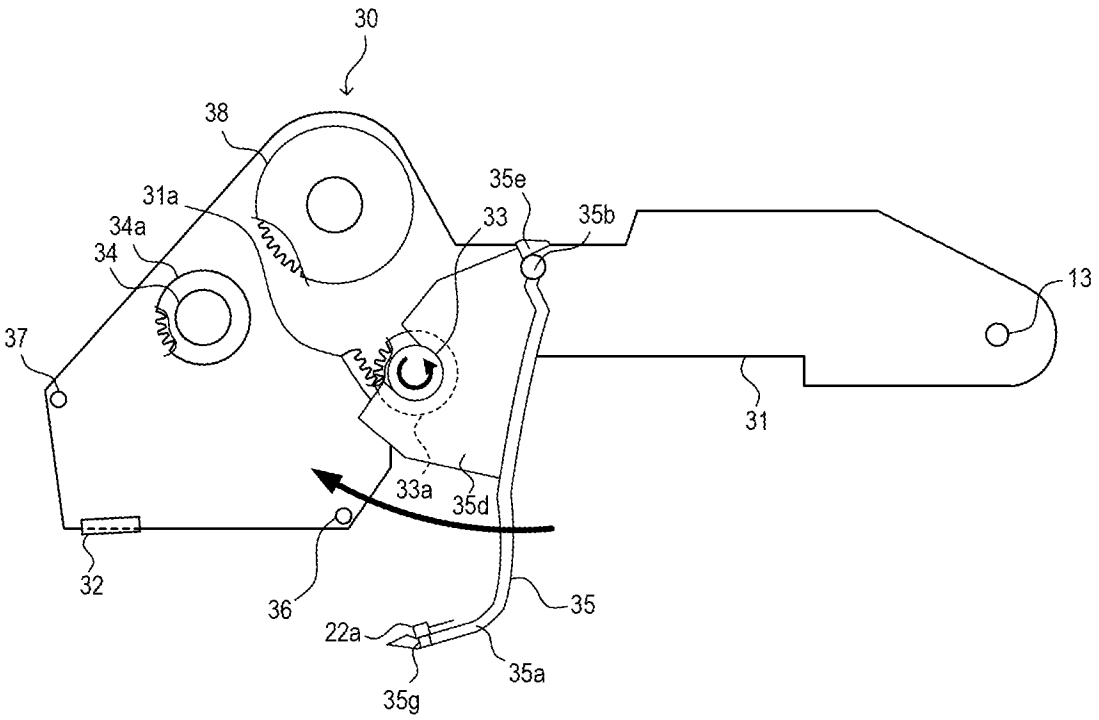
FIG. 7 is a view for explaining a situation where the partition member is brought from an open position to a close position.

As shown in FIGS. 6 and 7, a rack 31*a* is provided in the main body portion 31.

As shown in FIG. 7, the rack 31*a* meshes with the gear 33*a* in the middle of the partition member 35 moving from the open position to the close position, and rotates the ribbon supply shaft 33 in the direction in which the ink ribbon R is rolled up.

In a case where the ink ribbon R is replaced, etc., as shown in FIG. 5, there is sometimes a case where the ink ribbon R is loosened. In a case where the ink ribbon R is loosened, there is a need for rotating the ribbon supply shaft 33 or the ribbon roll up shaft 34 to remove looseness of the ink ribbon R.

Meanwhile, in the present embodiment, when the partition member 35 is brought from the open position to the close position, the ribbon supply shaft 33 is automatically rotated in the direction in which the ink ribbon R is rolled up, so that the looseness of the ink ribbon R is removed. Therefore, it is possible to prevent occurrence of printing failure due to the looseness of the ink ribbon R.

Note that meshing between the gear 33*a* and the rack 31*a* is cancelled immediately before the ribbon supply shaft 33 is brought to the ribbon supply position. Therefore, the rack 31*a* does not inhibit rotation of the ribbon supply shaft 33 at the time of printing.

Immediately after the meshing between the gear 33*a* and the rack 31*a* is cancelled, the gear 33*a* meshes with the gear 38. Thus, it is possible to suppress that the ribbon supply shaft 33 is rotated in the direction in which the ink ribbon R is supplied to the printing portion 15 within a period from cancellation of the meshing between the gear 33*a* and the rack 31*a* to meshing between the gear 33*a* and the gear 38.

As described above, the printer 100 includes the printing portion 15 that performs printing to the print medium M, the ribbon supply shaft 33 that holds the ink ribbon R to be supplied to the printing portion 15, and the ribbon roll up shaft 34 that rolls up the used ink ribbon R. The ribbon supply shaft 33 is provided movably with respect to the ribbon roll up shaft 34.

The ribbon supply shaft 33 is movable between the ribbon supply position where the ink ribbon R is supplied to the printing portion 15 and the ribbon replacement position where the ribbon supply shaft is attachable to and detachable from the printer 100.

According to this, at the time of replacing the ink ribbon R, it is possible to move the ribbon supply shaft 33 to the position where the task can be easily performed.

The printer 100 includes the swingably provided partition member 35 that partitions the ink ribbon R and the print medium M. The ribbon supply shaft 33 is attached to the partition member 35.

According to this, by using the swingably provided partition member 35, it is possible to realize a structure in which the ribbon supply shaft 33 is movable. Therefore, there is no need for separately providing a mechanism for making the ribbon supply shaft 33 movable.

The partition member 35 is swingable between the close position to bring the ribbon supply shaft 33 to the ribbon supply position and the open position to bring the ribbon supply shaft 33 to the ribbon replacement position. When the partition member 35 is brought to the open position, the ribbon supply shaft 33 is exposed to the outlet port 16 of the print medium M.

According to this, the ribbon supply shaft 33 is exposed to the outlet port 16 of the print medium M, that is, to the side of the position where the user performs tasks. Thus, it is possible to easily replace the ink ribbon R.

When the partition member 35 is moved from the open position to the close position, the ribbon supply shaft 33 is rotated in the direction in which the ink ribbon R is rolled up.

According to this, it is possible to prevent the occurrence of the printing failure due to the looseness of the ink ribbon R.

The printer 100 includes the swingably provided printing unit 30 having the thermal head 32 that constitutes the printing portion 15. The ribbon supply shaft 33, the ribbon roll up shaft 34, and the partition member 35 are provided in the printing unit 30.

The printer 100 includes the printing portion 15 that performs printing to the print medium M, the ribbon supply shaft 33 that holds the ink ribbon R to be supplied to the printing portion 15, the ribbon roll up shaft 34 that rolls up the used ink ribbon R, the swingably provided printing unit 30 having the thermal head 32 that constitutes the printing portion 15, and the partition member 35 swingably provided in the printing unit 30, the partition member that partitions the ink ribbon R and the print medium M. The ribbon supply shaft 33 is provided in the partition member 35.

According to this, at the time of replacing the ink ribbon R, it is possible to move the ribbon supply shaft 33 to the position where the task can be easily performed by swinging the partition member 35. Therefore, the ink ribbon R is more easily replaced.

The partition member 35 is swingable between the close position to bring the ribbon supply shaft 33 to the ribbon supply position where the ink ribbon R can be supplied to the printing portion 15, and the open position to bring the ribbon supply shaft 33 to the ribbon replacement position where the ribbon supply shaft is attachable to and detachable from the printer 100.

According to this, when the partition member 35 is brought to the open position, the ribbon supply shaft 33 is brought to the ribbon replacement position. Thus, it is possible to easily replace the ink ribbon R.

According to this, when the partition member 35 is brought to the open position, the ribbon supply shaft 33 is exposed to the outlet port 16 of the print medium M.

According to this, when the partition member 35 is brought to the open position, the ribbon supply shaft 33 is exposed to the outlet port 16 of the print medium M, that is, to the side of the position where the user performs tasks. Thus, it is possible to easily replace the ink ribbon R.

The ribbon supply shaft 33 is configured to be attachable and detachable on the front side of the printer 100, and the ribbon roll up shaft 34 is configured to be attachable and detachable on the upper side.

As shown in FIGS. 2, 4, and 5, the "front side of the printer 100" is the outlet port 16 of the print medium M, that is, the side of the position where the user performs tasks, and the opposite side is the rear side of the printer 100.

Figure 8:
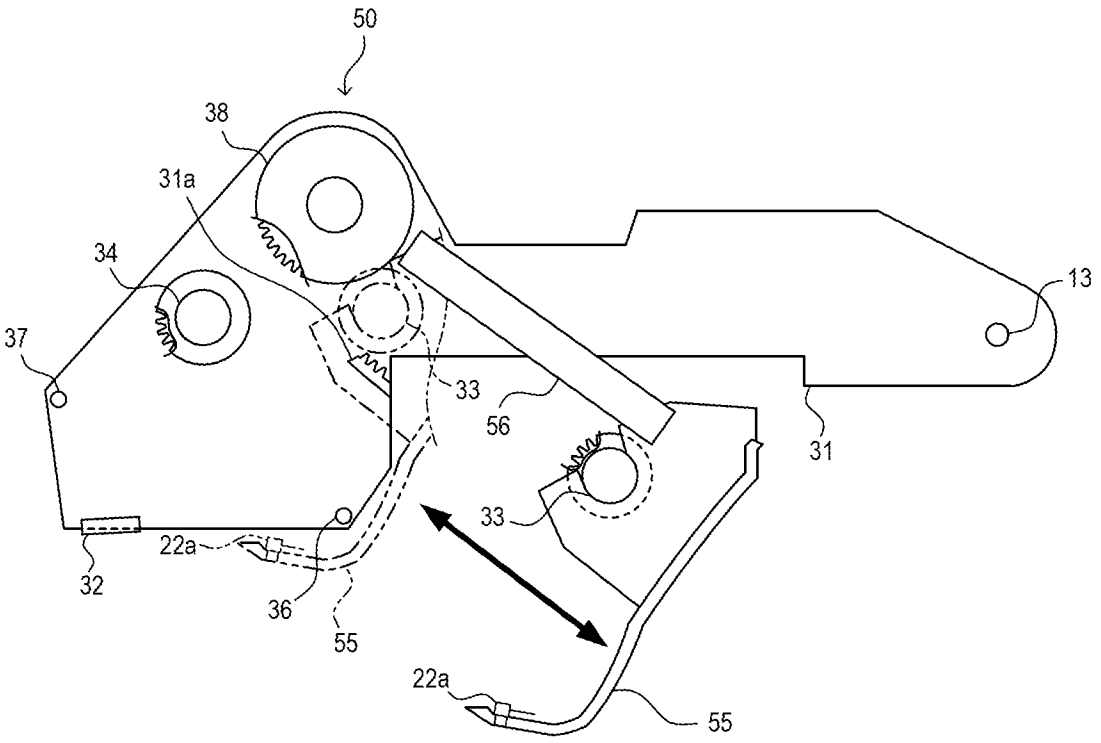
FIG. 8 is a view for explaining a modified example of the printing unit.

Note that in the above embodiment, by providing the partition member 35 in the printing unit 30 swingably, the ribbon supply shaft 33 attached to the partition member 35 is moved with respect to the ribbon roll up shaft 34. However, as in a printing unit 50 shown in FIG. 8, the ribbon supply shaft 33 may be moved by providing a slide mechanism 56 that lets a partition member 55 slide.

Second Embodiment

Hereinafter, a printer 200 according to a second embodiment will be described with reference to FIGS. 9 to 11. Differences from the first embodiment will be mainly described below, similar configurations to the first embodiment will be given the same reference signs, and description thereof will be omitted.

Figure 9:
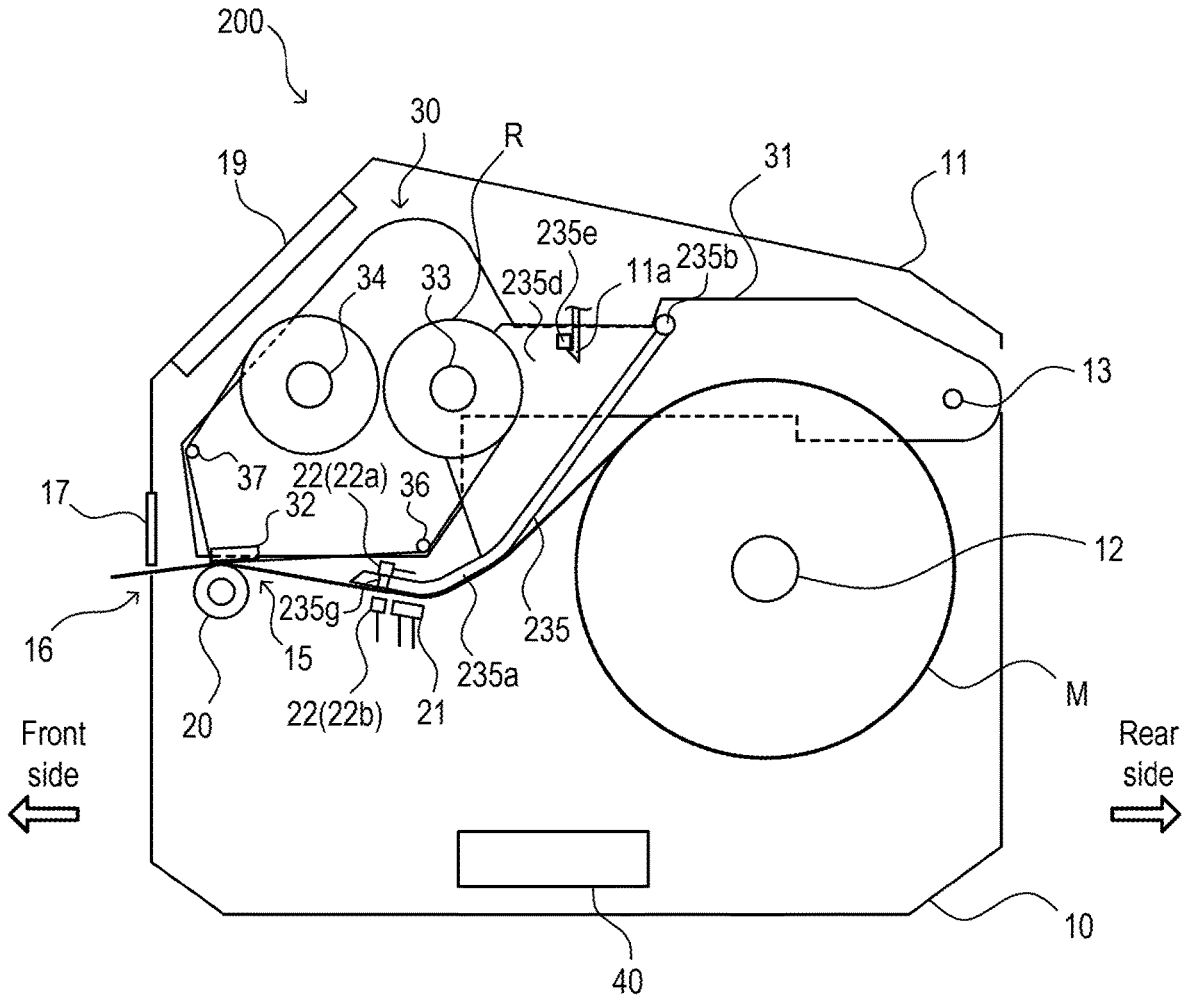
FIG. 9 is a schematic configuration view of a printer according to a second embodiment.

As shown in FIG. 9, a printing unit 30 of the present embodiment includes a ribbon supply shaft 33 that holds an ink ribbon R to be supplied to a printing portion 15 in a roll form, a ribbon roll up shaft 34 that rolls up the used ink ribbon R, a partition member 235 that partitions the ink ribbon R and a print medium M, a guide shaft 36 that defines a feed passage of the ink ribbon R from the ribbon supply shaft 33 to the printing portion 15, and a guide shaft 37 that defines a feed passage of the ink ribbon R from the printing portion 15 to the ribbon roll up shaft 34. The ribbon supply shaft 33 is detachably attached to the partition member 235. The ribbon roll up shaft 34 is detachably attached to a main body portion 31. Note that the ink ribbon R of the present embodiment is an outside wound ink ribbon in which a surface where inks are applied are on the outside.

The partition member 235 has a base portion 235*a*, a shaft portion 235*b* provided on the one end side of the base portion 235*a*, a support portion 235*c* and a support portion 235*d* that rotatably support the ribbon supply shaft 33 in parallel to the shaft portion 235*b*, and an engagement portion 235*e* formed between the support portion 235*c* and the support portion 235*d*. The support portion 235*c* is not shown in the figure but serves as a configuration corresponding to the support portion 35*c*.

The partition member 235 is swingably supported on the main body portion 31 by the shaft portion 235*b*.

As shown in FIG. 9, the engagement portion 235*e* is configured to be engaged with an engaged portion 11*a* provided in a cover 11. When the partition member 235 is brought to a position (close position) where the engagement portion 235*e* is engaged with the engaged portion 11*a*, the ribbon supply shaft 33 is accommodated in the main body portion 31. Thereby, the ribbon supply shaft 33 is brought to a ribbon supply position where the ink ribbon R is supplied to the printing portion 15.

In such a way, by engaging the engagement portion 235*e* with the engaged portion 11*a*, the partition member 235 is maintained at the close position where the ribbon supply shaft 33 is placed at the ribbon supply position. The printing unit 30 and the cover 11 are combined with each other.

At the time of performing printing by the printer 200, the cover 11 is brought into a close state, and the engagement portion 235*e* of the partition member 235 is engaged with the engaged portion 11*a* of the cover 11.

Figure 10:
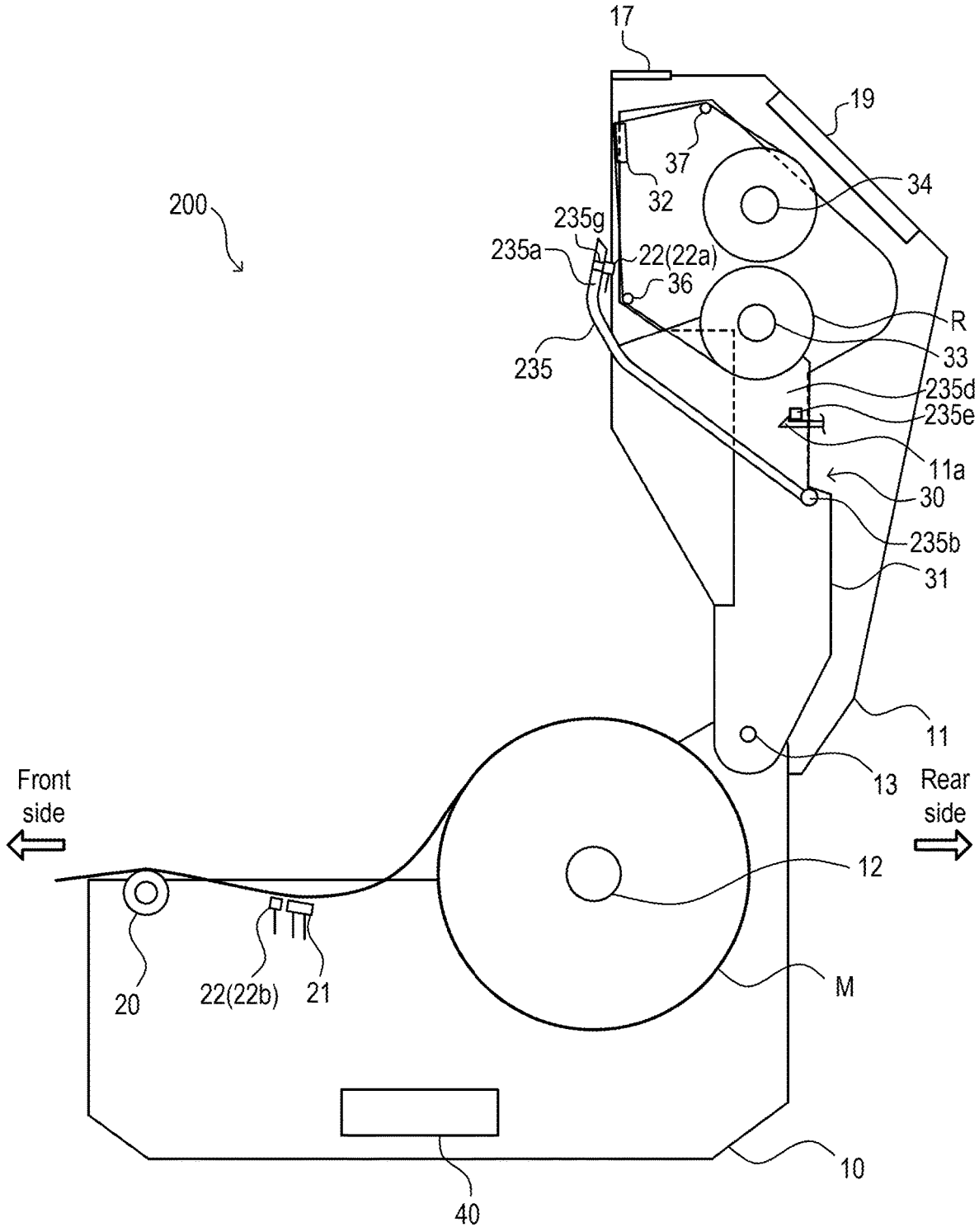
FIG. 10 is a view showing a state where a cover is opened.

Therefore, when the cover 11 is brought into an open state from the close state, the printing unit 30 is swung integrally with the cover 11, and as shown in FIG. 10, an opening portion of a casing 10 is opened.

Thereby, it is possible to perform settings of the print medium M to the printer 200 and maintenance of portions in the casing 10.

Figure 11:
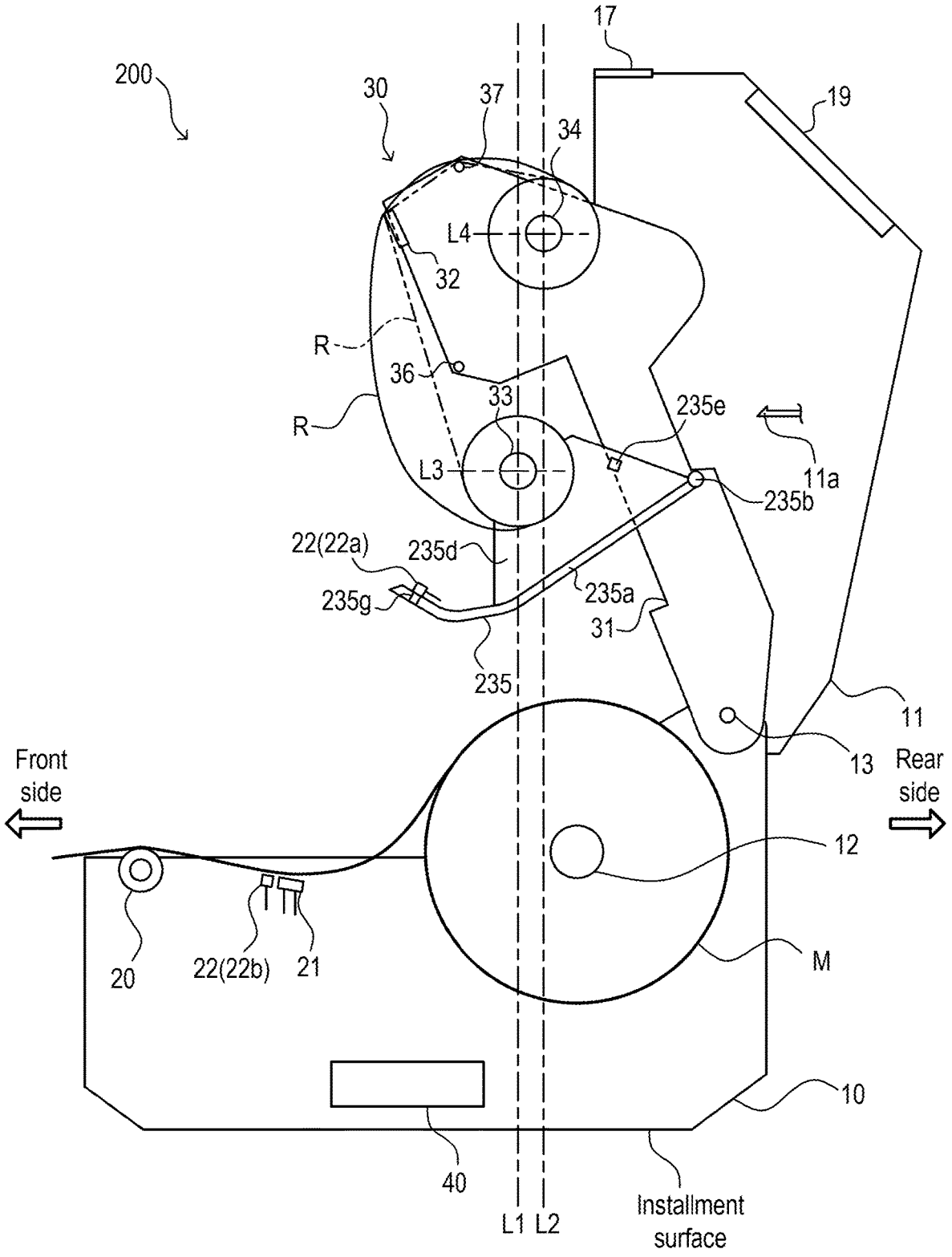
FIG. 11 is a view showing a state where a ribbon supply shaft is placed at a ribbon replacement position.

Further, when engagement between the engagement portion 235*e* and the engaged portion 11*a* is cancelled from the state shown in FIG. 10 and the partition member 235 is swung to the casing 10 side, the partition member 235 is brought to an open position shown in FIG. 11.

When the partition member 235 is swung to the casing 10 side with torque which is predetermined torque or more, the engagement portion 235*e* and the engaged portion 11*a* are elastically deformed and the engagement between the engagement portion 235*e* and the engaged portion 11*a* is cancelled.

Following the state that the partition member 235 is brought to the open position, the ribbon supply shaft 33 detachably attached to the partition member 235 and the roll-form ink ribbon R held by the ribbon supply shaft 33 are moved with respect to the ribbon roll up shaft 34, and exposed to the outlet port 16 of the print medium M.

By cancelling the engagement between the engagement portion 235*e* and the engaged portion 11*a*, the printing unit 30 itself is swung to a predetermined position toward the casing 10 side. The predetermined position is a position where a swing regulating portion (not shown) provided in the vicinity of a support shaft 13 in the casing 10 and the main body portion 31 are abutted with each other.

Thereby, the ribbon supply shaft 33 is brought to a ribbon replacement position where the ribbon supply shaft 33 is attachable to and detachable from the printer 200, and it is possible to perform a task of replacing the ink ribbon R.

Note that when the printing unit 30 is swung to the casing 10 side with torque which is predetermined torque or more, the swing regulating portion is elastically deformed, the main body portion 31 goes over the swing regulating portion, and the positioning of the printing unit 30 by the swing regulating portion is cancelled.

In such a way, in the present embodiment, the ribbon supply shaft 33 is movable with respect to the ribbon roll up shaft 34. Thus, at the time of replacing the ink ribbon R, it is possible to move the ribbon supply shaft 33 to a position where a task can be easily performed.

In more detail, in the present embodiment, as shown in FIG. 11, at the time of replacing the ink ribbon R where the partition member 235 is placed at the open position, the ribbon supply shaft 33 is positioned on the lower side of the ribbon roll up shaft 34 and on the front side of the printer 200 more than the ribbon roll up shaft 34. The ribbon supply shaft 33 is attachable and detachable on the front side of the printer 200, and the ribbon roll up shaft 34 is attachable and detachable on the upper side.

As shown in FIGS. 9 to 11, the "front side of the printer 200" is the outlet port 16 of the print medium M, that is, the side of a position where a user performs tasks, and the opposite side is the rear side of the printer 200.

The phrase that "the ribbon supply shaft 33 is positioned on the front side of the printer 200 more than the ribbon roll up shaft 34" indicates that a line L1 passing through center of the ribbon supply shaft 33, the line being perpendicular to an installment surface (bottom surface) of the printer 200 is on the front side of the printer 200 more than a line L2 passing through center of the ribbon roll up shaft 34, the line being perpendicular to the installment surface of the printer 200. The phrase that "the ribbon supply shaft 33 is positioned on the lower side of the ribbon roll up shaft 34" indicates that a line L3 passing through the center of the ribbon supply shaft 33, the line being parallel to the installment surface of the printer 200 is on the lower side of a line L4 passing through the center of the ribbon roll up shaft 34, the line being parallel to the installment surface of the printer 200 (see FIG. 11).

According to this, at the time of replacing the ink ribbon R, the ribbon supply shaft 33 is positioned on the lower side of the ribbon roll up shaft 34. Thus, when the user attaches or detaches the ribbon roll up shaft 34, the ribbon supply shaft 33 does not disturb the task. The ribbon supply shaft 33 is also positioned on the front side of the printer 200 more than the ribbon roll up shaft 34. Thus, the user performing the task of replacing the ink ribbon R from the front side of the printer 200 more easily confirms the ribbon supply shaft 33, and the user can attach or detach the ribbon supply shaft 33 without performing a troublesome action such as looking into the ribbon supply shaft 33 from the lower side. Therefore, it is possible to easily replace the ink ribbon R.

In a case where the ink ribbon R is replaced, etc., as shown by a solid line in FIG. 11, there is sometimes a case where the ink ribbon R is loosened. In a case where the ink ribbon R is loosened, in order to prevent occurrence of wrinkles, there is a need for a task of rotating the ribbon supply shaft 33 or the ribbon roll up shaft 34 to remove looseness of the ink ribbon R.

In the present embodiment, in a state where the looseness of the ink ribbon R is removed at the time of replacing the ink ribbon R, as shown by a double-chain line in FIG. 11, a part of the ink ribbon R running from the ribbon supply shaft 33 to an end portion of the printing unit 30 on the front side of the printer 200 (leading end of the printing unit 30) is either abutted with two points including the thermal head 32 and the end portion of the printing unit 30 on the front side of the printer 200, or abutted with only the end portion of the printing unit 30 on the front side of the printer 200.

In the ink ribbon R, the more there are bent points, the more likely wrinkles occur. When wrinkles occur between the ribbon supply shaft 33 and the thermal head 32, there is a possibility that printing failure occurs. Meanwhile, in the present embodiment, at the time of replacing the ink ribbon R, the part of the ink ribbon R from the ribbon supply shaft 33 to the end portion of the printing unit 30 on the front side of the printer 200 is either abutted with the two points including the thermal head 32 and the end portion of the printing unit 30 on the front side of the printer 200, or abutted with only the end portion of the printing unit 30 on the front side of the printer 200. That is, a part of the ink ribbon R between the ribbon supply shaft 33 and the thermal head 32 is not abutted with anything and has no bent points. Therefore, it is possible to suppress occurrence of wrinkles.

In the present embodiment, as shown in FIG. 9, the base portion 235*a* of the partition member 235 extends to a position where the base portion opposes a reflection sensor 21 provided in the casing 10. Thereby, a feed passage of the print medium M is formed between the reflection sensor 21 and the part of the partition member 235 opposing the reflection sensor 21.

In the present embodiment, a light emitting unit 22*a* of a light transmission sensor 22 is provided on the opposite side of the feed passage of the print medium M in the base portion 235*a*, that is, on the upper surface side of the base portion 235*a*. In the base portion 235*a*, a through hole 235*g* through which the light emitted from the light emitting unit 22*a* passes is formed. Meanwhile, a light receiving unit 22*b* of the light transmission sensor 22 is provided on the casing 10 side across the feed passage.

According to the present embodiment, it is possible to obtain similar effects to the first embodiment.

Further, in the present embodiment, the ribbon replacement position is positioned on the lower side of the ribbon roll up shaft 34 and on the front side of the printer 200 more than the ribbon roll up shaft 34. In other words, at the ribbon replacement position, the ribbon supply shaft 33 is positioned on the lower side of the ribbon roll up shaft 34 and on the front side of the printer 200 more than the ribbon roll up shaft 34.

According to this, at the time of replacing the ink ribbon R, the ribbon supply shaft 33 is positioned on the lower side of the ribbon roll up shaft 34. Thus, at the time of attaching or detaching the ribbon roll up shaft 34, the ribbon supply shaft 33 does not disturb the task. The ribbon supply shaft 33 is also positioned on the front side of the printer 200 more than the ribbon roll up shaft 34. Thus, the user performing the task of replacing the ink ribbon R from the front side of the printer 200 more easily confirms the ribbon supply shaft 33, and the user can attach or detach the ribbon supply shaft 33 without performing a troublesome action such as looking into the ribbon supply shaft 33 from the lower side. Therefore, it is possible to easily replace the ink ribbon R.

In the printer 200, in a state where the ribbon supply shaft 33 is placed at the ribbon replacement position and the looseness of the ink ribbon R is removed, the part of the ink ribbon R from the ribbon supply shaft 33 to the end portion of the printing unit 30 on the front side of the printer 200 is either abutted with the two points including the thermal head 32 and the end portion of the printing unit 30 on the front side of the printer 200, or abutted with only the end portion of the printing unit 30 on the front side of the printer 200.

According to this, at the time of replacing the ink ribbon R, the part of the ink ribbon R between the ribbon supply shaft 33 and the thermal head 32 is not abutted with anything and has no bent points. Therefore, it is possible to suppress the occurrence of wrinkles of the ink ribbon R.

The ribbon supply shaft 33 is configured to be attachable and detachable on the front side of the printer 200, and the ribbon roll up shaft 34 is configured to be attachable and detachable on the upper side.

Third Embodiment

Hereinafter, a printer 300 according to a third embodiment will be described with reference to FIG. 12. Differences from the second embodiment will be mainly described below, similar configurations to the second embodiment will be given the same reference signs, and description thereof will be omitted.

Figure 12:
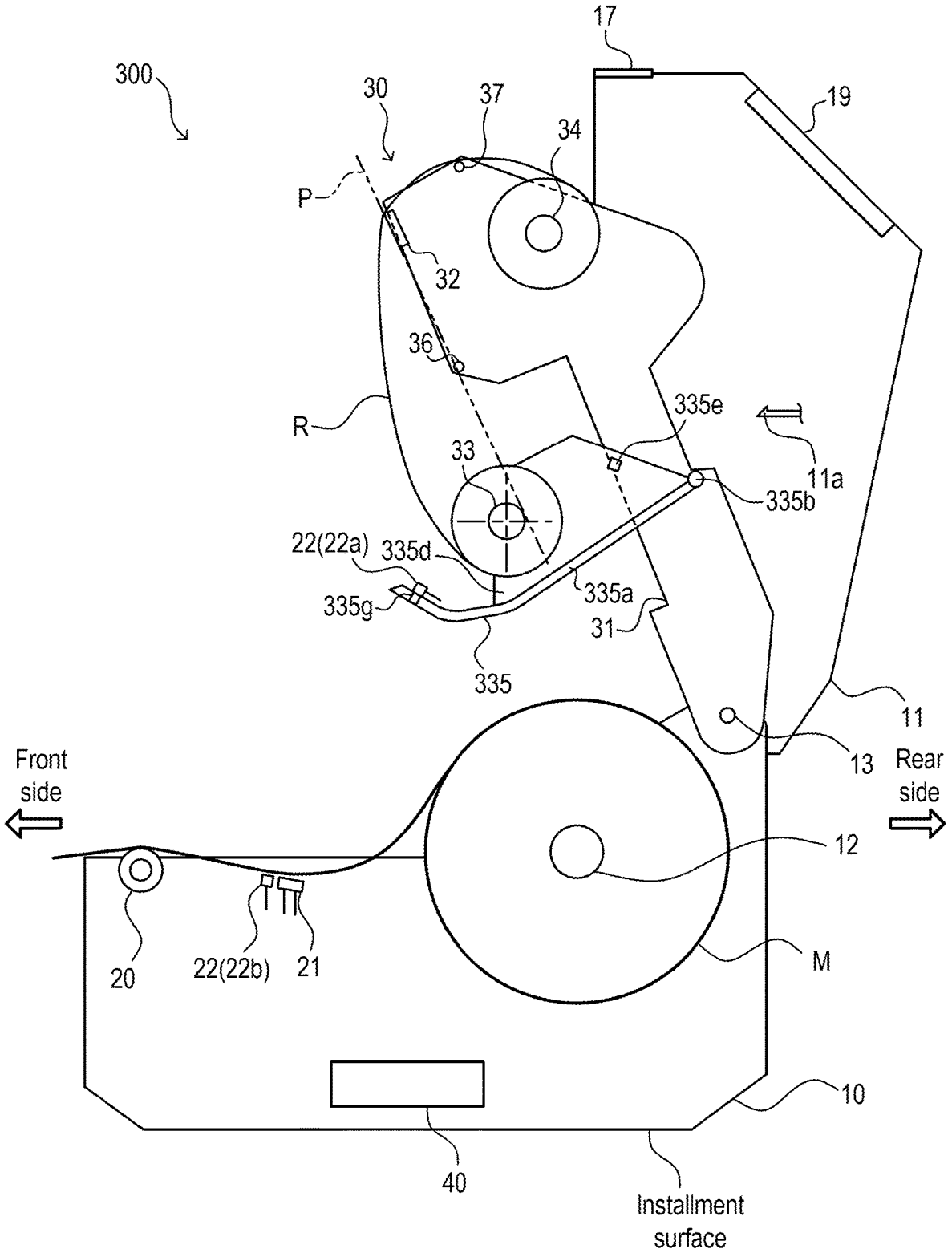
FIG. 12 is a view showing a state where a ribbon supply shaft of a printer according to a third embodiment is placed at a ribbon replacement position.

As shown in FIG. 12, a printing unit 30 of the present embodiment includes a ribbon supply shaft 33 that holds an ink ribbon R to be supplied to a printing portion 15 in a roll form, a ribbon roll up shaft 34 that rolls up the used ink ribbon R, a partition member 335 that partitions the ink ribbon R and a print medium M, a guide shaft 36 that defines a feed passage of the ink ribbon R from the ribbon supply shaft 33 to the printing portion 15, and a guide shaft 37 that defines a feed passage of the ink ribbon R from the printing portion 15 to the ribbon roll up shaft 34. The ribbon supply shaft 33 is detachably attached to the partition member 335. The ribbon roll up shaft 34 is detachably attached to a main body portion 31. Note that the ink ribbon R of the present embodiment is an outside wound ink ribbon in which a surface where inks are applied are on the outside.

The partition member 335 is different from the partition member 235 of the second embodiment in terms of a position to support the ribbon supply shaft 33. The other configurations of the partition member 335 are similar to the partition member 235 and hence will be given corresponding reference signs 335*a* to 335*g*, and description thereof will be omitted.

The position where the partition member 335 supports the ribbon supply shaft 33 is set so that as shown in FIG. 12, at the time of replacing the ink ribbon R where the partition member 335 is placed at an open position, the ribbon supply shaft 33 is positioned on the lower side of a plane P (double-chain line) containing a lower surface of a thermal head 32. The phrase that "the ribbon supply shaft 33 is positioned on the lower side of the plane P containing the lower surface of the thermal head 32" indicates that center of the ribbon supply shaft 33 is placed on the lower side of the plane P.

That is, in the present embodiment, a ribbon replacement position is positioned on the lower side of the plane containing the lower surface of the thermal head 32. In other words, the ribbon supply shaft 33 is positioned on the lower side of the plane containing the lower surface of the thermal head 32 at the ribbon replacement position.

Note that although the ribbon supply shaft 33 is positioned on the front side of the printer 300 more than the ribbon roll up shaft 34 in FIG. 12, the ribbon supply shaft 33 may be positioned on the rear side of the printer 300 more than the ribbon roll up shaft 34.

According to the present embodiment, it is possible to obtain similar effects to the first embodiment. Further, a user performing a task of replacing the ink ribbon R from the front side of the printer 300 more easily confirms the ribbon supply shaft 33, and the user can attach or detach the ribbon supply shaft 33 without performing a troublesome action such as looking into the ribbon supply shaft 33 from the lower side. Therefore, it is possible to easily replace the ink ribbon R.

Note that such effects can be obtained by positioning the ribbon replacement position on the lower side of the plane containing the lower surface of the thermal head 32. Therefore, depending on a position or an angle of the thermal head 32, it is possible to set the position where the partition member 335 supports the ribbon supply shaft 33 the same as the partition member 235 of the second embodiment.

As well as the second embodiment, in a state where the ribbon supply shaft 33 is placed at the ribbon replacement position and looseness of the ink ribbon R is removed, a part of the ink ribbon R from the ribbon supply shaft 33 to an end portion of the printing unit 30 on the front side of the printer 300 is either abutted with two points including the thermal head 32 and the end portion of the printing unit 30 on the front side of the printer 300, or abutted with only the end portion of the printing unit 30 on the front side of the printer 300. That is, a part of the ink ribbon R between the ribbon supply shaft 33 and the thermal head 32 is not abutted with anything and has no bent points. Therefore, it is possible to suppress occurrence of wrinkles of the ink ribbon R.

For example, in the above first to third embodiments, the printer 100, 200, 300 includes the cover 11. However, the printing unit 30 may function as a cover without providing the cover 11. In this case, an engaged portion to be engaged with the engagement portion 35*e*, 235*e*, 335*e* of the partition member 35, 235, 335 is provided in the main body portion 31 of the printing unit 30, etc.

Fourth Embodiment

Hereinafter, a printer 2100 according to a fourth embodiment will be described with reference to the attached drawings.

The printer 2100 is a thermal transfer printer in which an ink ribbon R is heated and inks of the ink ribbon R are transferred to a print medium M, so that printing is performed. The print medium M is, for example, a label continuous body in which plural labels are continuously temporarily attached to a band-shaped liner sheet.

Figure 13:
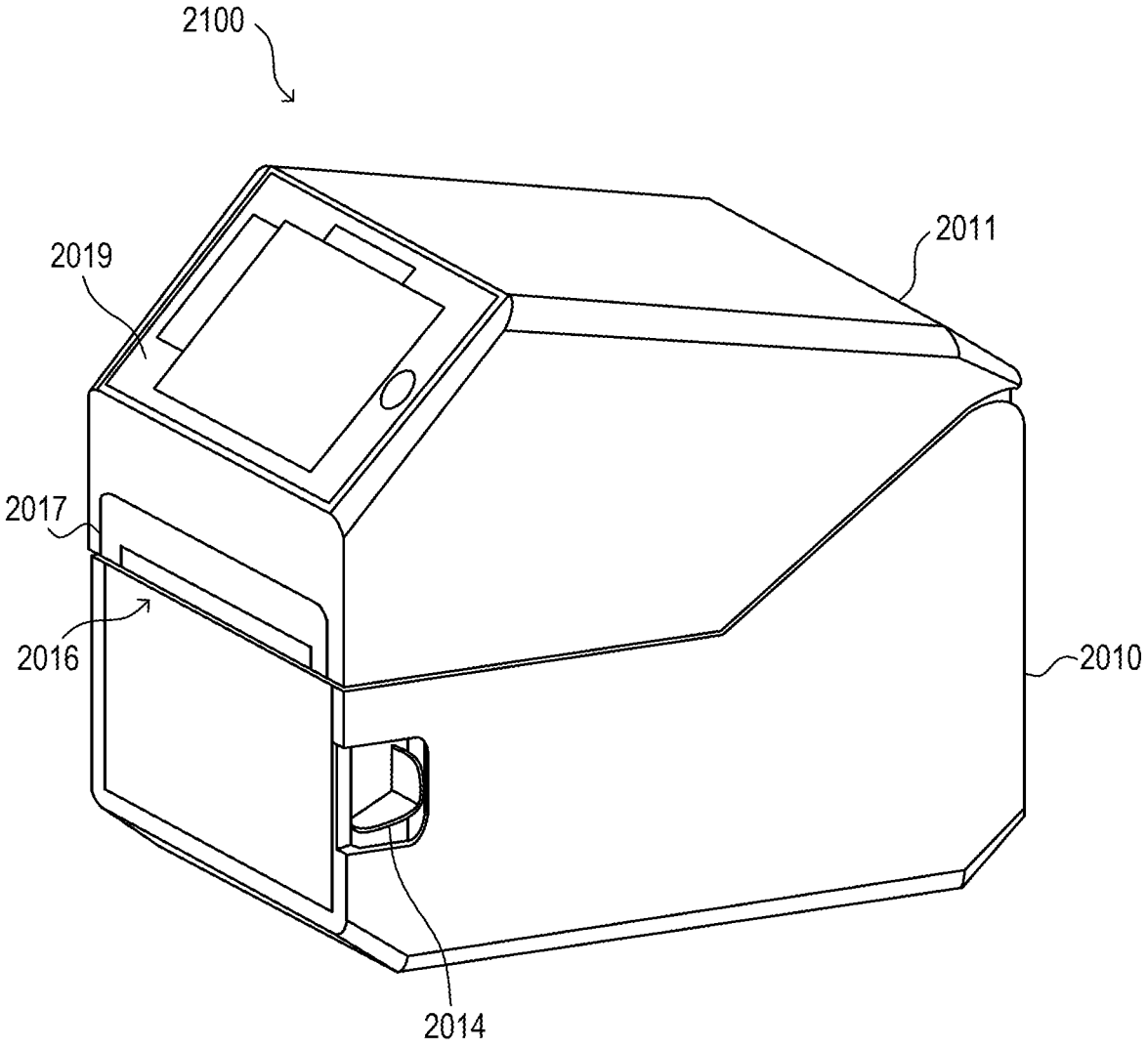
FIG. 13 is a perspective view of a printer according to a fourth embodiment.
Figure 14:
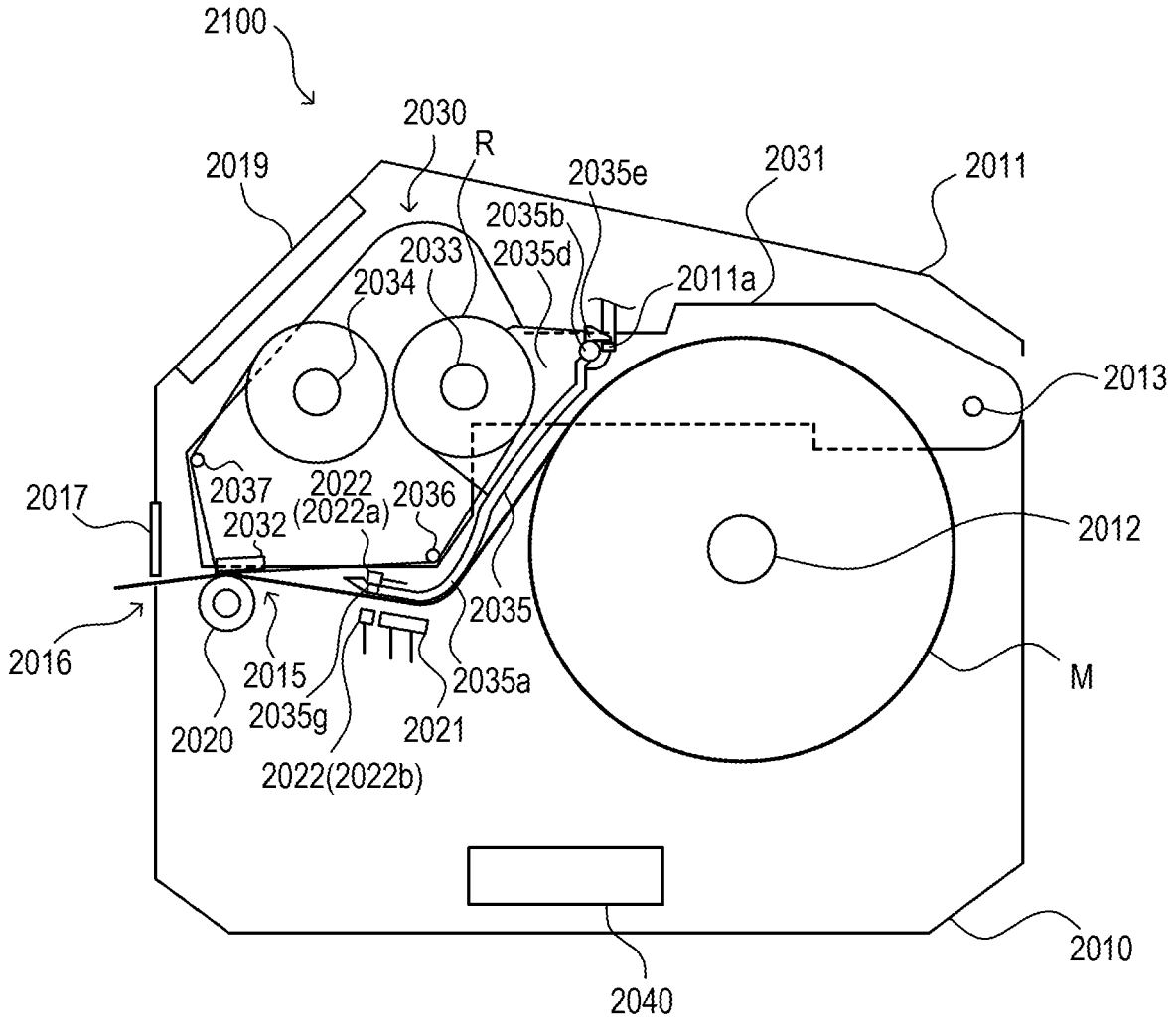
FIG. 14 is a schematic configuration view of the printer according to the fourth embodiment.

As shown in FIGS. 13 and 14, the printer 2100 includes a casing 2010, and a cover 2011 that covers an opening portion of the casing 2010.

As shown in FIG. 14, the print medium M is held on a medium supply shaft 2012 in a state where the print medium is wound in a roll form. Note that as the print medium M, a linerless label or a fanfold medium can also be used.

A one-end side end portion of the cover 2011 is supported by a support shaft 2013 provided in the casing 2010 so that the cover 2011 is swingable. By swinging with the support shaft 2013 as a supporting point, it is possible to switch the cover 2011 between an open state where the opening portion of the casing 2010 is opened (see FIG. 16) and a close state where the opening portion is closed (see FIG. 14).

A lock mechanism (not shown) that maintains the close state of the cover 2011 is provided in the casing 2010. The lock mechanism is cancelled by operating a lever 2014 shown in FIG. 13.

Between an other-end side end portion of the cover 2011 and the casing 2010, an outlet port 2016 that discharges the print medium M to which printing is already performed by a printing portion 2015 shown in FIG. 14 from the printer 2100 is formed.

A cutter 2017 facing the outlet port 2016 is attached to the cover 2011 of the present embodiment. Thereby, it is possible to cut the printed print medium M discharged from the outlet port 2016. Note that it is possible to attach various other units to the cover 2011 instead of the cutter 2017.

An operation unit 2019 for operating the printer 2100 is also provided in the cover 2011. The operation unit 2019 has various operation buttons, a display, a near-field communication module, LEDs, etc. The display may be a touch panel.

Inside the printer 2100, a printing unit 2030 for performing printing to the print medium M, a controller 2040 that controls actions of the printer 2100, etc. are accommodated.

The printing unit 2030 includes a main body portion 2031 whose one end side is supported by the support shaft 2013 so that the main body portion 2031 is swingable, and a thermal head 2032 attached to the main body portion 2031.

The thermal head 2032 constitutes the printing portion 2015 that performs printing to the print medium M together with a platen roller 2020 provided on the casing 2010 side.

The printing unit 2030 also includes a ribbon supply shaft 2033 that holds the ink ribbon R to be supplied to the printing portion 2015 in a roll form, a ribbon roll up shaft 2034 that rolls up the used ink ribbon R, a partition member 2035 that partitions the ink ribbon R and the print medium M, a guide shaft 2036 that defines a feed passage of the ink ribbon R from the ribbon supply shaft 2033 to the printing portion 2015, and a guide shaft 2037 that defines a feed passage of the ink ribbon R from the printing portion 2015 to the ribbon roll up shaft 2034. The ribbon supply shaft 2033 is detachably attached to the partition member 2035. Note that the ink ribbon R of the present embodiment is an outside wound ink ribbon in which a surface where inks are applied are on the outside.

The print medium M is supplied from the medium supply shaft 2012 to the printing portion 2015, and nipped between the thermal head 2032 and the platen roller 2020 together with the ink ribbon R.

When electricity is distributed through to a heating element of the thermal head 2032 in a state where the print medium M and the ink ribbon R are nipped between the thermal head 2032 and the platen roller 2020, the inks of the ink ribbon R are transferred to the print medium M by heat of the heating element, so that printing is performed to the print medium M.

When the platen roller 2020 is rotated forward by a platen drive motor (not shown), the print medium M and the ink ribbon R are fed to the downstream side in the feed direction, and the print medium M is discharged to the outside of the printer 2100 from the outlet port 2016.

Figure 15:
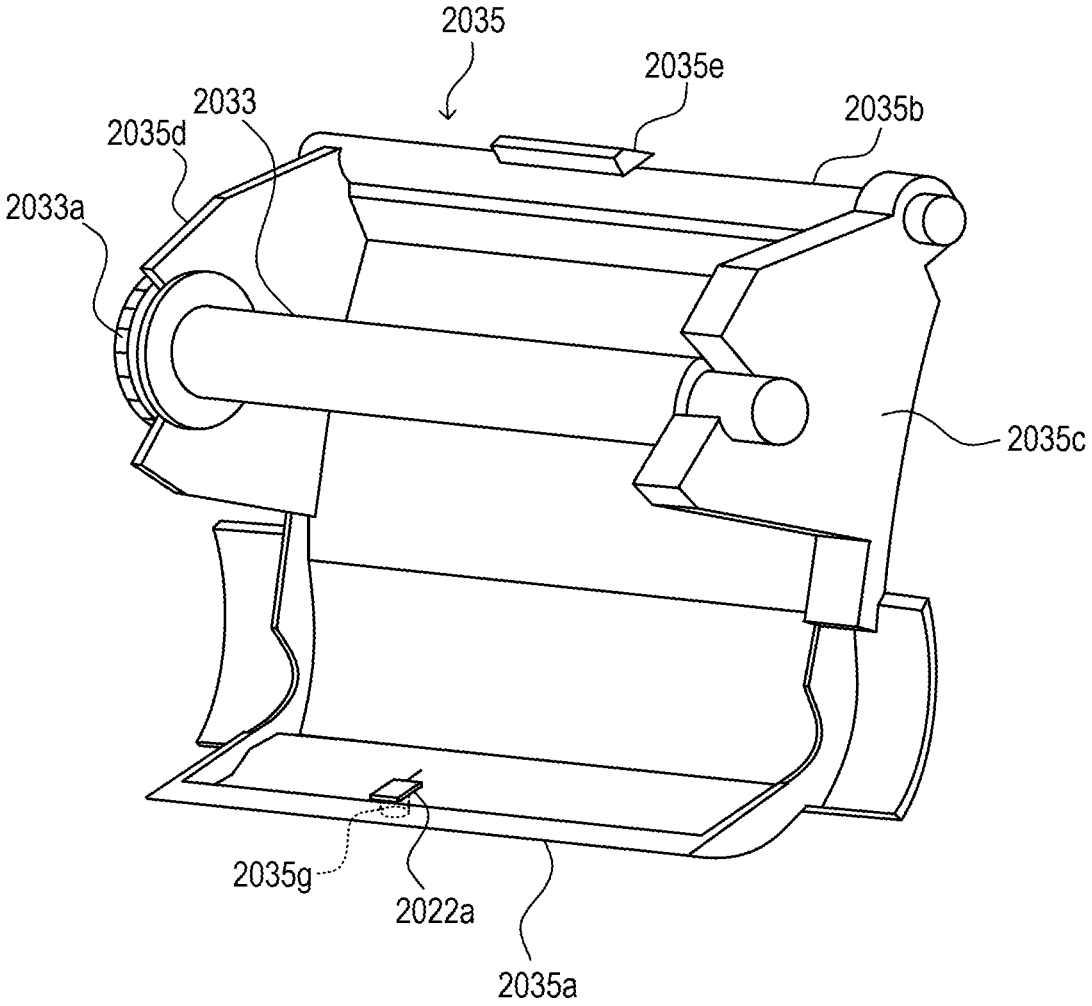
FIG. 15 is a perspective view of a partition member and a ribbon supply shaft.

As shown in FIG. 15, the partition member 2035 has a base portion 2035*a*, a shaft portion 2035*b* provided on the one end side of the base portion 2035*a*, support portions 2035*c*, 2035*d* that rotatably support the ribbon supply shaft 2033 in parallel to the shaft portion 2035*b*, and an engagement portion 2035*e* formed in a center portion of the shaft portion 2035*b*.

The partition member 2035 is swingably supported on the main body portion 2031 by the shaft portion 2035*b*.

As shown in FIG. 14, the engagement portion 2035*e* is configured to be engaged with an engaged portion 2011*a* provided in the cover 2011. When the partition member 2035 is brought to a position (close position) where the engagement portion 2035*e* is engaged with the engaged portion 2011*a*, the ribbon supply shaft 2033 is accommodated in the main body portion 2031. Thereby, the ribbon supply shaft 2033 is brought to a ribbon supply position where the ink ribbon R is supplied to the printing portion 2015.

In such a way, by engaging the engagement portion 2035*e* with the engaged portion 2011*a*, the partition member 2035 is maintained at the close position where the ribbon supply shaft 2033 is placed at the ribbon supply position. The printing unit 2030 and the cover 2011 are combined with each other.

At the time of performing printing by the printer 2100, the cover 2011 is brought into the close state, and the engagement portion 2035*e* of the partition member 2035 is engaged with the engaged portion 2011*a* of the cover 2011.

Figure 16:
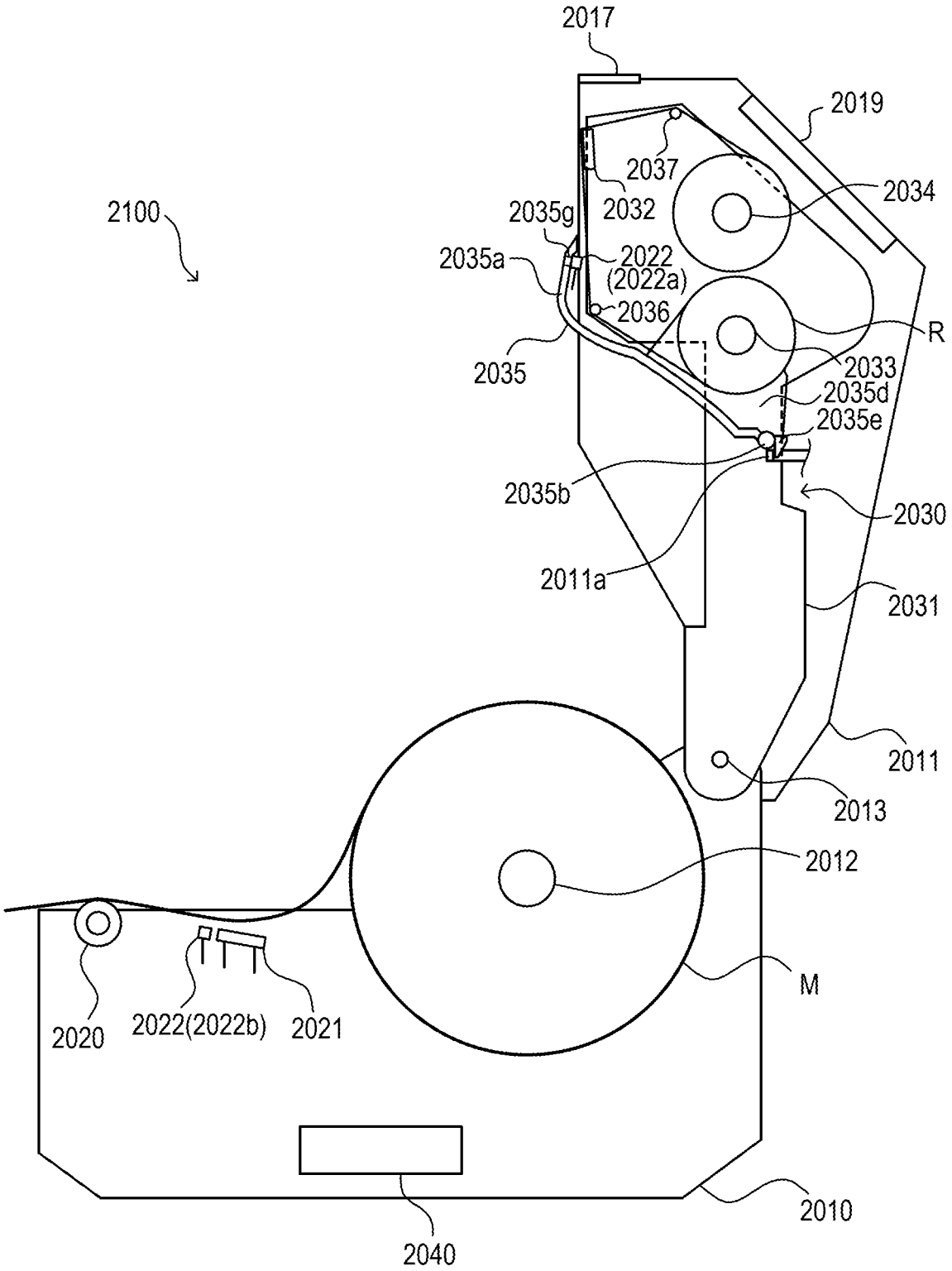
FIG. 16 is a view showing a state where a cover is opened.

Therefore, when the cover 2011 is brought into the open state from the close state, the printing unit 2030 is swung integrally with the cover 2011, and as shown in FIG. 16, the opening portion of the casing 2010 is opened.

Thereby, it is possible to perform settings of the print medium M to the printer 2100 and maintenance of portions in the casing 2010.

Figure 17:
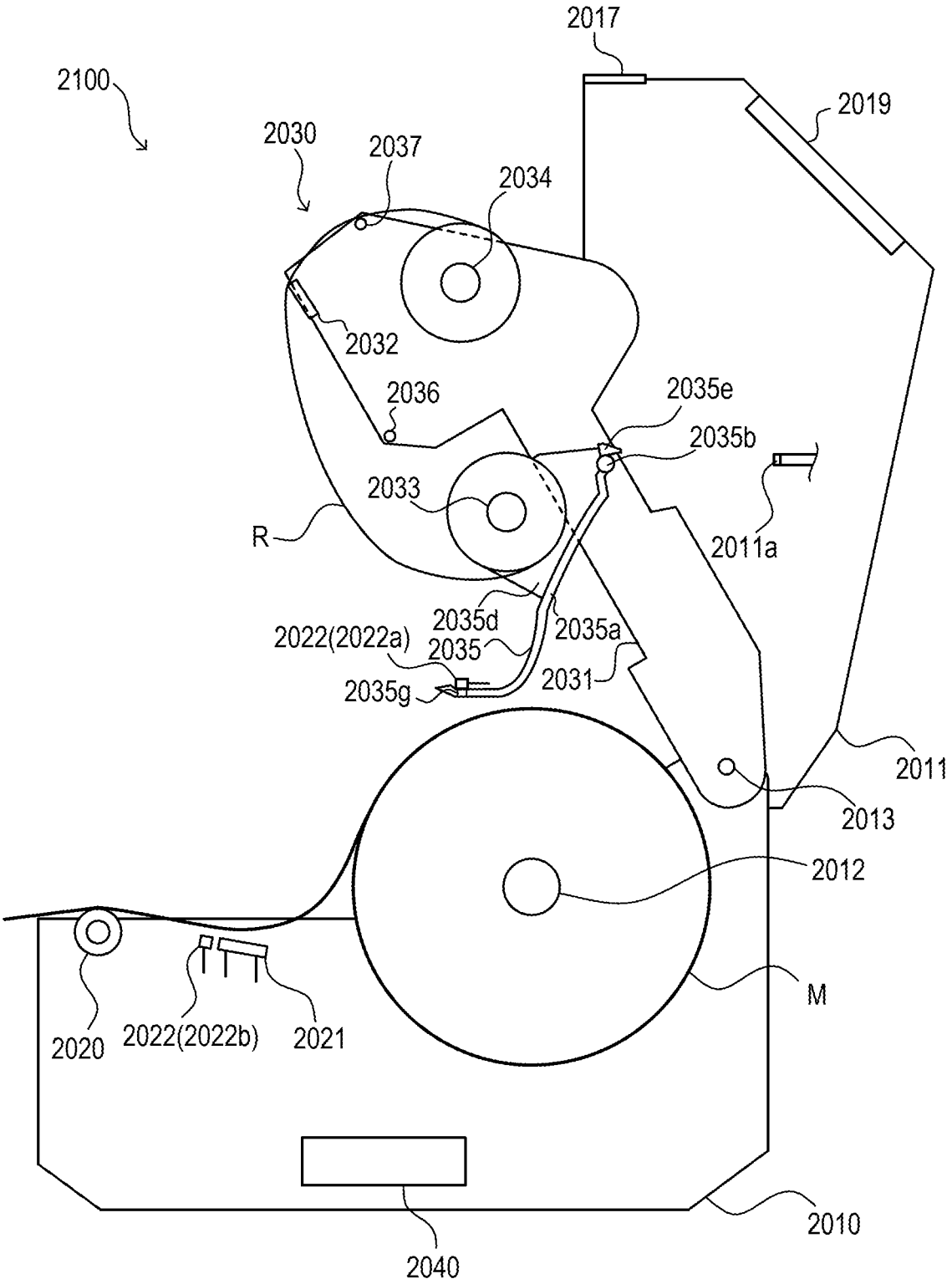
FIG. 17 is a view showing a state where the ribbon supply shaft is placed at a ribbon replacement position.

Further, when engagement between the engagement portion 2035*e* and the engaged portion 2011*a* is cancelled from the state shown in FIG. 16 and the partition member 2035 is swung to the casing 2010 side, the partition member 2035 is brought to an open position shown in FIG. 17.

Following the state that the partition member 2035 is brought to the open position, the ribbon supply shaft 2033 and the roll-form ink ribbon R held by the ribbon supply shaft 2033 are moved with respect to the ribbon roll up shaft 2034, and exposed to the outlet port 2016 of the print medium M. Note that the ribbon roll up shaft 2034 is attached to the main body portion 2031 and is not movable with respect to the printing unit 2030.

Thereby, the ribbon supply shaft 2033 is brought to a ribbon replacement position where the ribbon supply shaft 2033 is attachable to and detachable from the printer 2100, and it is possible to perform a task of replacing the ink ribbon R.

In such a way, in the present embodiment, the ribbon supply shaft 2033 is movable with respect to the ribbon roll up shaft 2034. At the time of replacing the ink ribbon R, it is possible to move the ribbon supply shaft 2033 to the ribbon replacement position where the task can be easily performed.

The ribbon supply shaft 2033 is exposed to the outlet port 2016 of the print medium M, that is, to the side of a position where a user performs tasks. Thereby, it is possible to improve workability more.

In a state where the ribbon supply shaft 2033 is placed at the ribbon replacement position, as shown in FIG. 17, all the feed passages of the ink ribbon R from the ribbon supply shaft 2033 to the ribbon roll up shaft 2034 are exposed. Therefore, a task of putting the ink ribbon R from the ribbon supply shaft 2033 to the ribbon roll up shaft 2034 is more easily performed.

When the partition member 2035 is swung to the casing 2010 side with torque which is predetermined torque or more, the engagement portion 2035*e* and the engaged portion 2011*a* are elastically deformed and the engagement between the engagement portion 2035*e* and the engaged portion 2011*a* is cancelled.

Note that by cancelling the engagement between the engagement portion 2035*e* and the engaged portion 2011*a*, the printing unit 2030 itself is swung to a predetermined position toward the casing 2010 side. The predetermined position is a position where a swing regulating portion (not shown) provided in the vicinity of the support shaft 2013 in the casing 2010 and the main body portion 2031 are abutted with each other.

When the printing unit 2030 is swung to the casing 2010 side with torque which is predetermined torque or more, the swing regulating portion is elastically deformed, the main body portion 2031 goes over the swing regulating portion, and the positioning of the printing unit 2030 by the swing regulating portion is cancelled.

As shown in FIG. 14, the base portion 2035*a* of the partition member 2035 extends to a position where the base portion 2035*a* opposes a reflection sensor 2021 provided in the casing 2010. Thereby, a feed passage of the print medium M is formed between the reflection sensor 2021 and the part of the partition member 2035 opposing the reflection sensor 2021.

The reflection sensor 2021 is a sensor that detects eye marks which are preliminarily printed on a surface of the print medium M opposite to a printed surface at predetermined intervals. Thereby, it is possible to detect a position of the print medium M in the feed direction.

In the present embodiment, by the partition member 2035 guiding the print medium M, the print medium M is stably fed within a fixed distance from the reflection sensor 2021. Thereby, it is possible to improve detection precision of the reflection sensor 2021.

Note that when the printer 2100 is brought into a printable state, that is, into the state shown in FIG. 14, the partition member 2035 is automatically brought into a state of guiding the print medium M.

In such a way, since the print medium M is guided by the partition member 2035, there is no need for separately providing a guide member for feeding the print medium M within a fixed distance from the reflection sensor 2021, and a task of inserting the print medium M into the guide member is also not required.

The printer 2100 also includes a light transmission sensor 2022 that detects the position of the print medium M in the feed direction.

The light transmission sensor 2022 is a sensor having a light emitting unit 2022*a* which serves as a light emitting portion that emits predetermined light, and a light receiving unit 2022*b* which serves as a light receiving portion that receives the light emitted from the light emitting unit 2022*a* and outputs an electric signal corresponding to intensity of the received light.

For example, in a case where the print medium M is a label continuous body in which plural labels are continuously temporarily attached to a band-shaped liner sheet at predetermined intervals, there is an only-liner part between two adjacent labels.

Between the label part and the only-liner part, a transmission amount of the light emitted from the light emitting unit 2022*a* is different, and hence the intensity of the light received by the light receiving unit 2022*b* is changed. Thereby, the light transmission sensor 2022 can detect the position of the print medium M in the feed direction.

In the present embodiment, as shown in FIGS. 14 and 15, the light emitting unit 2022*a* is provided on the opposite side of the feed passage of the print medium M in the base portion 2035*a*, that is, on the upper surface side of the base portion 2035*a*. In the base portion 2035*a*, a through hole 2035*g* through which the light emitted from the light emitting unit 2022*a* passes is formed. Meanwhile, as shown in FIG. 14, the light receiving unit 2022*b* is provided on the casing 2010 side across the feed passage.

As described above, the task of setting the print medium M in the printer 2100 is performed in a state where the printing unit 2030 is placed at a non-printing position and the opening portion of the casing 2010 is opened.

That is, in the present embodiment, it is possible to set the print medium M in the printer 2100 in a state where a portion between the light emitting unit 2022*a* and the light receiving unit 2022*b* is widely opened. Thus, it is possible to easily perform the task of setting the print medium M in the printer 2100. Note that the position of the light emitting unit 2022*a* may be exchanged with the position of the light receiving unit 2022*b*.

The printer 2100 activates any of the reflection sensor 2021 and the light transmission sensor 2022 in accordance with a type of a print medium M to be used, and detects the position of the print medium M in the feed direction.

For example, in a case where a print medium M provided with no eye marks is used, the printer 2100 detects the position of the print medium M by the light transmission sensor 2022.

The controller 2040 is constituted by a microprocessor, storage devices such as a ROM and a RAM, an input/output interface, buses that connect these members, etc. Print data from external computers, signals from the reflection sensor 2021, signals from the light transmission sensor 2022, etc. are inputted to the controller 2040 via the input/output interface.

The controller 2040 executes a print control program stored in the storage device by the microprocessor, and controls electricity distribution to the heating element of the thermal head 2032, electricity distribution to the platen drive motor, etc.

Successively, the printing unit 2030 will be described in detail with reference to FIGS. 18 and 19 mainly. Note that the ink ribbon R is omitted from FIGS. 18 and 19 for easy understanding.

Figure 18:
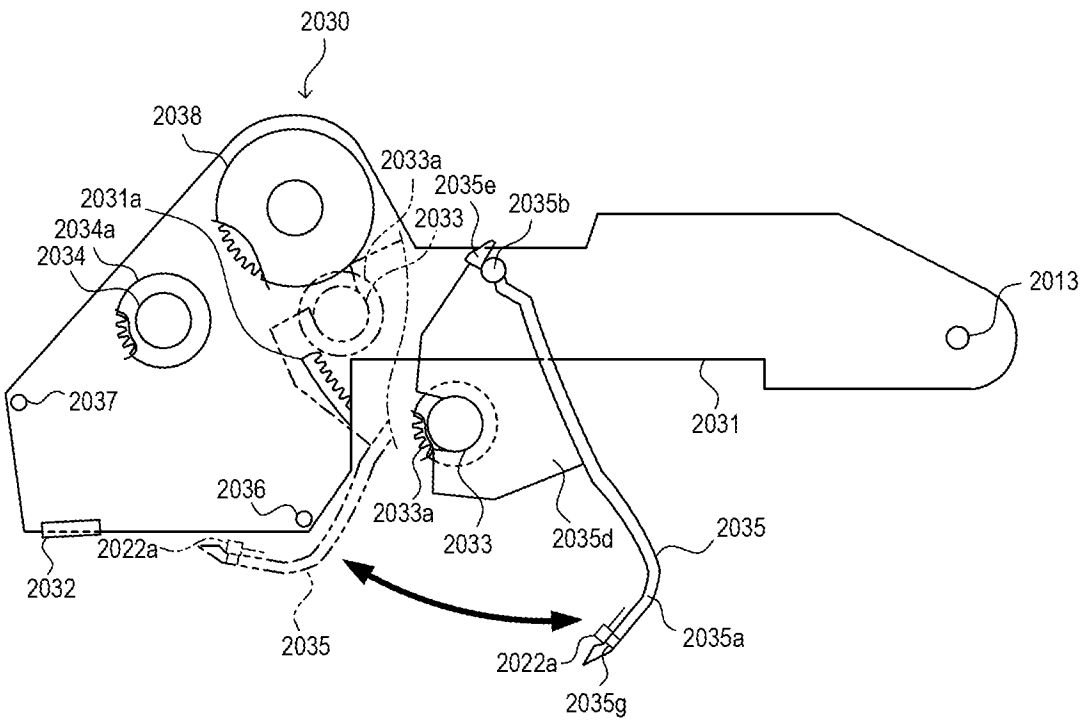
FIG. 18 is a view for explaining a printing unit.

As shown in FIGS. 15 and 18, the ribbon supply shaft 2033 has a gear 2033*a* formed on the one end side.

As shown in FIG. 18, the printing unit 2030 includes a gear 2038 to mesh with the gear 2033*a* in a state where the ribbon supply shaft 2033 is placed at the ribbon supply position (double-chain line). The ribbon supply shaft 2033 is driven by a supply shaft drive motor (not shown) via the gear 2038.

As shown in FIG. 18, the ribbon roll up shaft 2034 has a gear 2034*a* formed on the one end side. The ribbon roll up shaft 2034 is driven by a roll up shaft drive motor (not shown) via a gear (not shown).

Rotation of the ribbon supply shaft 2033 and the ribbon roll up shaft 2034 is controlled by the controller 2040 in synchronization with rotation of the platen roller 2020. Note that the ribbon supply shaft 2033 and the ribbon roll up shaft 2034 may be driven by one drive motor.

As described above, the printing unit 2030 includes the partition member 2035 whose one end side is supported on the main body portion 2031 by the shaft portion 2035*b* so that the partition member is swingable. The ribbon supply shaft 2033 is attached to the partition member 2035.

Thereby, as shown in FIG. 18, when the partition member 2035 is brought to the close position (double-chain line), the ribbon supply shaft 2033 is brought to the ribbon supply position (double-chain line) where the ink ribbon R is supplied to the printing portion 2015. When the partition member is brought to the open position (solid line), the ribbon supply shaft 2033 is brought to the ribbon replacement position (solid line) where the ribbon supply shaft is attachable to and detachable from the printer 2100. Note that a lock mechanism (not shown) for holding the ribbon supply shaft 2033 is provided in the partition member 2035. By cancelling lock by the lock mechanism at the ribbon replacement position, the ribbon supply shaft 2033 can be detached from the printer 2100.

Figure 19:
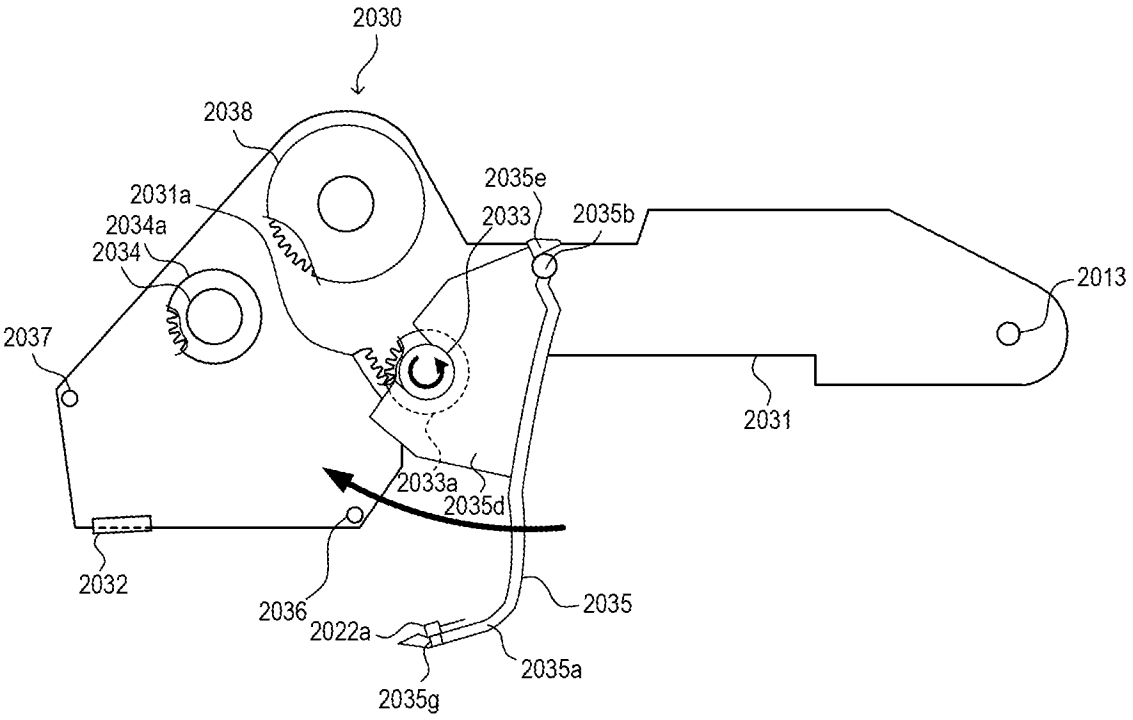
FIG. 19 is a view for explaining a situation where the partition member is brought from an open position to a close position.

As shown in FIGS. 18 and 19, a rack 2031*a* is provided in the main body portion 2031.

As shown in FIG. 19, the rack 2031*a* meshes with the gear 2033*a* in the middle of the partition member 2035 moving from the open position to the close position, and rotates the ribbon supply shaft 2033 in the direction in which the ink ribbon R is rolled up.

In a case where the ink ribbon R is replaced, etc., as shown in FIG. 17, there is sometimes a case where the ink ribbon R is loosened. In a case where the ink ribbon R is loosened, there is a need for rotating the ribbon supply shaft 2033 or the ribbon roll up shaft 2034 to remove looseness of the ink ribbon R.

Meanwhile, in the present embodiment, when the partition member 2035 is brought from the open position to the close position and the ribbon supply shaft 2033 is brought from the ribbon replacement position to the ribbon supply position, the ribbon supply shaft 2033 is automatically rotated in the direction in which the ink ribbon R is rolled up, so that the ink ribbon R is rolled up and the looseness of the ink ribbon R is removed.

According to this, there is no need for performing a task of rotating the ribbon supply shaft 2033 or the ribbon roll up shaft 2034 in order to eliminate the looseness of the ink ribbon R. Thus, it is possible to efficiently perform the task of replacing the ink ribbon R. Since the looseness of the ink ribbon R is eliminated, it is possible to prevent occurrence of printing failure due to the looseness of the ink ribbon R.

Note that meshing between the gear 2033*a* and the rack 2031*a* is cancelled immediately before the ribbon supply shaft 2033 is brought to the ribbon supply position. That is, in a state where the ribbon supply shaft 2033 is placed at the ribbon supply position, the rack 2031*a* does not mesh with the gear 2033*a*. Therefore, the rack 2031*a* does not inhibit rotation of the ribbon supply shaft 2033 at the time of printing.

Immediately after the meshing between the gear 2033*a* and the rack 2031*a* is cancelled, the gear 2033*a* meshes with the gear 2038. Thus, it is possible to suppress that the ribbon supply shaft 2033 is rotated in the direction in which the ink ribbon R is supplied to the printing portion 2015 within a period from cancellation of the meshing between the gear 2033*a* and the rack 2031*a* to meshing between the gear 2033*a* and the gear 2038.

As described above, the printer 2100 of the present embodiment includes the printing portion 2015 that performs printing to the print medium M, the ribbon supply shaft 2033 that holds the ink ribbon R to be supplied to the printing portion 2015, and the ribbon roll up shaft 2034 that rolls up the used ink ribbon R. The ribbon supply shaft 2033 is provided movably between the ribbon supply position where the ink ribbon R is supplied to the printing portion 2015 and the ribbon replacement position where the ribbon supply shaft 2033 is attachable to and detachable from the printer 2100, and rotated in the direction in which the ink ribbon R is rolled up in the middle of moving from the ribbon replacement position to the ribbon supply position.

Specifically, the gear 2033*a* is provided in the ribbon supply shaft 2033, and the printer 2100 includes the rack 2031*a* to mesh with the gear 2033*a* in the middle of the ribbon supply shaft 2033 moving from the ribbon replacement position to the ribbon supply position.

According to this, when the ribbon supply shaft 2033 is brought from the ribbon replacement position to the ribbon supply position, the ribbon supply shaft 2033 is automatically rotated, so that the ink ribbon R is rolled up. Therefore, there is no need for performing the task of rotating the ribbon supply shaft 2033 or the ribbon roll up shaft 2034 in order to eliminate the looseness of the ink ribbon R. Thus, it is possible to efficiently perform the task of replacing the ink ribbon R.

The rack 2031*a* does not mesh with the gear 2033*a* in a state where the ribbon supply shaft 2033 is placed at the ribbon supply position.

Therefore, the rack 2031*a* does not inhibit the rotation of the ribbon supply shaft 2033 at the time of printing.

The printer 2100 includes the swingably provided partition member 2035 that partitions the ink ribbon R and the print medium M. The ribbon supply shaft 2033 is attached to the partition member 2035.

According to this, at the time of replacing the ink ribbon R, it is possible to move the ribbon supply shaft 2033 to the ribbon replacement position where the task can be easily performed.

The printer 2100 includes the swingably provided printing unit 2030 having the thermal head 2032 that constitutes the printing portion 2015, the ribbon supply shaft 2033, the ribbon roll up shaft 2034, and the partition member 2035 are provided in the printing unit 2030, and the ribbon roll up shaft 2034 is not movable with respect to the printing unit 2030.

According to this, the ribbon roll up shaft 2034 is not moved with respect to the printing unit 2030. Thus, when the ribbon supply shaft 2033 is brought to the ribbon supply position and the ink ribbon R is rolled up, it is possible to efficiently eliminate the looseness of the ink ribbon R.

The printer 2100 includes the casing 2010 and the cover 2011 that covers the opening portion of the casing 2010, and the partition member 2035 has the engagement portion 2035*e* to be engaged with the engaged portion 2011*a* provided in the cover 2011. When the engagement portion 2035*e* and the engaged portion 2011*a* are engaged with each other, the partition member 2035 is maintained at the close position where the ribbon supply shaft 2033 is placed at the ribbon supply position, and the printing unit 2030 and the cover 2011 are combined with each other.

According to this, when the cover 2011 is brought from the close state to the open state, the printing unit 2030 is swung integrally with the cover 2011. Therefore, at the time of performing settings of the print medium M and maintenance of portions in the casing 2010, there is no need for individually opening the cover 2011 and the printing unit 2030, and it is possible to efficiently perform the task.

Figure 20:
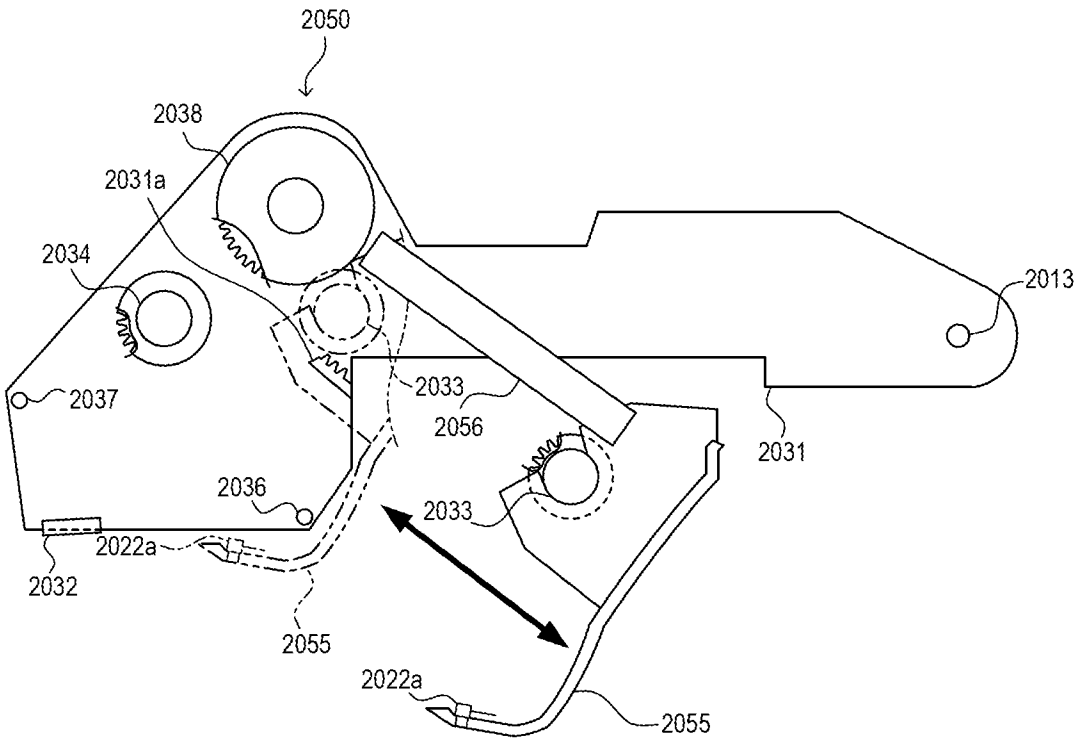
FIG. 20 is a view for explaining a modified example of the printing unit.

For example, in the above embodiment, by swingably providing the partition member 2035 in the printing unit 2030, the ribbon supply shaft 2033 attached to the partition member 2035 is moved with respect to the ribbon roll up shaft 2034. However, as in a printing unit 2050 shown in FIG. 20, the ribbon supply shaft 2033 may be moved by providing a slide mechanism 2056 that lets a partition member 2055 slide.

In the above embodiment, the printer 2100 includes the cover 2011. However, the printing unit 2030 may function as a cover without providing the cover 2011. In this case, an engaged portion to be engaged with the engagement portion 2035*e* of the partition member 2035 is provided in the main body portion 2031 of the printing unit 2030, etc.

Fifth Embodiment

Hereinafter, a printer 3100 according to a fifth embodiment will be described with reference to the attached drawings.

The printer 3100 is a thermal transfer printer in which an ink ribbon R is heated and inks of the ink ribbon R are transferred to a print medium M, so that printing is performed. The print medium M is, for example, a label continuous body in which plural labels are continuously temporarily attached to a band-shaped liner sheet.

Figure 21:
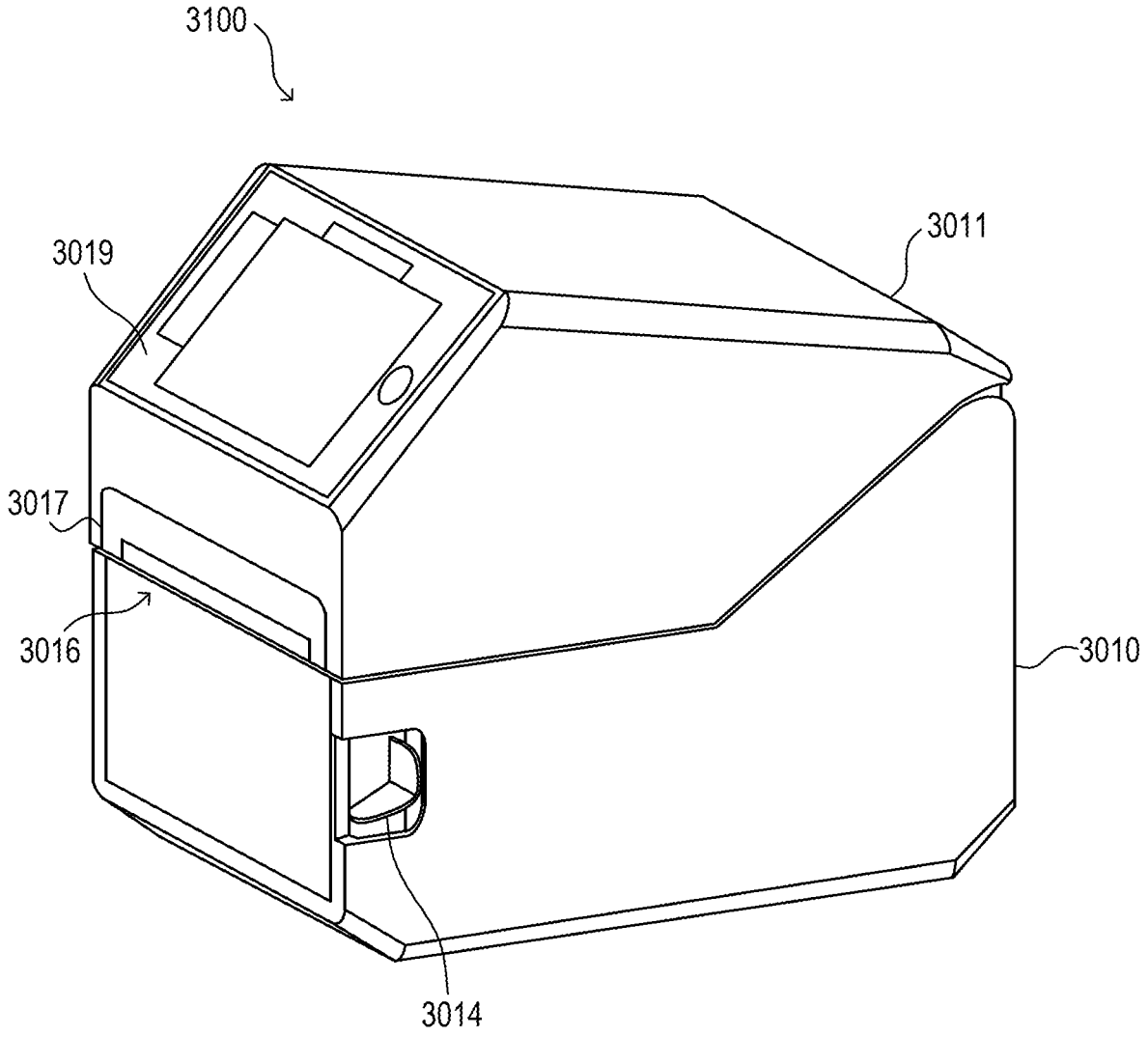
FIG. 21 is a perspective view of a printer according to a fifth embodiment.
Figure 22:
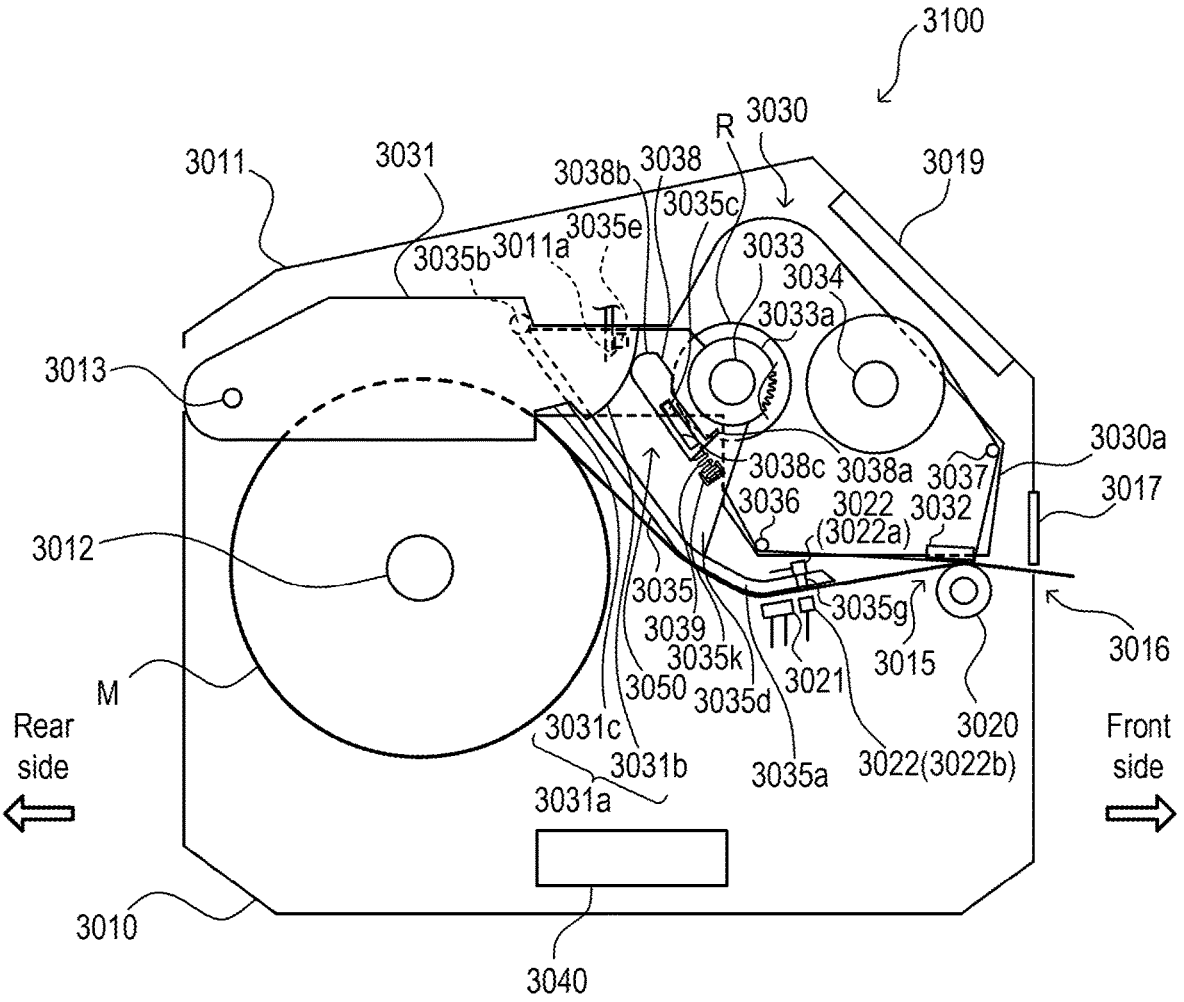
FIG. 22 is a schematic configuration view of the printer according to the fifth embodiment.

As shown in FIGS. 21 and 22, the printer 3100 includes a casing 3010, and a cover 3011 that covers an opening portion of the casing 3010.

As shown in FIG. 22, the print medium M is held on a medium supply shaft 3012 in a state where the print medium is wound in a roll form. As the print medium M, a linerless label or a fanfold medium can also be used.

An end portion of the cover 3011 is supported by a support shaft 3013 so that the cover 3011 is swingable. By swinging with the support shaft 3013 as a supporting point, it is possible to switch the cover 3011 between an open state where the opening portion of the casing 3010 is opened and a close state where the opening portion is closed.

A cover lock mechanism (not shown) that maintains the close state of the cover 3011 is provided in the casing 3010. The cover lock mechanism is cancelled by operating a lever 3014 shown in FIG. 21.

Between an end portion of the cover 3011 on the opposite side to the support shaft 3013 and the casing 3010, an outlet port 3016 that discharges the print medium M to which printing is already performed by a printing portion 3015 shown in FIG. 22 from the printer 3100 is formed.

A cutter 3017 facing the outlet port 3016 is attached to the cover 3011 of the present embodiment. Thereby, it is possible to cut the printed print medium M discharged from the outlet port 3016. Note that in the printer 3100, it is possible to attach various units, for example, a removal unit that removes labels from a band-shaped liner sheet, and a cutter unit that cuts linerless labels (labels with no band-shaped liner sheet).

An operation unit 3019 for operating the printer 3100 is also provided in the cover 3011. The operation unit 3019 has various operation buttons, a display, a near-field communication module, LEDs, etc. The display may be a touch panel.

Inside the printer 3100, a printing unit 3030 for performing printing to the print medium M, a controller 3040 that controls actions of the printer 3100, etc. are accommodated.

The printing unit 3030 includes a main body portion 3031 whose end portion is supported by the support shaft 3013 so that the main body portion 3031 is swingable, and a thermal head 3032 attached to the main body portion 3031.

The thermal head 3032 constitutes the printing portion 3015 that performs printing to the print medium M together with a platen roller 3020 provided on the casing 3010 side.

The printing unit 3030 also includes a ribbon supply shaft 3033 that holds the ink ribbon R to be supplied to the printing portion 3015 in a roll form, a ribbon roll up shaft 3034 that rolls up the used ink ribbon R, and a partition member 3035 that partitions the ink ribbon R and the print medium M.

The ribbon supply shaft 3033 is detachably attached to the partition member 3035. The ribbon roll up shaft 3034 is detachably attached to the main body portion 3031. Note that the ink ribbon R of the present embodiment is an outside wound ink ribbon in which a surface where inks are applied are on the outside.

The printing unit 3030 also includes a guide shaft 3036 that defines a feed passage of the ink ribbon R from the ribbon supply shaft 3033 to the printing portion 3015, and a guide shaft 3037 that defines a feed passage of the ink ribbon R from the printing portion 3015 to the ribbon roll up shaft 3034. Note that the example in which one guide shaft is provided in the upstream of the printing portion 3015 and another guide shaft is provided in the downstream will be described. However, for example, one more guide shaft may be provided in the vicinity of the upstream side of the thermal head 3032.

The print medium M is supplied from the medium supply shaft 3012 to the printing portion 3015, and nipped between the thermal head 3032 and the platen roller 3020 together with the ink ribbon R.

When electricity is distributed through to a heating element of the thermal head 3032 in a state where the print medium M and the ink ribbon R are nipped between the thermal head 3032 and the platen roller 3020, the inks of the ink ribbon R are transferred to the print medium M by heat of the heating element, so that printing is performed to the print medium M.

When the platen roller 3020 is rotated forward by a platen drive motor (not shown), the print medium M and the ink ribbon R are fed to the downstream side in the feed direction, and the print medium M is discharged to the outside of the printer 3100 from the outlet port 3016.

The ribbon roll up shaft 3034 is driven and rotated by being coupled with the platen drive motor via a gear 3061, etc. (see FIG. 25) when the cover 3011 is in the close state. A back tension mechanism (not shown) is provided in the ribbon supply shaft 3033, and the ink ribbon R is fed while developing fixed back tension on the upstream side in the feed direction.

As shown in FIG. 22, the partition member 3035 has a base portion 3035*a*, a shaft portion 3035*b* provided on the one end side of the base portion 3035*a*, a support portion 3035*d* that rotatably supports the ribbon supply shaft 3033 in parallel to the shaft portion 3035*b*, and an engagement portion 3035*e* formed in the support portion 3035*d*.

The partition member 3035 is swingably supported on the main body portion 3031 by the shaft portion 3035*b*.

As shown in FIG. 22, the engagement portion 3035*e* is configured to be engaged with an engaged portion 3011*a* provided in the cover 3011. When the partition member 3035 is brought to a position (close position) where the engagement portion 3035*e* is engaged with the engaged portion 3011*a*, the ribbon supply shaft 3033 is accommodated in the main body portion 3031. Thereby, the ribbon supply shaft 3033 is brought to a ribbon supply position (second position) where the ink ribbon R is supplied to the printing portion 3015.

In such a way, by engaging the engagement portion 3035*e* with the engaged portion 3011*a*, the partition member 3035 is held at the close position where the ribbon supply shaft 3033 is placed at the ribbon supply position. The printing unit 3030 and the cover 3011 are combined with each other, and the printing unit 3030 is held at an accommodation position where the printing unit 3030 is accommodated in the cover 3011.

At the time of performing printing by the printer 3100, the cover 3011 is brought into the close state, and the engagement portion 3035*e* of the partition member 3035 is engaged with the engaged portion 3011*a* of the cover 3011.

Figure 23:
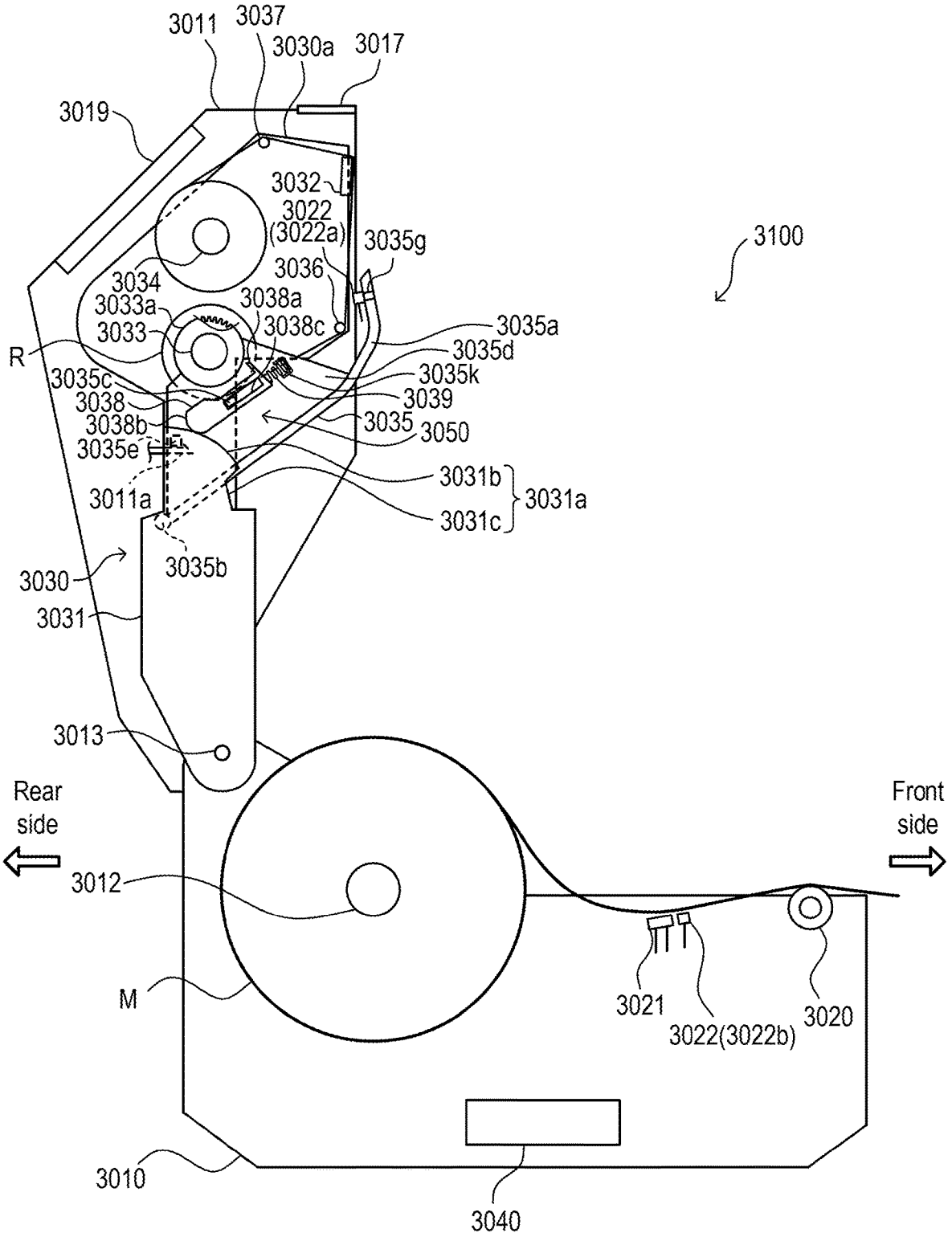
FIG. 23 is a view showing a state where a cover is opened.

Therefore, when the cover 3011 is opened, the printing unit 3030 is swung integrally with the cover 3011, and as shown in FIG. 23, the opening portion of the casing 3010 is opened.

Thereby, it is possible to perform settings of the print medium M to the printer 3100 and maintenance of portions in the casing 3010.

Figure 24:
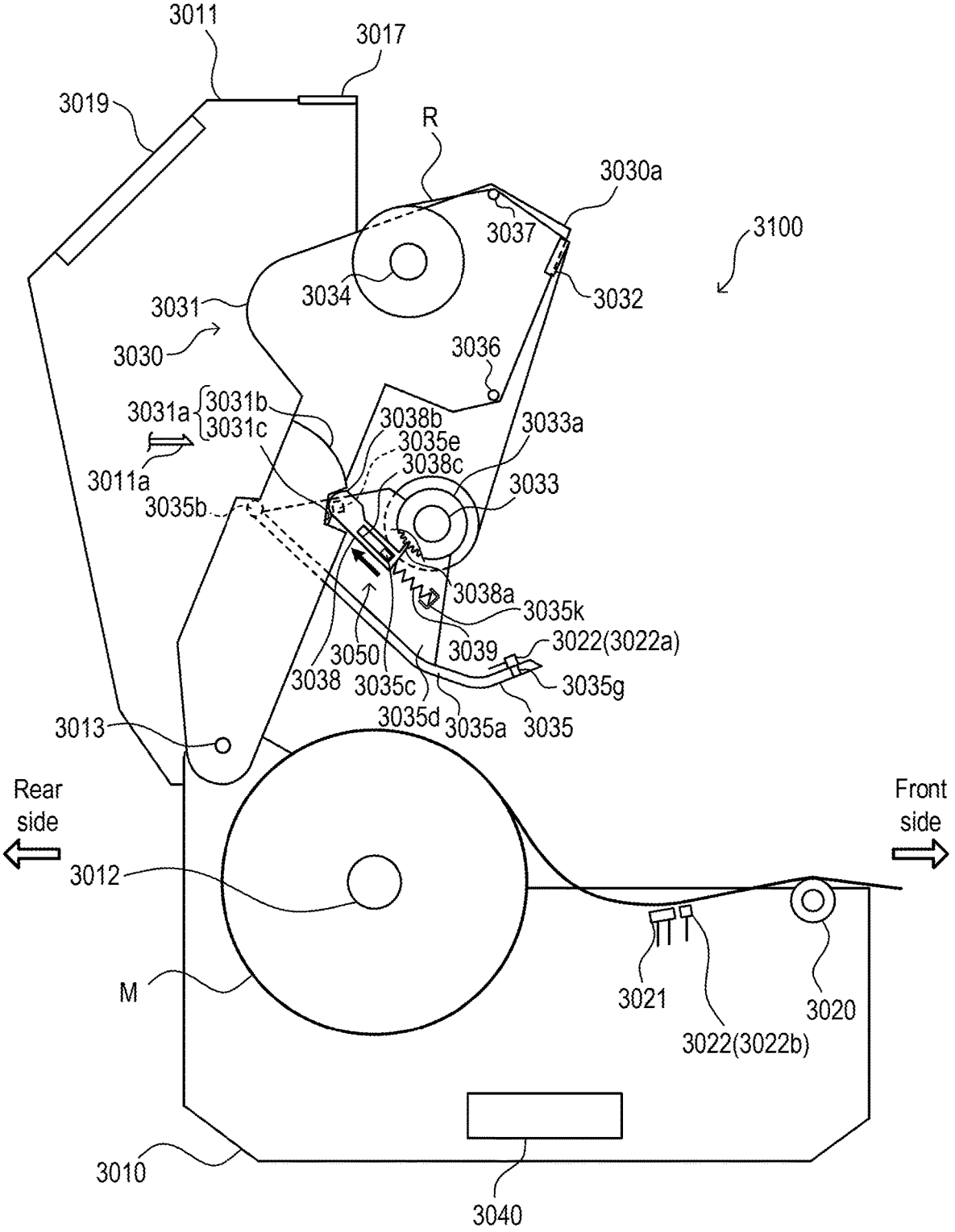
FIG. 24 is a view showing a state where a ribbon supply shaft is placed at a ribbon replacement position.

Further, when engagement between the engagement portion 3035*e* and the engaged portion 3011*a* is cancelled from the state shown in FIG. 23 and the partition member 3035 is swung to the casing 3010 side, the partition member 3035 is brought to an open position shown in FIG. 24. The base portion 3035*a* is abutted with the main body portion 3031 of the printing unit 3030 and the partition member 3035 is stopped at the open position.

When the partition member 3035 is swung to the casing 3010 side with torque which is predetermined torque or more, the engagement portion 3035*e* and the engaged portion 3011*a* are elastically deformed and the engagement between the engagement portion 3035*e* and the engaged portion 3011*a* is cancelled.

Following the state that the partition member 3035 is brought to the open position, the ribbon supply shaft 3033 attached to the partition member 3035 and the roll-form ink ribbon R held by the ribbon supply shaft 3033 are moved with respect to the ribbon roll up shaft 3034, and exposed to the outlet port 3016 of the print medium M which is the front side of the printer 3100.

By cancelling the engagement between the engagement portion 3035*e* and the engaged portion 3011*a*, the printing unit 3030 itself is swung to a predetermined position toward the casing 3010 side, so that the open end 3030*a* side is separated from the cover 3011. The predetermined position is a position where a swing regulating portion (not shown) provided in the vicinity of the support shaft 3013 in the casing 3010 and the main body portion 3031 are abutted with each other.

According to this, the ribbon supply shaft 3033 is brought to a ribbon replacement position (first position) where the ink ribbon R is attachable and detachable, and it is possible to perform a task of replacing the ink ribbon R.

In such a way, when the partition member 3035 is brought to the open position, the open end 3030*a* side of the printing unit 3030 is separated from the cover 3011, and the ribbon supply shaft 3033 is brought to the ribbon replacement position where the ink ribbon R is attachable and detachable.

As shown in FIG. 24, at the ribbon replacement position, the ribbon supply shaft 3033 is exposed to the front side of the printer 3100. Therefore, an operator easily visually confirms the ribbon supply shaft 3033 and the task of replacing the ink ribbon R is easily performed.

Note that when the printing unit 3030 is swung to the casing 3010 side with torque which is predetermined torque or more, the swing regulating portion is elastically deformed, the main body portion 3031 goes over the swing regulating portion, and the positioning of the printing unit 3030 by the swing regulating portion is cancelled.

In such a way, in the present embodiment, the ribbon supply shaft 3033 is movable with respect to the ribbon roll up shaft 3034, and at the time of replacing the ink ribbon R, it is possible to move the ribbon supply shaft 3033 to the position where the task can be easily performed.

The printer 3100 also includes a ribbon supply shaft lock mechanism 3050 to be brought into a lock state where rotation of the ribbon supply shaft 3033 is regulated when the ribbon supply shaft 3033 is placed at the ribbon replacement position, and into a non-lock state where the rotation of the ribbon supply shaft 3033 is permitted when the ribbon supply shaft 3033 is placed at the ribbon supply position.

The ribbon supply shaft lock mechanism 3050 will be described with reference to FIGS. 22 to 24.

The ribbon supply shaft lock mechanism 3050 has a gear 3033*a* provided in the ribbon supply shaft 3033, a lock member (first lock member) 3038 provided movably between a meshing position where a claw portion 3038*a* and the gear 3033*a* mesh with each other (see FIG. 24) and a non-meshing position where meshing between the claw portion 3038*a* and the gear 3033*a* is cancelled (see FIGS. 22 and 23), a guide rail 3031*a* provided in the main body portion 3031 of the printing unit 3030, the guide rail to be abutted with an end portion 3038*b* of the lock member 3038, and a spring (first bias member) 3039 that biases the lock member 3038 toward the guide rail 3031*a*.

A long hole 3038*c* is formed in the lock member 3038, and a rectangular projected portion 3035*c* provided in the support portion 3035*d* of the partition member 3035 is to be fitted into the long hole 3038*c*. Thereby, the lock member 3038 is slidably supported by the projected portion 3035*c*, and becomes movable between the meshing position and the non-meshing position along the longitudinal direction of the long hole 3038*c*.

The spring 3039 is provided in a compressed state between a sheet portion 3035*k* provided in the support portion 3035*d* of the partition member 3035 and the lock member 3038, and biases the lock member 3038 toward the guide rail 3031*a*. Note that in the present embodiment, the spring 3039 is a coil spring. The bias member that biases the lock member 3038 may be a plate spring, a torsional spring, rubber, etc.

The guide rail 3031*a* has a guide surface 3031*b* formed in an arc of a circle whose center is the shaft portion 3035*b* of the partition member 3035, and a guide surface 3031*c* formed at a position closer to the shaft portion 3035*b* than the guide surface 3031*b*.

Following the state that the partition member 3035 is swung between the close position and the open position, the lock member 3038 biased by the spring 3039 slides along the guide surfaces 3031*b* and 3031*c*.

The guide surface 3031*b* is formed in an arc of a circle whose center is the shaft portion 3035*b* of the partition member 3035. Thus, in a case where the partition member 3035 is swung within a range where the lock member 3038 slides along the guide surface 3031*b*, a position of the lock member 3038 with respect to the gear 3033*a* provided in the ribbon supply shaft 3033 is not changed. In this case, as shown in FIGS. 22 and 23, the lock member 3038 is maintained at the non-meshing position.

When the partition member 3035 is swung to the open position, the lock member 3038 is moved to a position to oppose the guide surface 3031*c*. Thereby, as shown by an arrow in FIG. 24, the lock member 3038 is moved to a position where the lock member 3038 is biased by the spring 3039 and abutted with the guide surface 3031*c*, and brought to the meshing position where the claw portion 3038*a* meshes with the gear 3033*a*. In this state, the rotation of the ribbon supply shaft 3033 is regulated by the lock member 3038.

When the partition member 3035 is swung from the open position to the close position, the lock member 3038 goes up onto the guide surface 3031*b* while compressing the spring 3039. Thereby, the lock member 3038 is brought to the non-meshing position where the meshing between the claw portion 3038*a* and the gear 3033*a* is cancelled. In this state, the rotation of the ribbon supply shaft 3033 is permitted.

Therefore, in a state where the partition member 3035 is placed at the close position and the printing unit 3030 and the cover 3011 are combined with each other, that is, in a state where the printing unit 3030 is placed at the accommodation position where the printing unit 3030 is accommodated in the cover 3011, the rotation of the ribbon supply shaft 3033 is permitted.

The ribbon supply shaft lock mechanism 3050 is configured as described above, and switched between the lock state where the rotation of the ribbon supply shaft 3033 is regulated and the non-lock state where the rotation of the ribbon supply shaft 3033 is permitted in conjunction with the swing actions of the partition member 3035.

In such a way, in the printer 3100, when the partition member 3035 is brought to the open position, that is, when the ribbon supply shaft 3033 is placed at the ribbon replacement position (first position), the ribbon supply shaft lock mechanism 3050 is brought into the lock state where the rotation of the ribbon supply shaft 3033 is regulated. When the partition member 3035 is brought to the close position, that is, when the ribbon supply shaft 3033 is placed at the ribbon supply position (second position), the ribbon supply shaft lock mechanism 3050 is brought into the non-lock state where the rotation of the ribbon supply shaft 3033 is permitted.

In other words, in a state where the printing unit 3030 is accommodated in the cover 3011, the rotation of the ribbon supply shaft 3033 is permitted. When the open end 3030*a* side of the printing unit 3030 is separated from the cover 3011 and the ribbon supply shaft 3033 is placed at the ribbon replacement position where the ink ribbon R is attachable and detachable, the rotation of the ribbon supply shaft 3033 is regulated.

Therefore, at the time of replacing the ink ribbon R, it is possible to prevent that the ribbon supply shaft 3033 is rotated in reaction of stoppage of the partition member 3035 at the open position and the ink ribbon R is loosened, and that the ribbon supply shaft 3033 is rotated during the task of replacing the ink ribbon R and the ink ribbon R is loosened. Thus, it is possible to easily replace the ink ribbon R.

The ribbon supply shaft lock mechanism 3050 is automatically switched between the lock state and the non-lock state in conjunction with the swing actions of the partition member 3035.

Therefore, there is no need for operating the ribbon supply shaft lock mechanism 3050 in order to regulate the rotation of the ribbon supply shaft 3033, and it is possible to efficiently perform the task of replacing the ink ribbon R.

As shown in FIG. 24, the claw portion 3038*a* of the lock member 3038 is moved in the tangent line direction in the vicinity of a tangent line of an outer diameter of the gear 3033*a* and meshes with the gear 3033*a*.

Note that in the present embodiment, in a state where the lock member 3038 is placed at the meshing position, the claw portion 3038*a* meshes with the gear 3033*a* provided in the ribbon supply shaft 3033. However, the claw portion 3038*a* may mesh with another gear coupled to the ribbon supply shaft 3033. The phrase that "a gear is coupled to the ribbon supply shaft 3033" indicates the state that rotation of the gear is transmitted to the ribbon supply shaft 3033. Therefore, the gear 3033*a* is also a gear coupled to the ribbon supply shaft 3033.

Note that the printer 3100 includes a clutch mechanism (not shown) in which the ribbon supply shaft 3033 is rotated upon application of torque which is predetermined torque or more even when the ribbon supply shaft lock mechanism 3050 is in the lock state. Therefore, for example, in a case where large tensile force is applied to the ink ribbon R in the ribbon roll-up direction, the ribbon supply shaft 3033 is rotated. Thus, it is possible to prevent breakage of the ink ribbon R.

Figure 25:
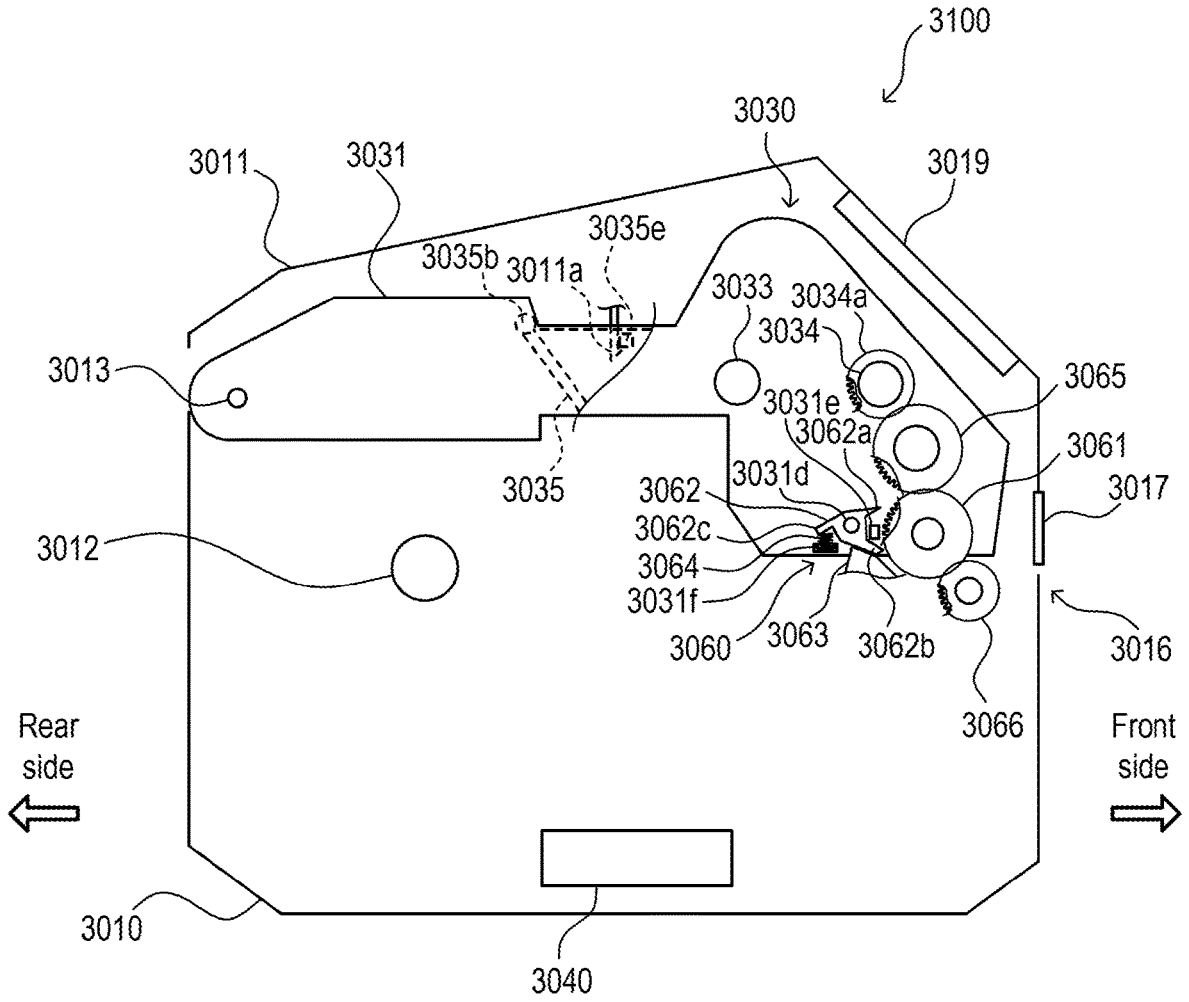
FIG. 25 is a view for explaining a ribbon roll up shaft lock mechanism.
Figure 26:
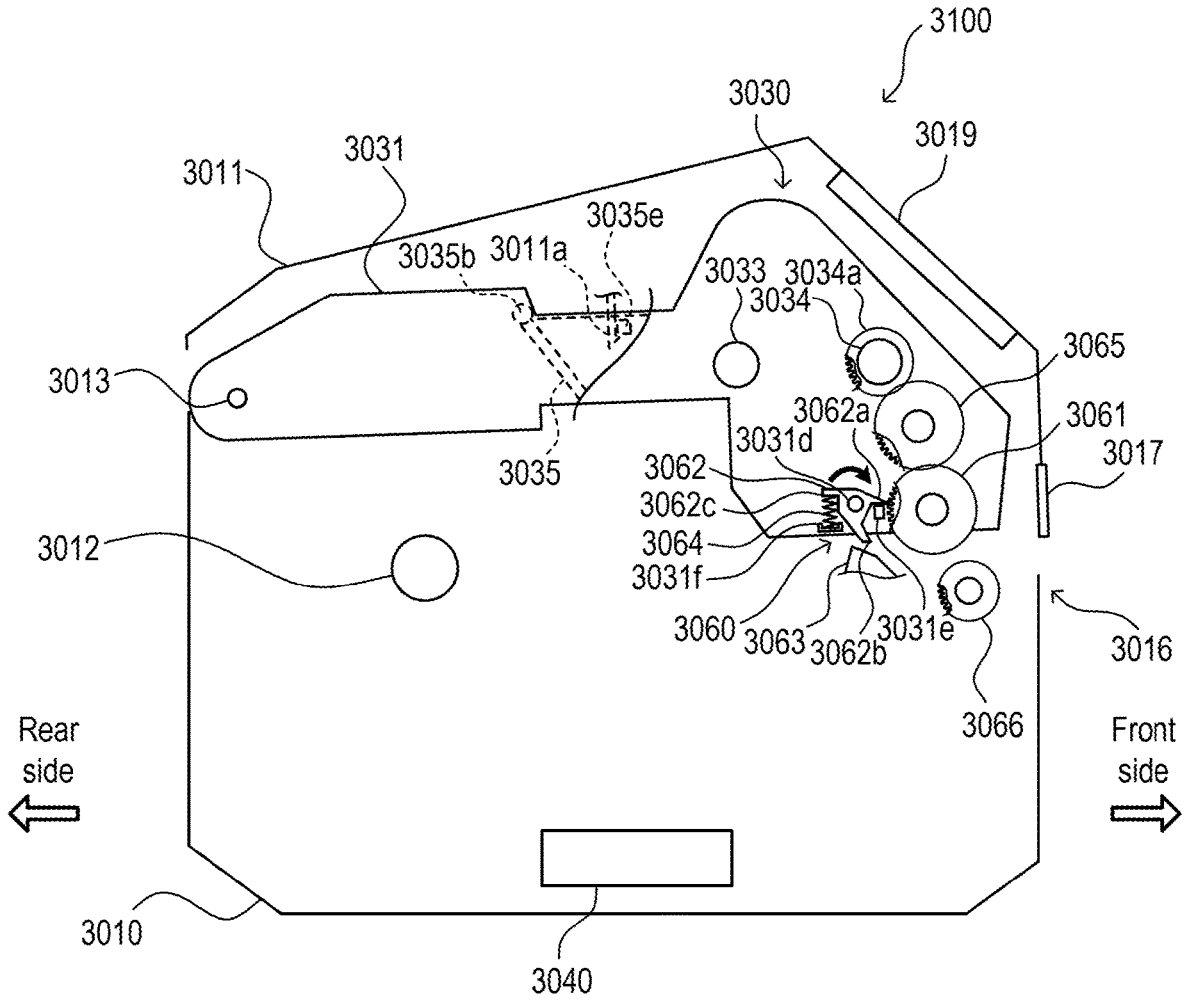
FIG. 26 is a view showing the ribbon roll up shaft lock mechanism in a lock state.

As shown in FIGS. 25 and 26, the printer 3100 also includes a ribbon roll up shaft lock mechanism 3060 to be brought into a lock state where rotation of the ribbon roll up shaft 3034 is regulated when the cover 3011 is opened, and into a non-lock state where the rotation of the ribbon roll up shaft 3034 is permitted when the cover 3011 is closed. In FIGS. 25 and 26, some configurations of the printer 3100 are appropriately omitted for easy understanding.

The ribbon roll up shaft lock mechanism 3060 has the gear 3061 provided in the main body portion 3031 of the printing unit 3030 and coupled to the ribbon roll up shaft 3034, a lock member (second lock member) 3062 supported by a support shaft 3031*d* provided in the main body portion 3031 of the printing unit 3030, the lock member being provided turnably between a meshing position where a claw portion 3062*a* and the gear 3061 mesh with each other (see FIG. 26) and a non-meshing position where meshing between the claw portion 3062*a* and the gear 3061 is cancelled (see FIG. 25), a first positioning portion 3063 provided on the casing 3010 side, the first positioning portion to be abutted with a projected portion 3062*b* of the lock member 3062 to position the lock member 3062 at the non-meshing position, a second positioning portion 3031*e* provided in the main body portion 3031 of the printing unit 3030, the second positioning portion to be abutted with the claw portion 3062*a* of the lock member 3062 to position the lock member 3062 at the meshing position, and a spring (second bias member) 3064 that biases the lock member 3062 in the direction in which the lock member is turned from the non-meshing position toward the meshing position.

The spring 3064 is provided in a compressed state between a sheet portion 3031*f* provided in the main body portion 3031 of the printing unit 3030 and a projected portion 3062*c* of the lock member 3062, and biases the lock member 3062 in the direction in which the lock member is turned from the non-meshing position toward the meshing position. Note that in the present embodiment, the spring 3064 is a coil spring. The bias member that biases the lock member 3062 may be a plate spring, a torsional spring, rubber, etc.

The gear 3061 meshes with a gear 3065 provided in the main body portion 3031. The gear 3065 meshes with a gear 3034*a* provided in the ribbon roll up shaft 3034. That is, the gear 3061 is coupled to the ribbon roll up shaft 3034 via the gear 3065 and the gear 3034*a*. The phrase that "a gear is coupled to the ribbon roll up shaft 3034" indicates the state that rotation of the gear is transmitted to the ribbon roll up shaft 3034.

As shown in FIG. 25, in a case where the cover 3011 is in the close state, the gear 3061 meshes with a gear 3066 provided on the casing 3010 side.

In a case where the cover 3011 is in the close state, the projected portion 3062*b* is abutted with the first positioning portion 3063, and hence a turn in the direction to the meshing position is regulated, so that the lock member 3062 is positioned at the non-meshing position. In this state, the lock member 3062 permits the rotation of the ribbon roll up shaft 3034.

Therefore, in a case where the cover 3011 is in the close state, and when drive force of the platen drive motor is transmitted to the gear 3066, the ribbon roll up shaft 3034 is rotated via the gears 3061, 3065, and 3034*a*.

When the lever 3014 is operated and the cover 3011 is opened, as shown in FIG. 26, the printing unit 3030 is swung integrally with the cover 3011. Following this, the lock member 3062 provided in the printing unit 3030 is also moved upward to be separated from the first positioning portion 3063. At this time, the lock member 3062 is turned in the direction to the meshing position by bias force of the spring 3064.

Thereby, when the cover 3011 is opened, the lock member 3062 is brought to the meshing position where the claw portion 3062*a* is abutted with the second positioning portion 3031*e*. In this state, the rotation of the ribbon roll up shaft 3034 is regulated by the lock member 3062.

In such a way, when the cover 3011 is opened, the ribbon roll up shaft lock mechanism 3060 is brought into the lock state where the rotation of the ribbon roll up shaft 3034 is regulated.

On the other hand, when the cover 3011 is closed, the projected portion 3062*b* is abutted with the first positioning portion 3063, and hence the lock member 3062 is turned in the direction to the non-meshing position while compressing the spring 3064. Thereby, the ribbon roll up shaft lock mechanism 3060 is brought into the non-lock state.

The ribbon roll up shaft lock mechanism 3060 is brought into the lock state when the cover 3011 is opened. Thus, when the ribbon supply shaft 3033 is placed at the ribbon replacement position, the rotation of the ribbon roll up shaft 3034 is regulated.

In such a way, in the present embodiment, when the ribbon supply shaft 3033 is placed at the ribbon replacement position where the ink ribbon R is attachable and detachable, the rotation of the ribbon supply shaft 3033 and the rotation of the ribbon roll up shaft 3034 are regulated. Therefore, at the time of replacing the ink ribbon R, it is possible to prevent that the ribbon supply shaft 3033 is rotated and the ink ribbon R is loosened. As described above, the back tension mechanism is provided in the ribbon supply shaft 3033. Therefore, when the ribbon supply shaft 3033 is placed at the ribbon replacement position where the ink ribbon R is attachable and detachable and the ribbon roll up shaft 3034 is rotatable, the ribbon roll up shaft 3034 is also rotated in the upstream-side roll back direction by roll-back bias force of the ribbon supply shaft 3033 toward the upstream side upon attaching the ink ribbon R, and the ink ribbon R is less easily attached. Meanwhile, in the present embodiment, when the ribbon supply shaft 3033 is placed at the ribbon replacement position where the ink ribbon R is attachable and detachable, the rotation of the ribbon roll up shaft 3034 is also regulated. Thus, it is possible to easily replace the ink ribbon R. Note that even in a case where no back tension mechanism is provided in the ribbon supply shaft 3033, it is also possible to prevent that the ribbon roll up shaft 3034 is rotated and the ink ribbon R is loosened.

Note that the printer 3100 includes a clutch mechanism (not shown) in which the ribbon roll up shaft 3034 is rotated upon application of torque which is predetermined torque or more even when the ribbon roll up shaft lock mechanism 3060 is in the lock state. Therefore, for example, in a case where large tensile force is applied to the ink ribbon R on the upstream side in the feed direction, the ribbon roll up shaft 3034 is rotated even when the ribbon roll up shaft lock mechanism 3060 is in the lock state. Thus, it is possible to prevent breakage of the ink ribbon R.

In a state where the lock member 3062 is placed at the meshing position, the claw portion 3062*a* meshes with the gear 3061. However, the claw portion 3062*a* may mesh with another gear coupled to the ribbon roll up shaft 3034.

As shown in FIG. 22, the base portion 3035*a* of the partition member 3035 extends to a position where the base portion opposes a reflection sensor 3021 provided in the casing 3010. Thereby, a feed passage of the print medium M is formed between the reflection sensor 3021 and the part of the partition member 3035 opposing the reflection sensor 3021.

The reflection sensor 3021 is a sensor that detects eye marks which are preliminarily printed on a surface of the print medium M opposite to a printed surface at predetermined intervals. Thereby, it is possible to detect a position of the print medium M in the feed direction.

In the present embodiment, by the partition member 3035 guiding the print medium M, the print medium M is stably fed within a fixed distance from the reflection sensor 3021. Thereby, it is possible to improve detection precision of the reflection sensor 3021.

Note that when the printer 3100 is brought into a printable state, that is, into the state shown in FIG. 22, the partition member 3035 is automatically brought into a state of guiding the print medium M.

In such a way, since the print medium M is guided by the partition member 3035, there is no need for separately providing a guide member for feeding the print medium M within a fixed distance from the reflection sensor 3021, and a task of inserting the print medium M into the guide member is also not required.

The printer 3100 also includes a light transmission sensor 3022 that detects the position of the print medium M in the feed direction.

The light transmission sensor 3022 is a sensor having a light emitting unit 3022*a* which serves as a light emitting portion that emits predetermined light, and a light receiving unit 3022*b* which serves as a light receiving portion that receives the light emitted from the light emitting unit 3022*a* and outputs an electric signal corresponding to intensity of the received light.

For example, in a case where the print medium M is a label continuous body in which plural labels are continuously temporarily attached to a band-shaped liner sheet at predetermined intervals, there is an only-liner part between two adjacent labels.

Between the label part and the only-liner part, a transmission amount of the light emitted from the light emitting unit 3022*a* is different, and hence the intensity of the light received by the light receiving unit 3022*b* is changed. Thereby, the light transmission sensor 3022 can detect the position of the print medium M in the feed direction.

In the present embodiment, as shown in FIG. 22, the light emitting unit 3022*a* is provided on the opposite side of the feed passage of the print medium M in the base portion 3035*a*, that is, on the upper surface side of the base portion 3035*a*. In the base portion 3035*a*, a through hole 3035*g* through which the light emitted from the light emitting unit 3022*a* passes is formed. Meanwhile, as shown in FIG. 22, the light receiving unit 3022*b* is provided on the casing 3010 side across the feed passage.

As described above, the task of setting the print medium M in the printer 3100 is performed in a state where the cover 3011 and the printing unit 3030 are swung and the opening portion of the casing 3010 is opened (see FIG. 23).

That is, in the present embodiment, it is possible to set the print medium M in the printer 3100 in a state where a portion between the light emitting unit 3022*a* and the light receiving unit 3022*b* is widely opened. Thus, it is possible to easily perform the task of setting the print medium M in the printer 3100. Note that the position of the light emitting unit 3022*a* may be exchanged with the position of the light receiving unit 3022*b*.

The printer 3100 activates any of the reflection sensor 3021 and the light transmission sensor 3022 in accordance with a type of a print medium M to be used, and detects the position of the print medium M in the feed direction.

For example, in a case where a print medium M provided with no eye marks is used, the printer 3100 detects the position of the print medium M by the light transmission sensor 3022.

The controller 3040 is constituted by a microprocessor, storage devices such as a ROM and a RAM, an input/output interface, buses that connect these members, etc. Print data from external computers, signals from the reflection sensor 3021, signals from the light transmission sensor 3022, etc. are inputted to the controller 3040 via the input/output interface.

The controller 3040 executes various programs stored in the storage device by the microprocessor, and controls electricity distribution to the heating element of the thermal head 3032, electricity distribution to the platen drive motor, etc.

Hereinafter, the configurations, operations, and effects of the present embodiment will be described collectively.

The printer 3100 includes the printing portion 3015 that performs printing to the print medium M, the ribbon roll up shaft 3034 that rolls up the ink ribbon R used in the printing portion 3015, the ribbon supply shaft 3033 provided movably between the first position and the second position with respect to the ribbon roll up shaft 3034, the ribbon supply shaft 3033 that holds the ink ribbon R to be supplied to the printing portion 3015, and the ribbon supply shaft lock mechanism 3050 to be brought into the lock state where the rotation of the ribbon supply shaft 3033 is regulated when the ribbon supply shaft 3033 is placed at the first position, and into the non-lock state where the rotation of the ribbon supply shaft 3033 is permitted when the ribbon supply shaft 3033 is placed at the second position.

In the present embodiment, the first position is the ribbon replacement position where the ink ribbon R is attachable to and detachable from the ribbon supply shaft 3033, and the second position is the ribbon supply position where the ink ribbon R is supplied to the printing portion 3015.

In such a way, at the position where the ink ribbon R is attachable and detachable, the rotation of the ribbon supply shaft 3033 is regulated. Thereby, at the time of replacing the ink ribbon R, it is possible to prevent that the ribbon supply shaft 3033 is rotated and the ink ribbon R is loosened. Thus, it is possible to easily replace the ink ribbon R. By preventing that the ink ribbon R is loosened, it is possible to prevent useless consumption of the ink ribbon R.

The ribbon supply shaft lock mechanism 3050 has the gear 3033*a* coupled to the ribbon supply shaft 3033, and the lock member 3038 to be brought to the meshing position to mesh with the gear 3033*a* when the ribbon supply shaft 3033 is placed at the first position, and to the non-meshing position where the meshing with the gear 3033*a* is cancelled when the ribbon supply shaft 3033 is placed at the second position.

According to this, it is possible to easily realize a structure to regulate the rotation of the ribbon supply shaft 3033.

The printer 3100 includes the swingably provided partition member 3035 that partitions the ink ribbon R and the print medium M, the ribbon supply shaft 3033 and the lock member 3038 are provided in the partition member 3035, and the ribbon supply shaft lock mechanism 3050 has the guide rail 3031*a* in which the lock member 3038 slides along the guide surfaces 3031*b* and 3031*c* following swing of the partition member 3035.

According to this, it is possible to easily realize a structure in which a position of the lock member 3038 with respect to the ribbon supply shaft 3033 is changed following the swing of the partition member 3035.

The ribbon supply shaft lock mechanism 3050 has the spring 3039 serving as a bias member that biases the lock member 3038 toward the guide rail 3031*a*.

According to this, a following property at the time of the lock member 3038 sliding on the guide rail 3031*a* is improved. Thus, it is possible to stably move the lock member 3038.

The partition member 3035 is slidable between the position where the ribbon supply shaft 3033 is placed at the first position and the position where the ribbon supply shaft 3033 is placed at the second position.

According to this, it is possible to easily realize a structure in which the ribbon supply shaft 3033 is moved between the first position and the second position.

The printer 3100 includes the swingably provided printing unit 3030 having the thermal head 3032 that constitutes the printing portion 3015, and the ribbon roll up shaft 3034, the partition member 3035, and the guide rail 3031*a* are provided in the main body portion 3031 of the printing unit 3030.

The printer 3100 includes the printing portion 3015 that performs printing to the print medium M, the ribbon supply shaft 3033 that holds the ink ribbon R to be supplied to the printing portion 3015, the ribbon roll up shaft 3034 that rolls up the ink ribbon R used in the printing portion 3015, the swingably provided partition member 3035 that partitions the ink ribbon R and the print medium M, and the ribbon supply shaft lock mechanism 3050 that regulates the rotation of the ribbon supply shaft 3033. The ribbon supply shaft lock mechanism 3050 is switched between the lock state where the rotation of the ribbon supply shaft 3033 is regulated and the non-lock state where the rotation of the ribbon supply shaft 3033 is permitted in conjunction with the swing actions of the partition member 3035.

According to this, at the time of replacing the ink ribbon R, by swinging the partition member 3035 to bring the ribbon supply shaft lock mechanism 3050 into the lock state, it is possible to prevent that the ribbon supply shaft 3033 is rotated and the ink ribbon R is loosened. Thus, it is possible to easily replace the ink ribbon R. There is no need for operating the ribbon supply shaft lock mechanism 3050 in order to regulate the rotation of the ribbon supply shaft 3033, and it is possible to efficiently perform the task of replacing the ink ribbon R.

The ribbon supply shaft lock mechanism 3050 has the gear 3033*a* coupled to the ribbon supply shaft 3033, and the lock member 3038 provided movably between the meshing position to mesh with the gear 3033*a* and the non-meshing position where the meshing with the gear 3033*a* is cancelled.

According to this, it is possible to easily realize a structure in which the rotation of the ribbon supply shaft 3033 is regulated.

The printer 3100 includes the printing portion 3015 that performs printing to the print medium M, the ribbon supply shaft 3033 that holds the ink ribbon R to be supplied to the printing portion 3015, and the ribbon roll up shaft 3034 that rolls up the ink ribbon R used in the printing portion 3015. When the ribbon supply shaft 3033 is placed at the ribbon replacement position where the ink ribbon R is attachable and detachable, the rotation of the ribbon supply shaft 3033 and the rotation of the ribbon roll up shaft 3034 are regulated.

According to this, at the time of replacing the ink ribbon R, it is possible to prevent that the ribbon supply shaft 3033 is rotated and the ink ribbon R is loosened. As described above, the back tension mechanism is provided in the ribbon supply shaft 3033. Therefore, when the ribbon supply shaft 3033 is placed at the ribbon replacement position where the ink ribbon R is attachable and detachable and the ribbon roll up shaft 3034 is rotatable, the ribbon roll up shaft 3034 is also rotated in the upstream-side roll back direction by roll-back bias force of the ribbon supply shaft 3033 toward the upstream side upon attaching the ink ribbon R, and the ink ribbon R is less easily attached. Meanwhile, in the present embodiment, when the ribbon supply shaft 3033 is placed at the ribbon replacement position where the ink ribbon R is attachable and detachable, the rotation of the ribbon roll up shaft 3034 is also regulated. Thus, it is possible to easily replace the ink ribbon R. Note that even in a case where no back tension mechanism is provided in the ribbon supply shaft 3033, it is also possible to prevent that the ribbon roll up shaft 3034 is rotated and the ink ribbon R is loosened.

The printer 3100 includes the casing 3010, the swingably provided cover 3011 that covers the opening portion of the casing 3010, and the swingably provided printing unit 3030 having the thermal head 3032 that constitutes the printing portion 3015. The ribbon supply shaft 3033 and the ribbon roll up shaft 3034 are provided in the printing unit 3030. The state where the ribbon supply shaft 3033 is placed at the ribbon replacement position is the state where the cover 3011 is opened, and the state where the open end 3030*a* side of the printing unit 3030 is separated from the cover 3011.

In the printer 3100, when the cover 3011 is opened, the rotation of the ribbon roll up shaft 3034 is regulated.

According to this, when the cover 3011 is opened, the rotation of the ribbon roll up shaft 3034 is automatically regulated. Thus, there is no need for an operation for regulating the rotation of the ribbon roll up shaft 3034.

In the printer 3100, when the ribbon supply shaft 3033 is placed at the ribbon replacement position, the ribbon supply shaft 3033 is exposed to the front side of the printer 3100.

According to this, an operator easily visually confirms the ribbon supply shaft 3033 and the task of replacing the ink ribbon R is more easily performed.

The printer 3100 includes the lock member 3038 serving as the first lock member provided movably between the position where the rotation of the ribbon supply shaft 3033 is regulated and the position where the rotation is permitted, the lock member 3062 serving as the second lock member provided movably between the position where the rotation of the ribbon roll up shaft 3034 is regulated and the position where the rotation is permitted, the spring 3039 serving as the first bias member that biases the lock member 3038 toward the position where the rotation of the ribbon supply shaft 3033 is regulated, and the spring 3064 serving as the second bias member that biases the lock member 3062 toward the position where the rotation of the ribbon roll up shaft 3034 is regulated.

According to this, it is possible to easily position the lock member 3038 at the position where the rotation of the ribbon supply shaft 3033 is regulated, and also to easily position the lock member 3062 at the position where the rotation of the ribbon roll up shaft 3034 is regulated.

The printer 3100 includes the casing 3010, the swingably provided cover 3011 that covers the opening portion of the casing 3010, the printing portion 3015 that performs printing to the print medium M, the ribbon supply shaft 3033 that holds the ink ribbon R to be supplied to the printing portion 3015, the ribbon roll up shaft 3034 that rolls up the ink ribbon R used in the printing portion 3015, and the swingably provided printing unit 3030 having the thermal head 3032 that constitutes the printing portion 3015. The ribbon supply shaft 3033 and the ribbon roll up shaft 3034 are provided in the printing unit 3030. In a state where the printing unit 3030 is accommodated in the cover 3011, the rotation of the ribbon supply shaft 3033 is permitted. When the open end 3030*a* side of the printing unit 3030 is separated from the cover 3011, and the ribbon supply shaft 3033 is placed at the ribbon replacement position where the ink ribbon R is attachable and detachable, the rotation of the ribbon supply shaft 3033 is regulated.

According to this, in a state where the open end 3030*a* side of the printing unit 3030 is separated from the cover 3011 and the ink ribbon R is attachable to and detachable from the ribbon supply shaft 3033, the rotation of the ribbon supply shaft 3033 is regulated. Therefore, at the time of replacing the ink ribbon R, it is possible to prevent that the ribbon supply shaft 3033 is rotated and the ink ribbon R is loosened. Thus, it is possible to easily replace the ink ribbon R.

In the printer 3100, in a state where the cover 3011 is opened, and both in a state where the printing unit 3030 is accommodated in the cover 3011 and a state where the open end 3030*a* side of the printing unit 3030 is separated from the cover 3011, the rotation of the ribbon roll up shaft 3034 is regulated.

According to this, in state where the cover 3011 is opened, irrespective of whether the printing unit 3030 is accommodated in the cover 3011 or the open end 3030*a* side is separated from the cover 3011, the rotation of the ribbon roll up shaft 3034 is regulated. Therefore, at the time of replacing the ink ribbon R or at the time of performing maintenance of the printer 3100, it is possible to prevent that the ribbon roll up shaft 3034 is rotated and the ink ribbon R is loosened.

Sixth Embodiment

Figure 27:
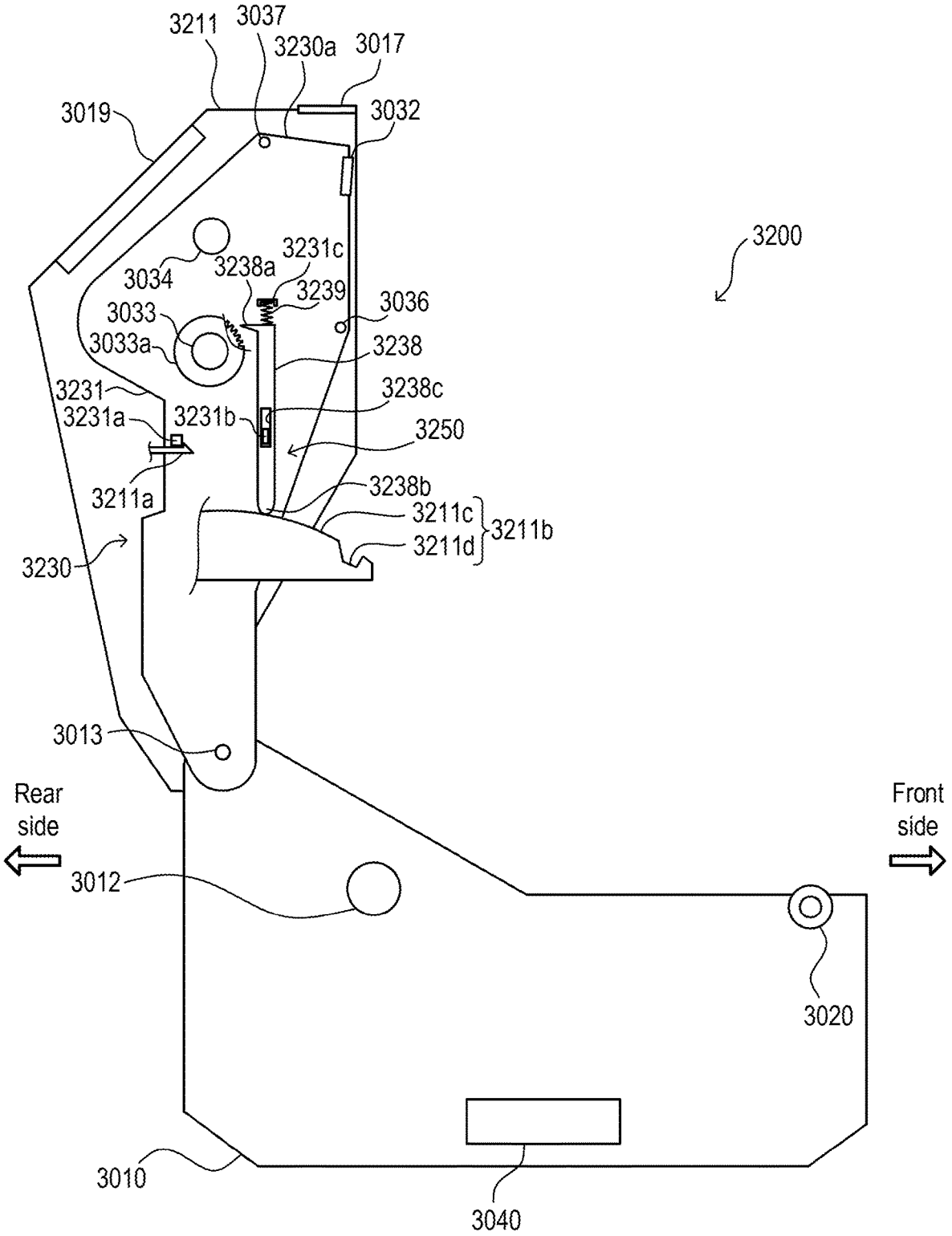
FIG. 27 is a view showing a printer according to a sixth embodiment.
Figure 28:
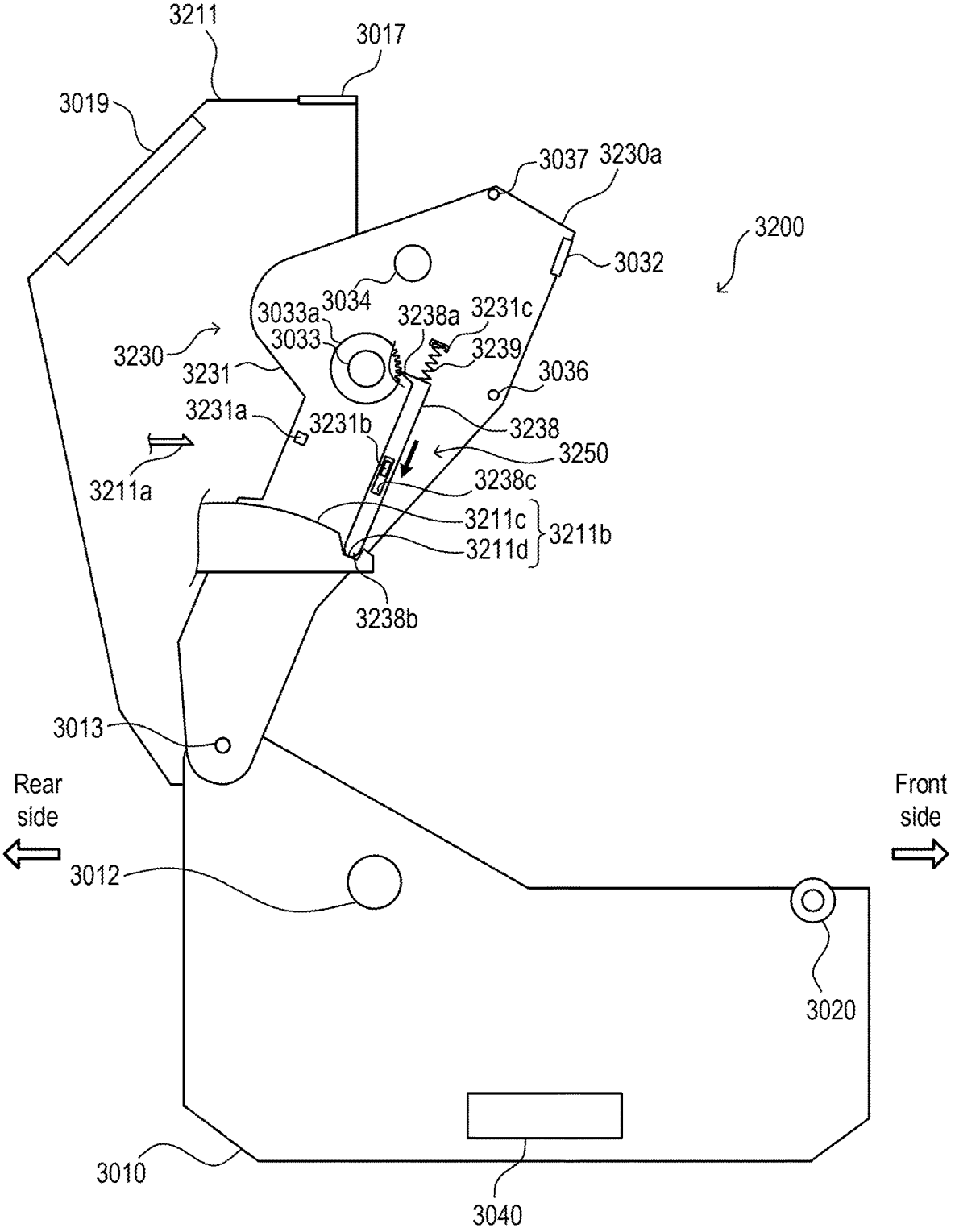
FIG. 28 is a view showing a state where a ribbon supply shaft is placed at a ribbon replacement position.

Successively, a printer 3200 according to a sixth embodiment will be described with reference to FIGS. 27 and 28. The printer 3200 is different from the printer 3100 mainly in a point that a ribbon supply shaft 3033 and a ribbon roll up shaft 3034 are not moved with respect to each other. Note that in FIGS. 27 and 28, similar configurations to the printer 3100 will be given the same reference signs, or will not be described appropriately for easy understanding. The configurations of the printer 3200 other than the configurations shown in FIGS. 27 and 28 are the same as the printer 3100.

Hereinafter, differences from the fifth embodiment will be mainly described.

A printing unit 3230 of the printer 3200 includes a main body portion 3231 whose end portion is supported by a support shaft 3013 so that the main body portion is swingable, and a thermal head 3032 attached to the main body portion 3231.

The ribbon supply shaft 3033 that holds an ink ribbon R in a roll form and the ribbon roll up shaft 3034 that rolls up the used ink ribbon R are provided in the main body portion 3231.

An engagement portion 3231*a* to be engaged with an engaged portion 3211*a* provided in a cover 3211 is also provided in the main body portion 3231.

As shown in FIG. 27, in a state where the printing unit 3230 is placed at an accommodation position where the printing unit 3230 is accommodated in the cover 3211, the engagement portion 3231*a* and the engaged portion 3211*a* are engaged with each other. Thereby, the printing unit 3230 and the cover 3211 are combined with each other.

At the time of performing printing by the printer 3200, the cover 3211 is in a close state, and the engagement portion 3231*a* is engaged with the engaged portion 3211*a*. In a state where the cover 3211 is closed, the ribbon supply shaft 3033 is placed at a ribbon supply position (second position) where the ink ribbon R is supplied to a printing portion 3015.

When the cover 3211 is opened, the printing unit 3230 is swung integrally with the cover 3211, and an opening portion of a casing 3010 is opened.

Thereby, it is possible to perform settings of a print medium M to the printer 3200 and maintenance of portions in the casing 3010.

Further, when engagement between the engagement portion 3231*a* and the engaged portion 3211*a* is cancelled from the state shown in FIG. 27 and the printing unit 3230 is swung to the casing 3010 side, the printing unit 3230 is brought to an open position where the open end 3230*a* side is separated from the cover 3211 as shown in FIG. 28.

By swinging the printing unit 3230 to the casing 3010 side with torque which is predetermined torque or more so that the open end 3230*a* side is separated from the cover 3211, the engagement portion 3231*a* and the engaged portion 3211*a* are elastically deformed and the engagement between the engagement portion 3231*a* and the engaged portion 3211*a* is cancelled.

The open position of the printing unit 3230 is a position where a swing regulating portion (not shown) provided in the vicinity of the support shaft 3013 in the casing 3010 and the main body portion 3231 are abutted with each other.

Thereby, the ribbon supply shaft 3033 is brought to a ribbon replacement position (first position) where the ink ribbon R is attachable and detachable, and it is possible to perform a task of replacing the ink ribbon R.

As shown in FIG. 28, at the ribbon replacement position, the ribbon supply shaft 3033 is exposed to the front side of the printer 3200. Therefore, an operator easily visually confirms the ribbon supply shaft 3033 and the task of replacing the ink ribbon R is more easily performed.

When the printing unit 3230 is swung to the casing 3010 side with torque which is predetermined torque or more, the swing regulating portion is elastically deformed, the main body portion 3231 goes over the swing regulating portion, and the positioning of the printing unit 3230 by the swing regulating portion is cancelled.

In such a way, in the present embodiment, by bringing the printing unit 3230 to the position where the open end 3230*a* side is separated from the cover 3211, it is possible to move the ribbon supply shaft 3033 to the ribbon replacement position where the ink ribbon R is attachable and detachable.

The printer 3200 also includes a ribbon supply shaft lock mechanism 3250 to be brought into a lock state where rotation of the ribbon supply shaft 3033 is regulated when the ribbon supply shaft 3033 is placed at the ribbon replacement position, and into a non-lock state where the rotation of the ribbon supply shaft 3033 is permitted when the ribbon supply shaft 3033 is placed at the ribbon supply position.

The ribbon supply shaft lock mechanism 3250 has a gear 3033*a* provided in the ribbon supply shaft 3033, a lock member (first lock member) 3238 provided movably between a meshing position where a claw portion 3238*a* and the gear 3033*a* mesh with each other (see FIG. 28) and a non-meshing position where meshing between the claw portion 3238*a* and the gear 3033*a* is cancelled (see FIG. 27), a guide rail 3211*b* provided in the cover 3211, the guide rail to be abutted with an end portion 3238*b* of the lock member 3238, and a spring (first bias member) 3239 that biases the lock member 3238 toward the guide rail 3211*b*.

A long hole 3238*c* is formed in the lock member 3238, and a rectangular projected portion 3231*b* provided in the main body portion 3231 is to be fitted into the long hole 3238*c*. Thereby, the lock member 3238 is slidably supported by the projected portion 3231*b*, and becomes movable between the meshing position and the non-meshing position along the longitudinal direction of the long hole 3238*c*.

The spring 3239 is provided in a compressed state between a sheet portion 3231*c* provided in the main body portion 3231 and the lock member 3238, and biases the lock member 3238 toward the guide rail 3211*b*. Note that in the present embodiment, the spring 3239 is a coil spring. The bias member that biases the lock member 3238 may be a plate spring, a torsional spring, rubber, etc.

The guide rail 3211*b* has a guide surface 3211*c* formed in an arc of a circle whose center is the support shaft 3013, and a guide surface 3211*d* formed at a position closer to the support shaft 3013 than the guide surface 3211*c*.

Following the state that the printing unit 3230 is swung between the accommodation position (see FIG. 27) and the open position (see FIG. 28), the lock member 3238 biased by the spring 3239 slides along the guide surfaces 3211*c* and 3211*d*.

The guide surface 3211*c* is formed in an arc of a circle whose center is the support shaft 3013. Thus, in a case where the printing unit 3230 is swung within a range where the lock member 3238 slides along the guide surface 3211*c*, a position of the lock member 3238 with respect to the gear 3033*a* provided in the ribbon supply shaft 3033 is not changed. In this case, as shown in FIG. 27, the lock member 3238 is maintained at the non-meshing position.

When the printing unit 3230 is swung to the open position, the lock member 3238 is moved to a position to oppose the guide surface 3211*d*. Thereby, as shown by an arrow in FIG. 28, the lock member 3238 is biased by the spring 3239 and moved to a position where the lock member is abutted with the guide surface 3211*d*, and brought to the meshing position where the claw portion 3238*a* meshes with the gear 3033*a*. In this state, the rotation of the ribbon supply shaft 3033 is regulated by the lock member 3238.

When the cover 3211 is swung in the closing direction, the printing unit 3230 is accommodated in the cover 3211. Then, the printing unit goes over the swing regulating portion, and is swung together with the cover 3211.

At this time, the printing unit 3230 is placed at the accommodation position, and the lock member 3238 goes up onto the guide surface 3211*c* while compressing the spring 3239. Thereby, the lock member 3238 is brought to the non-meshing position where the meshing between the claw portion 3238*a* and the gear 3033*a* is cancelled. In this state, the lock member 3238 permits the rotation of the ribbon supply shaft 3033.

In such a way, in the printer 3200, the ribbon supply shaft lock mechanism 3250 is brought into the lock state where the rotation of the ribbon supply shaft 3033 is regulated when the ribbon supply shaft 3033 is placed at the ribbon replacement position, and the ribbon supply shaft lock mechanism 3250 is brought into the non-lock state where the rotation of the ribbon supply shaft 3033 is permitted when the ribbon supply shaft 3033 is placed at the ribbon supply position.

Therefore, at the time of replacing the ink ribbon R, it is possible to prevent that the ribbon supply shaft 3033 is rotated in reaction of stoppage of the printing unit 3230 at the open position and the ink ribbon R is loosened, and that the ribbon supply shaft 3033 is rotated during the task of replacing the ink ribbon R and the ink ribbon R is loosened. Thus, it is possible to easily replace the ink ribbon R.

The ribbon supply shaft lock mechanism 3250 is automatically switched between the lock state and the non-lock state in conjunction with the swing actions of the printing unit 3230.

Therefore, there is no need for operating the ribbon supply shaft lock mechanism 3250 in order to regulate the rotation of the ribbon supply shaft 3033, and it is possible to efficiently perform the task of replacing the ink ribbon R.

As shown in FIG. 28, the claw portion 3238*a* of the lock member 3238 is moved in the tangent line direction in the vicinity of a tangent line of an outer diameter of the gear 3033*a* and meshes with the gear 3033*a*.

Note that as well as the ribbon supply shaft lock mechanism 3050 of the fifth embodiment, the gear to mesh with the claw portion 3238*a* of the lock member 3238 may be a gear coupled to the ribbon supply shaft 3033 other than the gear 3033*a*.

As well as the printer 3100, the printer 3200 also includes a ribbon roll up shaft lock mechanism 3060 to be brought into a lock state where rotation of the ribbon roll up shaft 3034 is regulated when the cover 3211 is opened. In a state where the cover 3211 is opened, and both in a state where the printing unit 3230 is accommodated in the cover 3211 and a state where the open end 3230*a* side of the printing unit 3230 is separated from the cover 3211, the rotation of the ribbon roll up shaft 3034 is regulated.

Therefore, when the ribbon supply shaft 3033 is placed at the ribbon replacement position where the ink ribbon R is attachable and detachable, the rotation of the ribbon supply shaft 3033 and the rotation of the ribbon roll up shaft 3034 are regulated.

Figure 29:
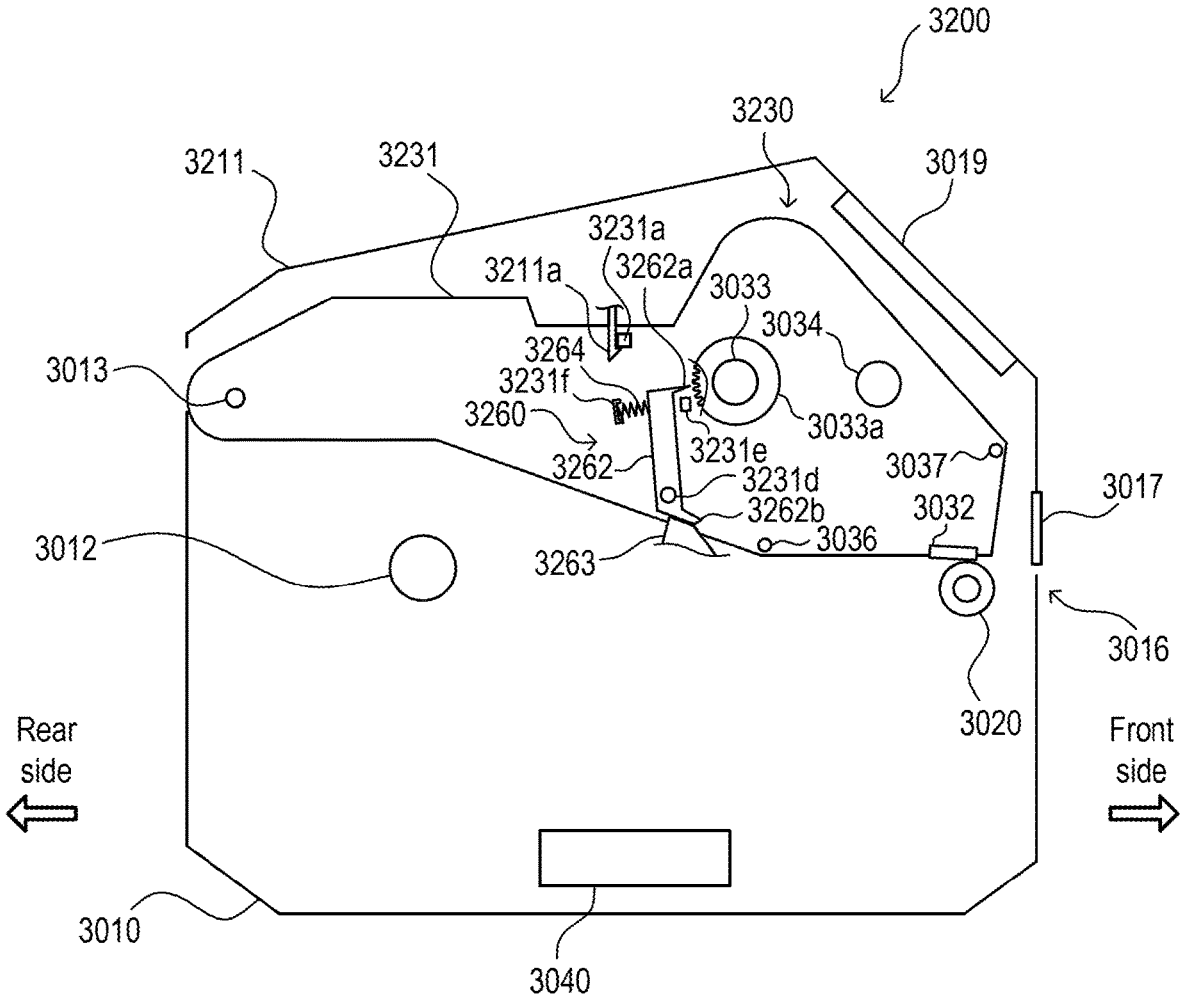
FIG. 29 is a view showing a modified example of a ribbon supply shaft lock mechanism.

Note that as described above, in the printer 3200, the ribbon supply shaft 3033 is provided in the main body portion 3231 of the printing unit 3230. Therefore, instead of the ribbon supply shaft lock mechanism 3250, a ribbon supply shaft lock mechanism 3260 having a similar structure to the ribbon roll up shaft lock mechanism 3060 may be provided as shown in FIG. 29.

The ribbon supply shaft lock mechanism 3260 has the gear 3033*a* provided in the ribbon supply shaft 3033, a lock member (first lock member) 3262 supported by a support shaft 3231*d* provided in the main body portion 3231 of the printing unit 3230, the lock member being provided turnably between a meshing position where a claw portion 3262*a* and the gear 3033*a* mesh with each other and a non-meshing position where meshing between the claw portion 3262*a* and the gear 3033*a* is cancelled (see FIG. 29), a first positioning portion 3263 provided on the casing 3010 side, the first positioning portion to be abutted with a projected portion 3262*b* of the lock member 3262 to position the lock member 3262 at the non-meshing position, a second positioning portion 3231*e* provided in the main body portion 3231 of the printing unit 3230, the second positioning portion to be abutted with the lock member 3262 to position the lock member 3262 at the meshing position, and a spring (first bias member) 3264 that biases the lock member 3262 in the direction in which the lock member is turned from the non-meshing position toward the meshing position.

The spring 3264 is provided in a compressed state between a sheet portion 3231*f* provided in the main body portion 3231 of the printing unit 3230 and the lock member 3262, and biases the lock member 3262 in the direction in which the lock member is turned from the non-meshing position toward the meshing position. Note that in the present embodiment, the spring 3264 is a coil spring. The bias member that biases the lock member 3262 may be a plate spring, a torsional spring, rubber, etc.

In a case where the ribbon supply shaft lock mechanism 3260 having a similar structure to the ribbon roll up shaft lock mechanism 3060 is adopted, in the printer 3200, the rotation of the ribbon supply shaft 3033 and the rotation of the ribbon roll up shaft 3034 are regulated when the cover 3211 is opened.

In this case, the lock member 3262 of the ribbon supply shaft lock mechanism 3260 and the lock member 3062 of the ribbon roll up shaft lock mechanism 3060 may work in conjunction with each other by a link mechanism.

According to this, either the spring 3264 of the ribbon supply shaft lock mechanism 3260 or the spring 3064 of the ribbon roll up shaft lock mechanism 3060 is not required.

Hereinafter, the configurations, operations, and effects of the present embodiment will be described collectively.

The printer 3200 includes the printing portion 3015 that performs printing to the print medium M, the ribbon supply shaft 3033 that holds the ink ribbon R to be supplied to the printing portion 3015, and the ribbon roll up shaft 3034 that rolls up the ink ribbon R used in the printing portion 3015. When the ribbon supply shaft 3033 is placed at the ribbon replacement position where the ink ribbon R is attachable and detachable, the rotation of the ribbon supply shaft 3033 and the rotation of the ribbon roll up shaft 3034 are regulated.

According to this, at the time of replacing the ink ribbon R, it is possible to prevent that the ribbon supply shaft 3033 is rotated and the ink ribbon R is loosened. As described above, the back tension mechanism is provided in the ribbon supply shaft 3033. Therefore, when the ribbon supply shaft 3033 is placed at the ribbon replacement position where the ink ribbon R is attachable and detachable and the ribbon roll up shaft 3034 is rotatable, the ribbon roll up shaft 3034 is also rotated in the upstream-side roll back direction by roll-back bias force of the ribbon supply shaft 3033 toward the upstream side upon attaching the ink ribbon R, and the ink ribbon R is less easily attached. Meanwhile, in the present embodiment, when the ribbon supply shaft 3033 is placed at the ribbon replacement position where the ink ribbon R is attachable and detachable, the rotation of the ribbon roll up shaft 3034 is also regulated. Thus, it is possible to easily replace the ink ribbon R. Note that even in a case where no back tension mechanism is provided in the ribbon supply shaft 3033, it is also possible to prevent that the ribbon roll up shaft 3034 is rotated and the ink ribbon R is loosened.

The printer 3200 includes the casing 3010, the swingably provided cover 3211 that covers the opening portion of the casing 3010, and the swingably provided printing unit 3230 having the thermal head 3032 that constitutes the printing portion 3015. The ribbon supply shaft 3033 and the ribbon roll up shaft 3034 are provided in the printing unit 3230. The state where the ribbon supply shaft 3033 is placed at the ribbon replacement position is the state where the cover 3211 is opened, and the state where the open end 3230*a* side of the printing unit 3230 is separated from the cover 3211.

In the printer 3200, when the cover 3211 is opened, the rotation of the ribbon roll up shaft 3034 is regulated.

According to this, when the cover 3211 is opened, the rotation of the ribbon roll up shaft 3034 is automatically regulated. Thus, there is no need for an operation for regulating the rotation of the ribbon roll up shaft 3034.

In the printer 3200, when the ribbon supply shaft 3033 is placed at the ribbon replacement position, the ribbon supply shaft 3033 is exposed to the front side of the printer 3200.

According to this, an operator easily visually confirms the ribbon supply shaft 3033 and the task of replacing the ink ribbon R is more easily performed.

The printer 3200 includes the lock member 3238 serving as the first lock member provided movably between the position where the rotation of the ribbon supply shaft 3033 is regulated and the position where the rotation is permitted, the lock member 3062 serving as the second lock member provided movably between the position where the rotation of the ribbon roll up shaft 3034 is regulated and the position where the rotation is permitted, the spring 3239 serving as the first bias member that biases the lock member 3238 toward the position where the rotation of the ribbon supply shaft 3033 is regulated, and the spring 3064 serving as the second bias member that biases the lock member 3062 toward the position where the rotation of the ribbon roll up shaft 3034 is regulated.

According to this, it is possible to easily position the lock member 3238 at the position where the rotation of the ribbon supply shaft 3033 is regulated, and also to easily position the lock member 3062 at the position where the rotation of the ribbon roll up shaft 3034 is regulated.

The printer 3200 includes the casing 3010, the swingably provided cover 3211 that covers the opening portion of the casing 3010, the printing portion 3015 that performs printing to the print medium M, the ribbon supply shaft 3033 that holds the ink ribbon R to be supplied to the printing portion 3015, the ribbon roll up shaft 3034 that rolls up the ink ribbon R used in the printing portion 3015, and the swingably provided printing unit 3230 having the thermal head 3032 that constitutes the printing portion 3015. The ribbon supply shaft 3033 and the ribbon roll up shaft 3034 are provided in the printing unit 3230. In a state where the printing unit 3230 is accommodated in the cover 3211, the rotation of the ribbon supply shaft 3033 is permitted. When the open end 3230*a* side of the printing unit 3230 is separated from the cover 3211, and the ribbon supply shaft 3033 is placed at the ribbon replacement position where the ink ribbon R is attachable and detachable, the rotation of the ribbon supply shaft 3033 is regulated.

According to this, in a state where the open end 3230*a* side of the printing unit 3230 is separated from the cover 3211 and the ink ribbon R is attachable to and detachable from the ribbon supply shaft 3033, the rotation of the ribbon supply shaft 3033 is regulated. Therefore, at the time of replacing the ink ribbon R, it is possible to prevent that the ribbon supply shaft 3033 is rotated and the ink ribbon R is loosened. Thus, it is possible to easily replace the ink ribbon R.

In the printer 3200, in a state where the cover 3211 is opened, and both in a state where the printing unit 3230 is accommodated in the cover 3211 and a state where the open end 3230*a* side of the printing unit 3230 is separated from the cover 3211, the rotation of the ribbon roll up shaft 3034 is regulated.

According to this, in state where the cover 3211 is opened, irrespective of whether the printing unit 3230 is accommodated in the cover 3211 or the open end 3230*a* side is separated from the cover 3211, the rotation of the ribbon roll up shaft 3034 is regulated. Therefore, at the time of replacing the ink ribbon R or at the time of performing maintenance of the printer 3200, it is possible to prevent that the ribbon roll up shaft 3034 is rotated and the ink ribbon R is loosened.

Seventh Embodiment

Hereinafter, a printer 4100 according to a seventh embodiment will be described with reference to the attached drawings.

The printer 4100 is a thermal transfer printer in which an ink ribbon R is heated and inks of the ink ribbon R are transferred to a print medium M, so that printing is performed. The print medium M is, for example, a label continuous body in which plural labels are continuously temporarily attached to a band-shaped liner sheet at predetermined intervals.

Figure 30:
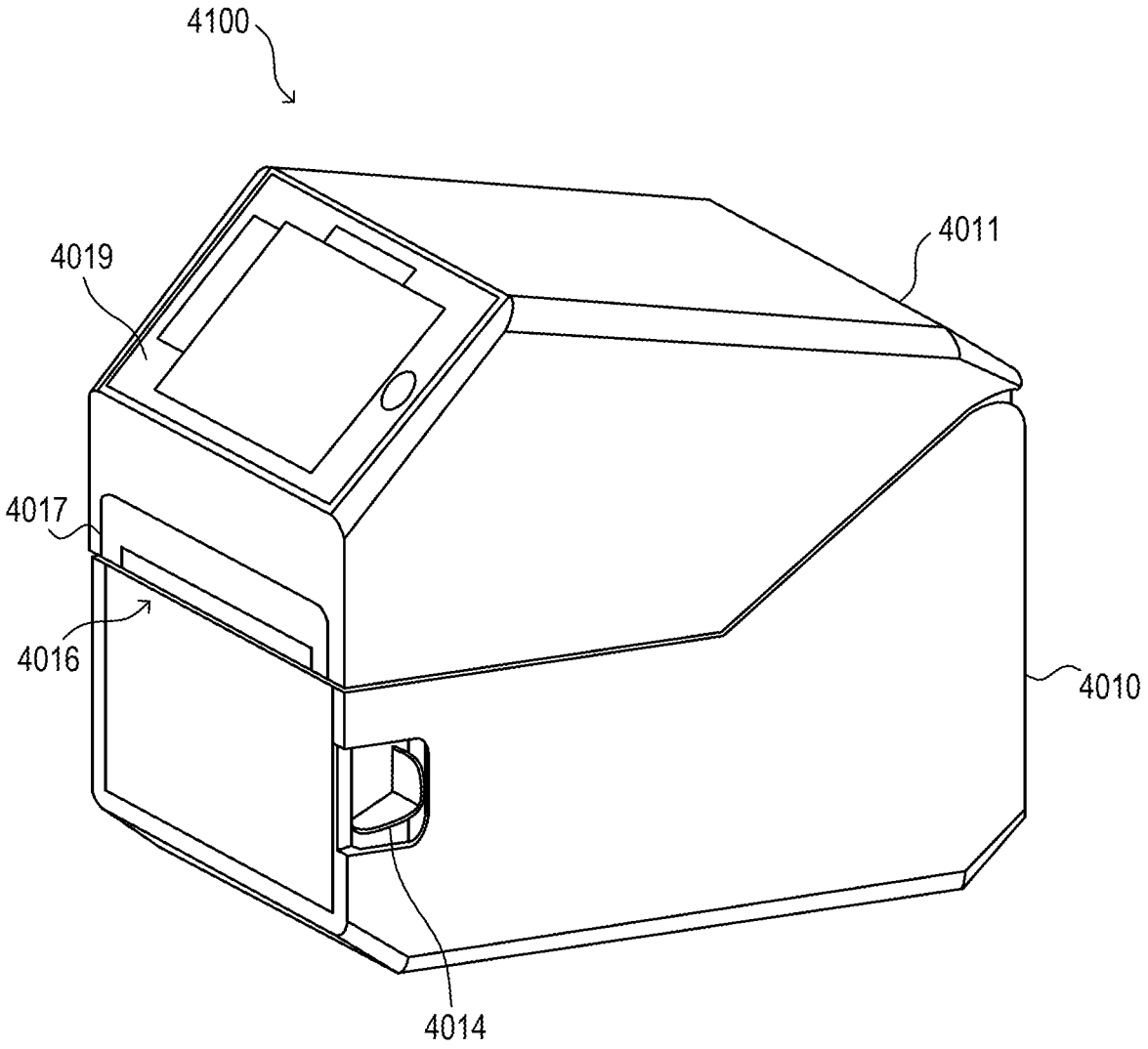
FIG. 30 is a perspective view of a printer according to a seventh embodiment.
Figure 31:
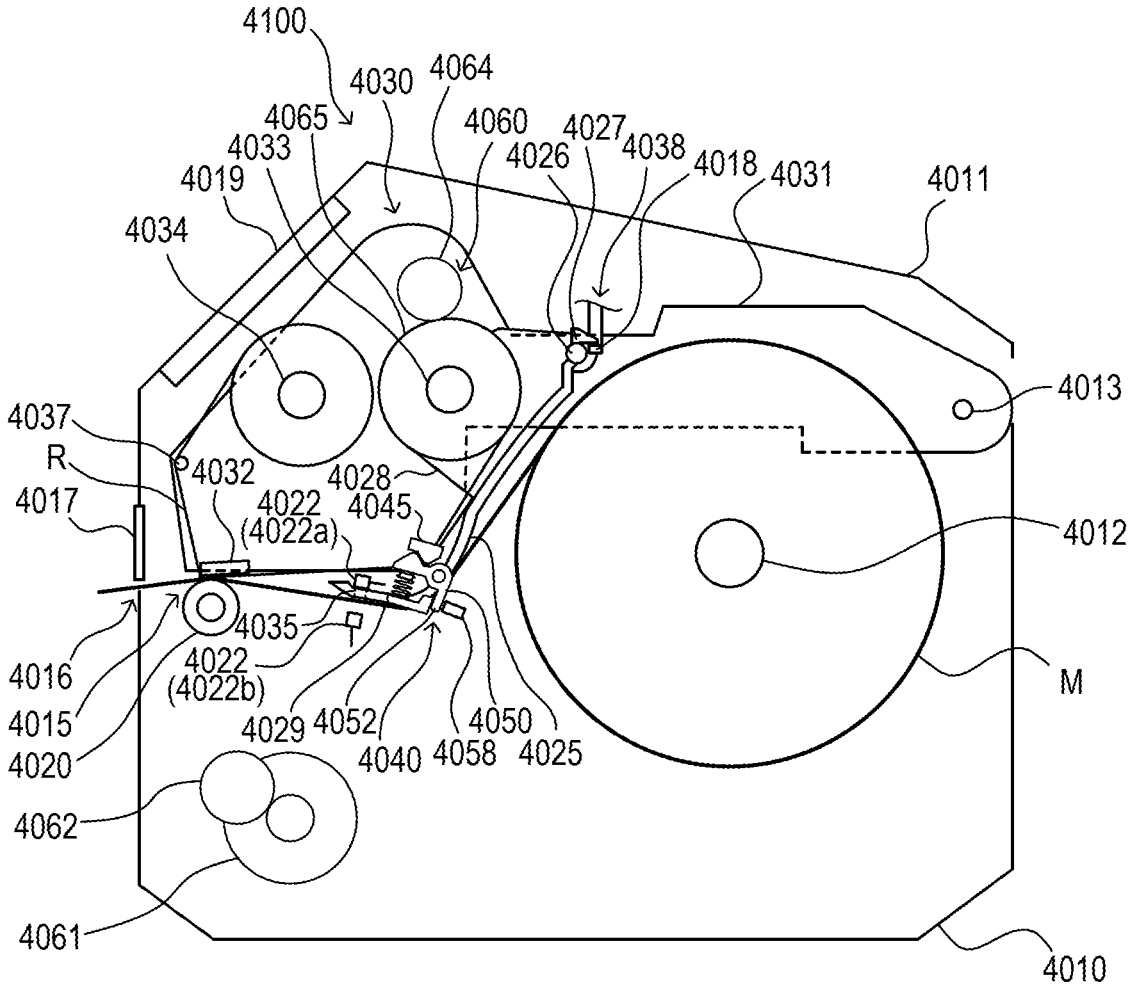
FIG. 31 is a schematic configuration view of the printer according to the seventh embodiment.

As shown in FIGS. 30 and 31, the printer 4100 includes a casing 4010, and a cover 4011 that covers an opening portion of the casing 4010.

As shown in FIG. 31, the print medium M is held on a medium supply shaft 4012 in a state where the print medium is wound in a roll form. As the print medium M, a linerless label or a fanfold medium can also be used.

A one-end side end portion of the cover 4011 is supported by a support shaft 4013 provided in the casing 4010 so that the cover is swingable. By swinging with the support shaft 4013 as a supporting point, it is possible to switch the cover 4011 between a close position where the opening portion of the casing 4010 is closed (see FIG. 31) and an open position where the opening portion of the casing 4010 is opened (see FIGS. 32 and 33).

A cover lock mechanism (not shown) that maintains a close state of the cover 4011 is provided in the casing 4010. The cover lock mechanism is cancelled by operating a lever 4014 shown in FIG. 30.

Between an other-end side end portion of the cover 4011 and the casing 4010, an outlet port 4016 that discharges the print medium M to which printing is already performed by a printing portion 4015 shown in FIG. 31 from the printer 4100 is formed.

A cutter 4017 facing the outlet port 4016 is attached to the cover 4011. The cutter 4017 cuts the printed print medium M discharged from the outlet port 4016. Note that it is possible to attach various other units to the cover 4011 instead of the cutter 4017.

An operation unit 4019 for operating the printer 4100 is also provided in the cover 4011. The operation unit 4019 has various operation buttons, a display, a near-field communication module, LEDs, etc. The display may be a touch panel.

As shown in FIG. 31, inside the printer 4100, a printing unit 4030 for performing printing to the print medium M is accommodated.

The printing unit 4030 includes a main body portion 4031 whose one end side is supported by the support shaft 4013 so that the main body portion 4031 is swingable, and a thermal head 4032 attached to the main body portion 4031.

The thermal head 4032 constitutes the printing portion 4015 that performs printing to the print medium M together with a platen roller 4020 provided on the casing 4010 side.

The printing unit 4030 also includes a ribbon supply shaft 4033 that holds the ink ribbon R to be supplied to the printing portion 4015 in a roll form, a ribbon roll up shaft 4034 that rolls up the used ink ribbon R, a partition member 4025 that partitions the ink ribbon R and the print medium M, a guide shaft 4036 that defines a feed passage of the ink ribbon R from the ribbon supply shaft 4033 to the printing portion 4015 (see FIG. 33), and a guide shaft 4037 that defines a feed passage of the ink ribbon R from the printing portion 4015 to the ribbon roll up shaft 4034. The ribbon supply shaft 4033 is detachably attached to the partition member 4025.

The print medium M is supplied from the medium supply shaft 4012 to the printing portion 4015, and nipped between the thermal head 4032 and the platen roller 4020 together with the ink ribbon R.

When electricity is distributed through to a heating element of the thermal head 4032 in a state where the print medium M and the ink ribbon R are nipped between the thermal head 4032 and the platen roller 4020, that is, in a state where the printing unit 4030 is placed at a printing position, the inks of the ink ribbon R are transferred to the print medium M by heat of the heating element, so that printing is performed to the print medium M.

A motor 4061 serving as a power source, and a gear train 4062 that transmits drive force of the motor 4061 to the platen roller 4020, etc. are provided in the casing 4010. When the platen roller 4020 is rotated forward by the drive force of the motor 4061, the print medium M and the ink ribbon R are fed to the downstream side in the feed direction, and the print medium M is discharged to the outside of the printer 4100 from the outlet port 4016.

A gear train 4060 that transmits the drive force of the motor 4061 to the ribbon supply shaft 4033 and the ribbon roll up shaft 4034 is provided in the printing unit 4030. At the time of activating the printing unit 4030, a gear (not shown) of the gear train 4062 and a gear (not shown) of the gear train 4060 mesh with each other, and the power of the motor 4061 is transmitted to the ribbon supply shaft 4033 and the ribbon roll up shaft 4034.

Figure 32:
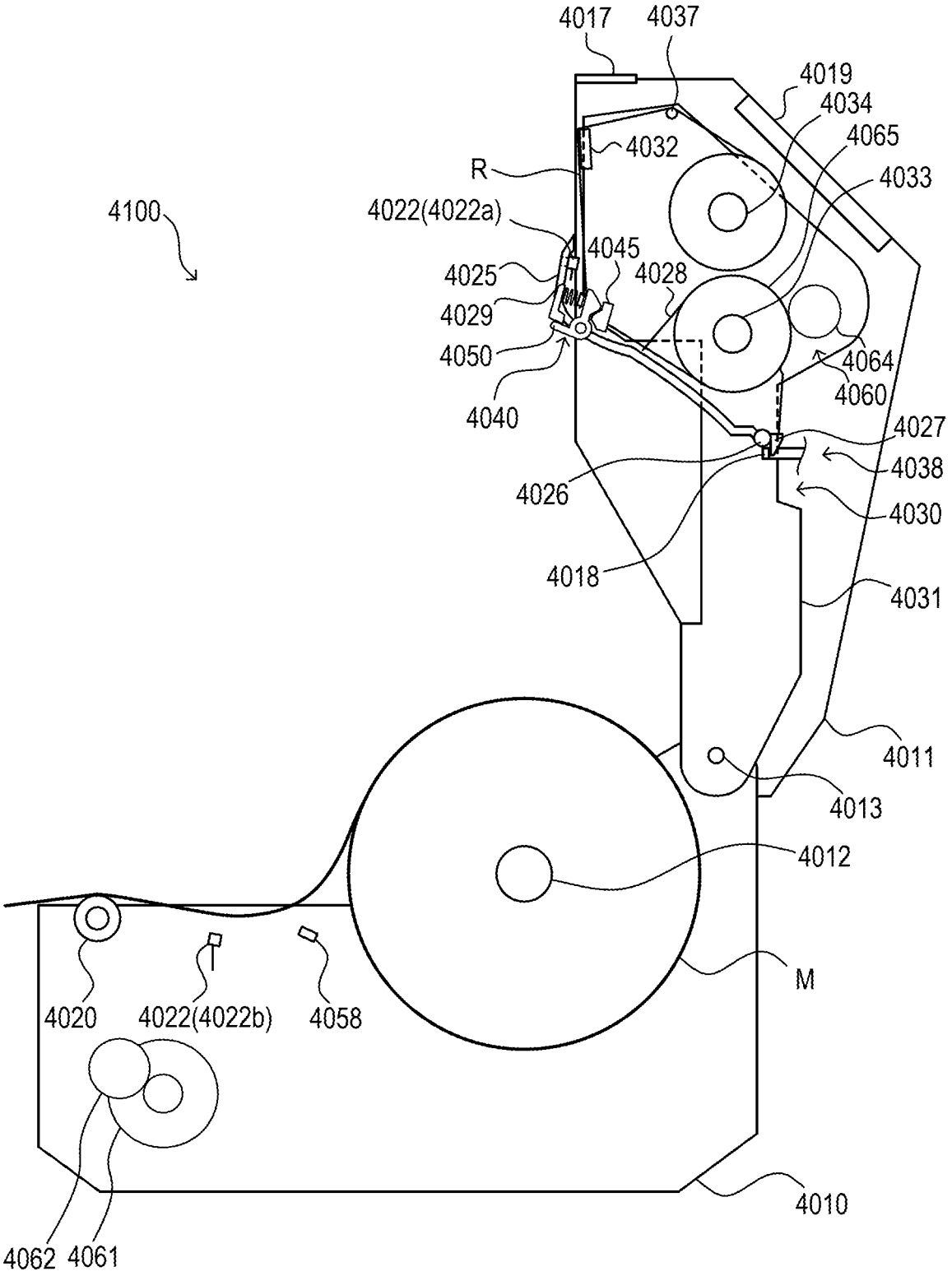
FIG. 32 is a view showing a state where a cover is opened.
Figure 33:
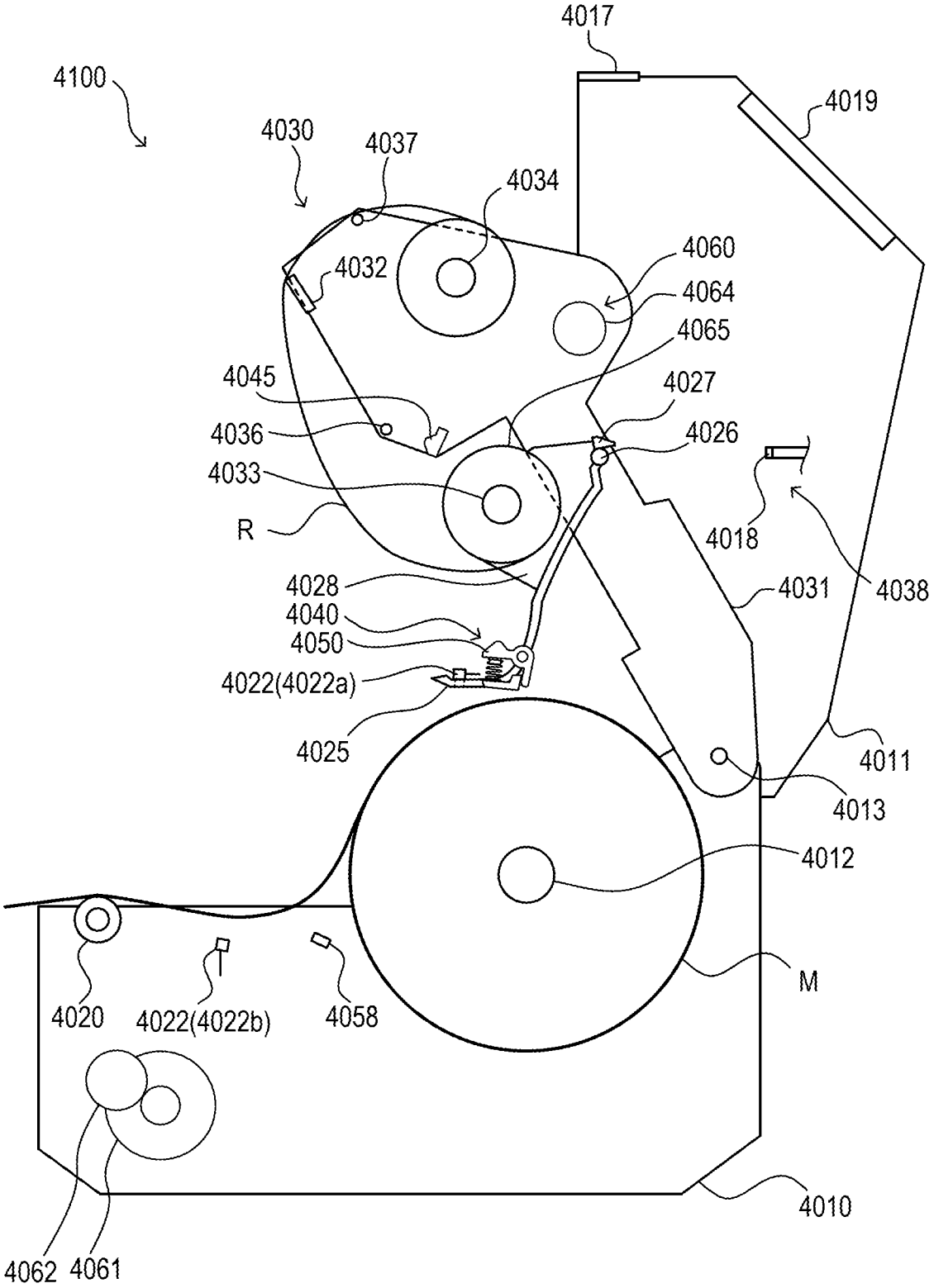
FIG. 33 is a view showing a state where a partition member is opened.

By swinging with the support shaft 4013 as a supporting point with respect to the casing 4010 together with the cover 4011, the printing unit 4030 is switched between the printing position where the printing unit is accommodated in the casing 4010 and the print medium M is nipped between the thermal head 4032 and the platen roller 4020 (see FIG. 31), and a non-printing position where the thermal head 4032 is separated from the platen roller 4020 (see FIGS. 32 and 33).

The partition member 4025 is supported by a swing shaft 4026 swingably with respect to the main body portion 4031. By swinging with the swing shaft 4026 as a supporting point with respect to the main body portion 4031, the partition member 4025 is switched between a close position where the ribbon supply shaft 4033 is accommodated in the printing unit 4030 (see FIG. 32), and an open position where the ribbon supply shaft 4033 is attachable and detachable (see FIG. 33). At the close position, a gear 4064 and a gear 4065 of the gear train 4060 mesh with each other, and the drive force of the motor 4061 is transmitted to the ribbon supply shaft 4033. Meanwhile, at the open position, meshing between the gear 4064 and the gear 4065 of the gear train 4060 is cancelled.

When the printer 4100 is brought into a printable state, that is, into the state shown in FIG. 31, the partition member 4025 is automatically brought into a state of guiding the print medium M. The partition member 4025 has guiding surfaces 4029 with which the print medium M is brought into sliding contact. In sliding contact with the ink ribbon R fed from the guide shaft 4036 to the printing portion 4015, the guiding surfaces 4029 define the feed passage of the ink ribbon R.

The printer 4100 also includes a light transmission sensor 4022 that detects a position of the print medium M in the feed direction.

The light transmission sensor 4022 is a sensor having a light emitting unit 4022*a* which serves as a light emitting portion that emits predetermined light, and a light receiving unit 4022*b* which serves as a light receiving portion that receives the light emitted from the light emitting unit 4022*a* and outputs an electric signal corresponding to intensity of the received light.

For example, in a case where the print medium M is a label continuous body in which plural labels arc continuously temporarily attached to a band-shaped liner sheet at predetermined intervals, there is an only-liner part between two adjacent labels. Between the label part and the only-liner part, a transmission amount of the light emitted from the light emitting unit 4022*a* is different, and hence the intensity of the light received by the light receiving unit 4022*b* is changed. Thereby, the light transmission sensor 4022 can detect the position of the print medium M in the feed direction.

In the present embodiment, as shown in FIG. 31, the light emitting unit 4022*a* is provided on the opposite side of the feed passage of the print medium M in the partition member 4025, that is, on the upper surface side of the partition member 4025. In the partition member 4025, a through hole 4035 through which the light emitted from the light emitting unit 4022*a* passes is formed. Meanwhile, the light receiving unit 4022*b* is provided on the casing 4010 side across the feed passage. Note that the present invention is not limited to this but the light emitting unit 4022*a* may be provided on the casing 4010 side and the light receiving unit 4022*b* may be provided in the partition member 4025. A reflection sensor (not shown) may be provided in the partition member 4025. This reflection sensor is a sensor having a light emitting portion that emits predetermined light, and a light receiving portion that receives the light emitted from the light emitting portion and then reflected from the print medium M, and outputs an electric signal corresponding to intensity of the received light. The reflection sensor detects the position of the print medium M in the feed direction by detecting eye marks which are preliminarily printed on a surface of the print medium M.

Both end portions of the ribbon supply shaft 4033 are supported by two support portions 4028 rotatably and detachably with respect to the partition member 4025.

A locking portion 4027 projecting from a center portion of the swing shaft 4026 is provided in the swing shaft 4026. A locked portion 4018 to be engaged with the locking portion 4027 is provided in the cover 4011. In a state where the locking portion 4027 is engaged with the locked portion 4018, the printing unit 4030 is held at an accommodation position where the printing unit is accommodated in the cover 4011. A unit lock mechanism 4038 that holds the printing unit 4030 with respect to the cover 4011 is constituted by the locking portion 4027 and the locked portion 4018.

At the time of performing printing by the printer 4100, as shown in FIG. 31, the cover 4011 is in the close state where the opening portion of the casing 4010 is closed.

At the time of performing maintenance of the printer 4100, etc., the cover 4011 is swung from the close position shown in FIG. 31 to the open position shown in FIG. 32. Thereby, the opening portion of the casing 4010 is opened, and it is possible to perform settings of the print medium M to the printer 4100 and maintenance of portions in the casing 4010.

When the partition member 4025 is swung from the close position shown in FIG. 32 to the open position shown in FIG. 33, the ribbon supply shaft 4033 and the roll-form ink ribbon R held by the ribbon supply shaft 4033 are moved with respect to the ribbon roll up shaft 4034, and exposed to the outlet port 4016 of the print medium M.

By operation force to swing the partition member 4025 from the close position to the open position, the locking portion 4027 and the locked portion 4018 are elastically deformed and engagement between both the portions is cancelled.

By cancelling the engagement between the locking portion 4027 and the locked portion 4018, the printing unit 4030 itself is swung to a predetermined exposure position toward the casing 4010 side. The predetermined exposure position is a position where a swing regulating portion (not shown) provided in the vicinity of the support shaft 4013 in the casing 4010 and the main body portion 4031 are abutted with each other.

Note that when the printing unit 4030 is swung to the casing 4010 side with operation force which is predetermined torque or more, the swing regulating portion is elastically deformed, the main body portion 4031 goes over the swing regulating portion, and the positioning of the printing unit 4030 by the swing regulating portion is cancelled.

In such a way, the partition member 4025 and the printing unit 4030 are switched from the state shown in FIG. 32 to the state shown in FIG. 33. Thereby, the ribbon supply shaft 4033 and the ribbon roll up shaft 4034 are arranged at a ribbon replacement position where the shafts are attachable to and detachable from the printer 4100, and it is possible to perform a task of replacing the ink ribbon R.

When the partition member 4025 is swung from the open position shown in FIG. 33 toward the cover 4011 side, the partition member 4025 is switched to the close position shown in FIG. 32, and the locking portion 4027 and the locked portion 4018 are elastically deformed and engaged with each other. By engaging the locking portion 4027 and the locked portion 4018, the printing unit 4030 is held at the accommodation position where the printing unit 4030 is accommodated in the cover 4011.

The printer 4100 includes lock mechanisms 4040 that position the partition member 4025 with respect to the printing unit 4030 when the partition member 4025 is placed at the close position. The lock mechanisms 4040 stop swing of the partition member 4025 with respect to the printing unit 4030 by an action of switching the partition member 4025 from the open position to the close position.

Hereinafter, configurations of the lock mechanisms 4040 will be described with reference to FIG. 34.

Figure 34:
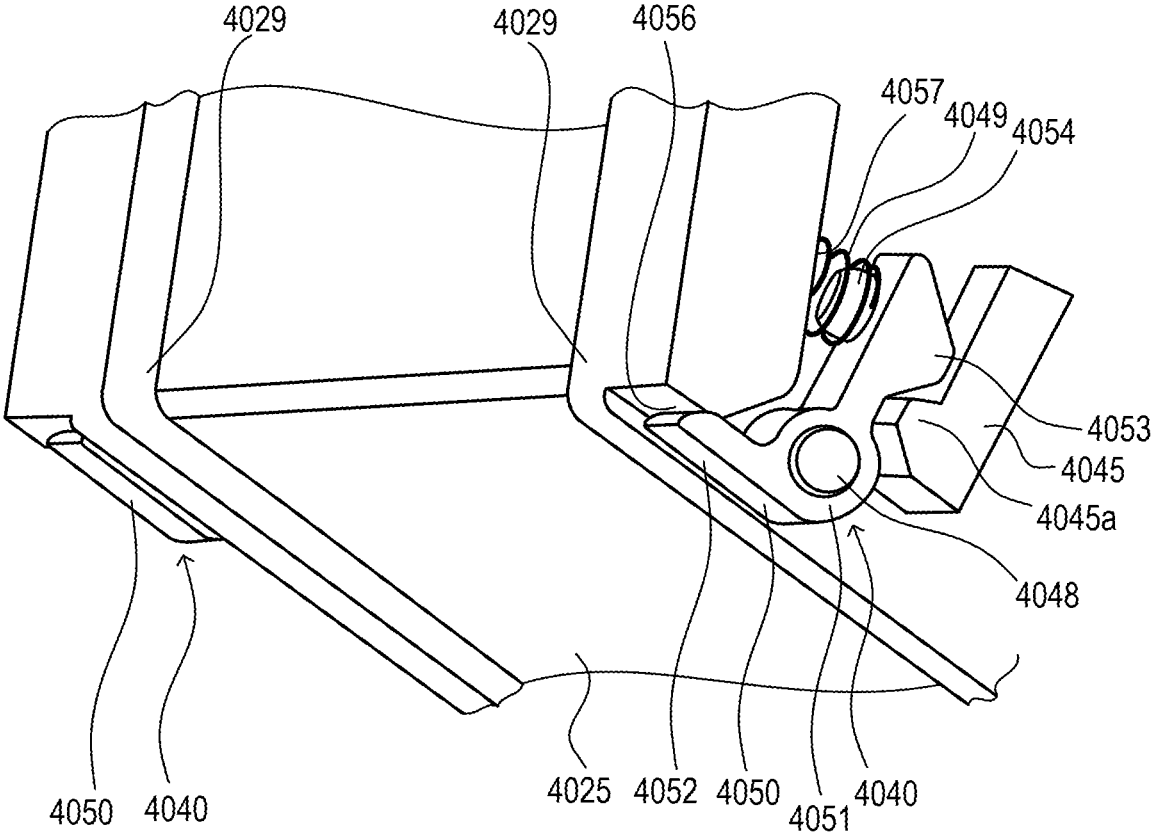
FIG. 34 is a perspective view showing the partition member and lock mechanisms.

FIG. 34 is a perspective view showing the partition member 4025 and the lock mechanisms 4040. The two lock mechanisms 4040 are provided in the partition member 4025 at a position separated from the swing shaft 4026 in the radial direction of the swing shaft 4026. The two lock mechanisms 4040 are arranged in both end portions of the partition member 4025 in the axial direction of the swing shaft 4026.

Each of the lock mechanisms 4040 has a hook 4050 supported swingably about the axis with respect to the partition member 4025, and a spring 4049 that biases an engagement portion 4053 of the hook 4050 in the direction in which the engagement portion 4053 is engaged with an engaged portion 4045 of the main body portion 4031.

A support shaft 4048 that swingably supports the hook 4050 is formed in the partition member 4025. The support shaft 4048 is arranged in parallel to the swing shaft 4026.

The hook 4050 has a tubular fitting portion 4051 rotatably fitted to an outer periphery of the support shaft 4048, and the engagement portion 4053 and a regulating portion 4052 projecting from the fitting portion 4051 in the radial direction of the support shaft 4048.

An abutment portion 4056 to be abutted with the regulating portion 4052 to regulate swing of the hook 4050, and a spring receiving portion 4057 that receives one end of the spring 4049 are formed in the partition member 4025.

The one end of the coil-shaped spring 4049 is supported by the spring receiving portion 4057 and the other end is supported by a spring receiving portion 4054 of the hook 4050.

The engagement portion 4053 of the hook 4050 projects in a mountain shape toward the engaged portion 4045. The engaged portion 4045 of the partition member 4025 has a mountain portion 4045*a* projecting in a mountain shape toward the hook 4050.

Hereinafter, actions of each of the lock mechanisms 4040 will be described with reference to FIGS. 35A, 35B, and 35C. By the actions shown in order of FIGS. 35A, 35B, and 35C, the lock mechanism 4040 cancels holding of the partition member 4025, and the partition member 4025 is switched from the close position shown in FIG. 32 to the open position shown in FIG. 33. Note that in FIGS. 35A, 35B, and 35C, part of the printer 4100 is omitted for simplification of the description.

Figure 35A:
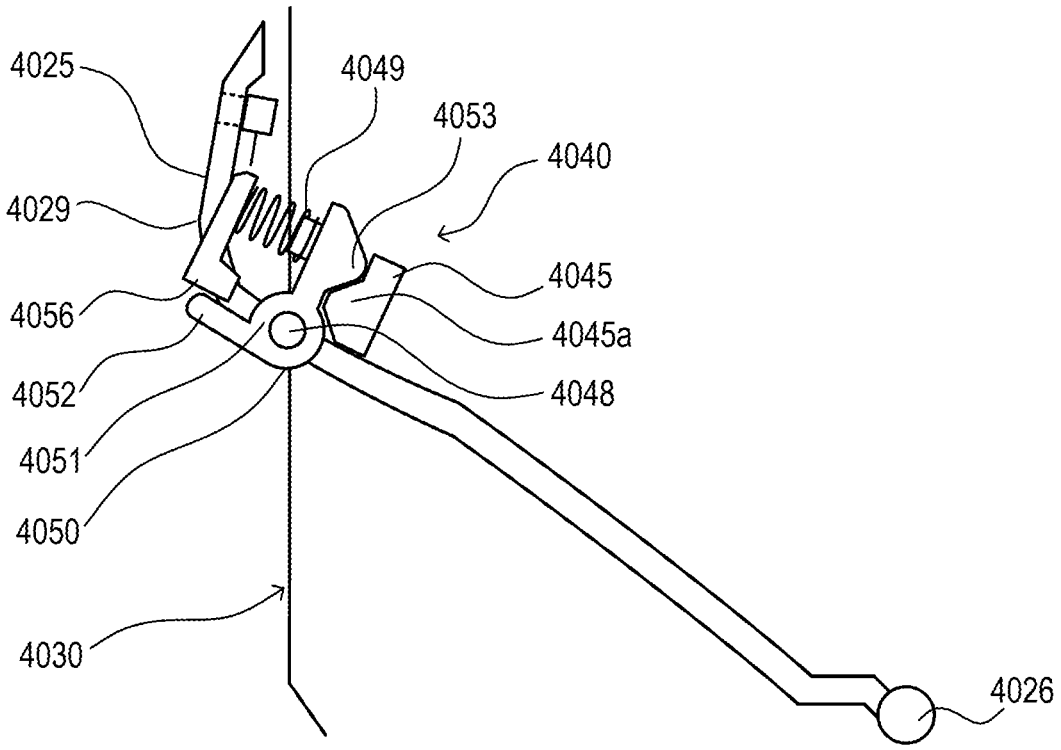
FIG. 35A is a perspective view showing an action of the lock mechanism.

As shown in FIG. 35A, in a state where the partition member 4025 is placed at the close position, the engagement portion 4053 of the hook 4050 is engaged with the mountain portion 4045*a* of the engaged portion 4045 by bias force of the spring 4049. Thereby, the partition member 4025 is held at the close position.

Figure 35B:
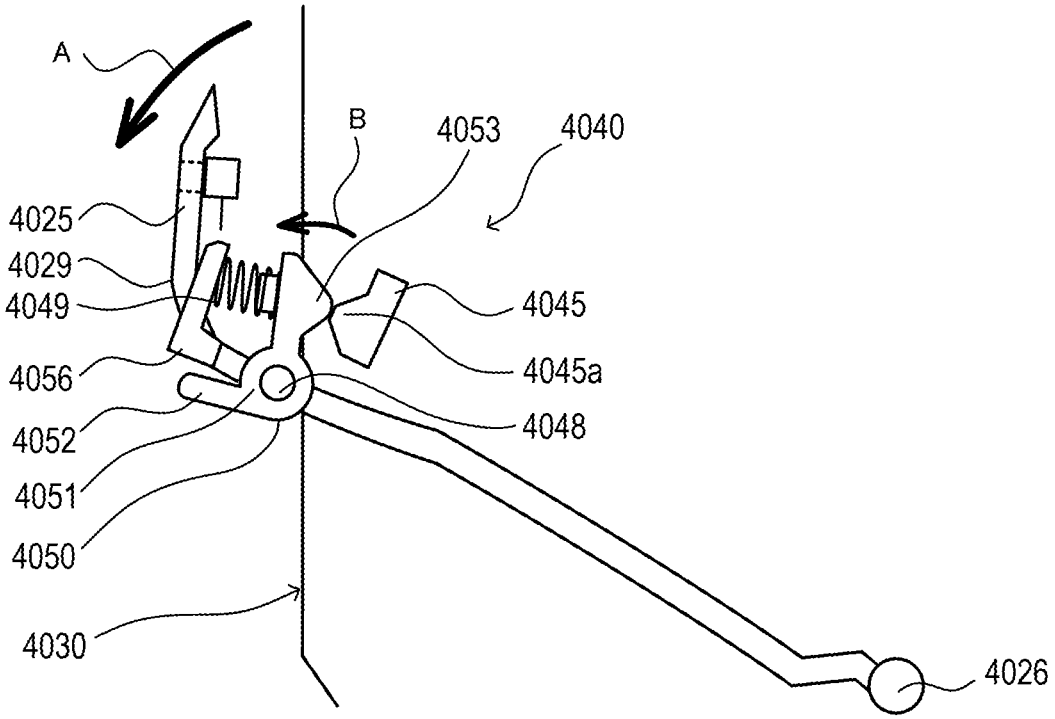
FIG. 35B is a perspective view showing an action of the lock mechanism.

As shown by an arrow A in FIG. 35B, when an operator gives operation force which is predetermined torque or more to the partition member 4025, the hook 4050 is swung in the direction shown by an arrow B against the bias force of the spring 4049, the engagement portion 4053 goes up onto the mountain portion 4045*a* of the engaged portion 4045, and the partition member 4025 is swung from the close position to the open position.

Figure 35C:
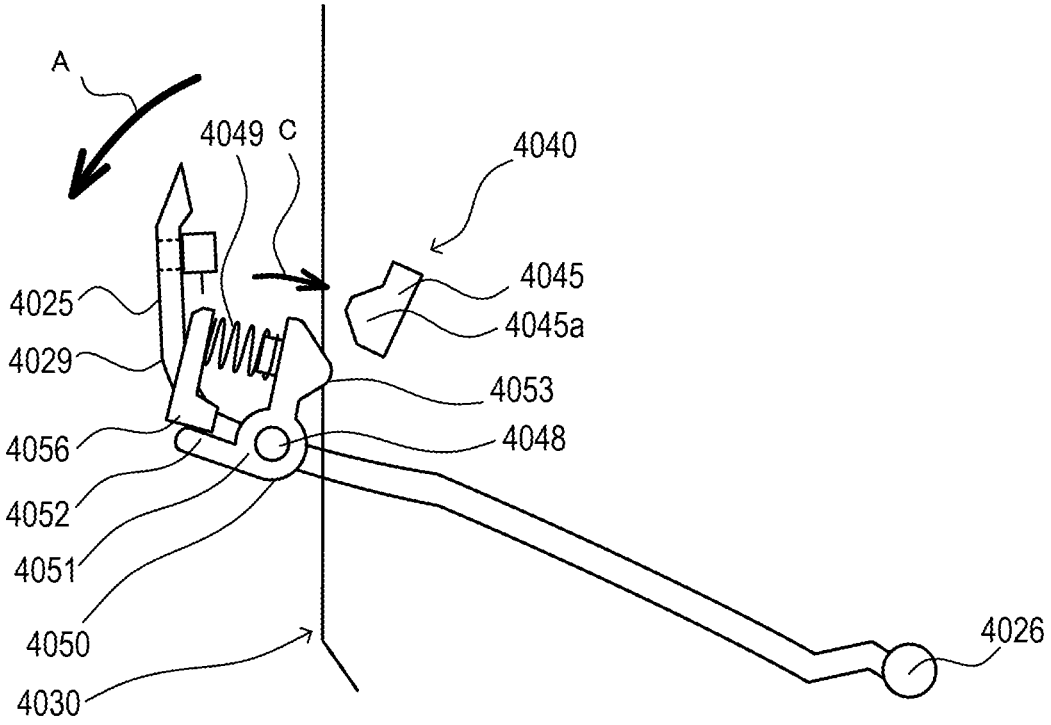
FIG. 35C is a perspective view showing an action of the lock mechanism.

As shown in FIG. 35C, when the partition member 4025 is successively swung, the engagement portion 4053 goes over the mountain portion 4045*a* of the engaged portion 4045. At this time, the hook 4050 is swung in the direction shown by an arrow C in FIG. 35C by the bias force of the spring 4049, and the swing of the hook 4050 is stopped by abutment of the regulating portion 4052 with the abutment portion 4056.

In such a way, by an operation of the operator to swing the partition member 4025 in the direction of the open position (downward), the state where the partition member 4025 is held at the close position by the lock mechanism 4040 is cancelled, and the partition member 4025 is smoothly switched from the close position to the open position.

Meanwhile, at the time of switching the partition member 4025 from the open position shown in FIG. 33 to the close position shown in FIG. 32, the lock mechanism 4040 is activated conversely to the above actions shown in order of FIGS. 35A, 35B, and 35C. After going over the mountain portion 4045*a* of the engaged portion 4045, the engagement portion 4053 of the hook 4050 is engaged with the mountain portion 4045*a* of the engaged portion 4045 by the bias force of the spring 4049. Thereby, the partition member 4025 is positioned at the close position.

Even in a state where the printing unit 4030 is placed at the printing position where the printing unit is accommodated in the casing 4010 (see FIG. 31), the ribbon supply shaft 4033 is held by the lock mechanism 4040 together with the partition member 4025. Thereby, at the time of activating the printer 4100, the state where the gear 4065 and the gear 4064 of the ribbon supply shaft 4033 mesh with each other is held, and the ink ribbon R is smoothly fed.

A facing portion (not shown) that faces the lower surface side of the partition member 4025 is provided in the casing 4010. Further, a facing portion 4058 that faces the regulating portion 4052 of the hook 4050 is provided in the casing 4010. In a state where the printing unit 4030 is switched to the printing position where the printing unit 4030 is accommodated in the casing 4010 (see FIG. 31), the lower surface side of the partition member 4025 faces the facing portion (not shown) of the casing 4010, and the regulating portion 4052 of the hook 4050 faces the facing portion 4058 of the casing 4010. Thereby, in a state where the printing unit 4030 is placed at the printing position (see FIG. 31), the swing of the hook 4050 is stopped, and the state where the engagement portion 4053 and the engaged portion 4045 are engaged with each other is reliably maintained.

Next, effects of the present embodiment will be described.

According to the present embodiment, the printer 4100 including the printing unit 4030 that performs printing to the print medium M, the ribbon supply shaft 4033 (ribbon shaft) that holds the ink ribbon R, the partition member 4025 provided swingably between the close position where the gears 4064 and 4065 that transmit drive force to the ribbon supply shaft 4033 mesh with each other and the open position where the meshing between the gears 4064 and 4065 of the gear train 4060 is cancelled, and the lock mechanisms 4040 that hold the partition member 4025 with respect to the printing unit 4030 when the partition member 4025 is placed at the close position is provided.

With such a configuration, at the time of activating the printer 4100, the partition member 4025 is held at the close position by the lock mechanisms 4040. Thereby, the state where the gears 4064 and 4065 that drive the ribbon supply shaft 4033 mesh with each other is held, and the ink ribbon R is stably fed. Meanwhile, at the time of replacing the ink ribbon R, the partition member 4025 is swung to the open position, so that the ribbon supply shaft 4033 is arranged detachably from the printing unit 4030. Thereby, an operation of attaching and detaching the ink ribbon R in a limited space of the printer 4100 is more easily performed, and it is possible to improve replacement workability of the ink ribbon R.

The motor 4061 that transmits the drive force to the gear 4064 is provided in the casing 4010. At the time of activating the printer 4100, by holding the partition member 4025 at the close position by the lock mechanisms 4040, the drive force of the motor 4061 is precisely transmitted to the ribbon supply shaft 4033 via the gear 4064, and the ink ribbon R is stably fed.

The printer 4100 includes the light transmission sensor 4022 (sensor) having the light emitting unit 4022*a* (light emitting portion) and the light receiving unit 4022*b* (light receiving portion), the light transmission sensor that detects the position of the print medium M in the feed direction. At least one of the light emitting unit 4022*a* and the light receiving unit 4022*b* is provided in the partition member 4025. At the time of activating the printer 4100, by holding the partition member 4025 at the close position by the lock mechanisms 4040, the light transmission sensor 4022 can detect the position of the print medium M in the feed direction with high precision.

The partition member 4025 has the guiding surfaces 4029 with which the print medium M is brought into sliding contact. At the time of activating the printer 4100, by holding the partition member 4025 at the close position by the lock mechanisms 4040, the print medium M is fed through a predetermined route by the guiding surfaces 4029 of the partition member 4025. Thereby, printing is performed in the printer 4100 with high precision.

The printer 4100 includes the cover 4011 that opens and closes the casing 4010. When the partition member 4025 is placed at the close position, the printing unit 4030 is accommodated in the cover 4011. When the partition member 4025 is switched to the open position, the printing unit 4030 is exposed from the cover 4011. Thereby, by an operation of the partition member 4025, the printing unit 4030 is exposed from the cover 4011. Thus, the operation of attaching and detaching the ink ribbon R is more easily performed, and it is possible to improve the replacement workability of the ink ribbon R.

The printer 4100 further includes the unit lock mechanism 4038 that holds the printing unit 4030 with respect to the cover 4011 when the partition member 4025 is placed at the close position. At the time of activating the printer 4100, by holding the partition member 4025 at the close position by the lock mechanisms 4040, the printing unit 4030 is held at a predetermined printing position with respect to the cover 4011 by the unit lock mechanism 4038.

The lock mechanism 4040 includes the engaged portion 4045 provided in the printing unit 4030, and the engagement portion 4053 to be engaged with the engaged portion 4045 by the bias force of the spring 4049 following the situation that the partition member 4025 is swung and brought to the close position. By the operation force to swing the partition member 4025 to the open position, the lock mechanism 4040 cancels the engagement between the engagement portion 4053 and the engaged portion 4045 against the bias force of the spring 4049. In such a way, by the lock mechanism 4040 being automatically activated by the operation to swing the partition member 4025, it is possible to improve the replacement workability of the ink ribbon R.

The lock mechanism 4040 includes the hook 4050 supported swingably by the partition member 4025. The hook 4050 has the engagement portion 4053, and is swung in the direction in which the engagement portion 4053 is engaged with the engaged portion 4045 by the bias force of the spring 4049.

With such a configuration, in the lock mechanism 4040, when the partition member 4025 is switched to the close position, the hook 4050 is swung by the bias force of the spring 4049 and the engagement portion 4053 is engaged with the engaged portion 4045. Thereby, an operation of the lock mechanism 4040 is easily performed, and it is possible to improve the replacement workability of the ink ribbon R.

The printer 4100 also includes the casing 4010 in which the printing unit 4030 is accommodated. The printing unit 4030 is switched between the printing position where the printing unit 4030 is accommodated in the casing 4010 and the non-printing position where the casing 4010 is opened. The hook 4050 has the regulating portion 4052 that regulates the swing of the hook 4050 with respect to the casing 4010.

With such a configuration, at the printing position where the partition member 4025 is accommodated in the printing unit 4030, the swing of the hook 4050 is stopped by the regulating portion 4052 of the hook 4050 facing the casing 4010, and cancellation of the engagement between the engagement portion 4053 and the engaged portion 4045 is forbidden. Thereby, even when the printer 4100 receives impact from the outside, the state where the engagement portion 4053 and the engaged portion 4045 are engaged with each other is maintained. Therefore, at the time of activating the printer 4100, the state where the gears that drive the ribbon supply shaft 4033 mesh with each other is held, an action to feed the ink ribbon R is smoothly performed.

The swing shaft 4026 is provided on the one end side of the partition member 4025, and the lock mechanisms 4040 are provided on the other end side of the partition member 4025.

By providing a sufficient distance between the swing shaft 4026 and the lock mechanisms 4040 in such a way, the partition member 4025 at the close position is reliably positioned. In addition, only small operation force is required for switching the lock mechanisms 4040.

The lock mechanisms 4040 are arranged in both the end portions of the partition member 4025 in the axial direction of the swing shaft 4026.

By providing a sufficient gap between the lock mechanisms 4040 in such a way, a stable posture of the partition member 4025 at the close position is maintained.

For example, in the above embodiment, the engaged portion 4045 is provided in the partition member 4025, and the engagement portion 4053 is provided in the printing unit 4030. The embodiment is not limited to this but the engaged portion 4045 may be provided in the printing unit 4030 and the engagement portion 4053 may be provided in the partition member 4025.

The ribbon supply shaft 4033 is detachably provided in the partition member 4025. However, the embodiment is not limited to this but the ribbon roll up shaft 4034 may be detachably provided.

The embodiments of the printer are described above. However, there is no intention to limit the technical scope of the present invention to the specific configurations of the embodiments described above.

The configurations of the embodiments described above can be appropriately combined for use.

The present application makes a priority claim based on Japanese Patent Application No. 2017-185376 filed in the Japan Patent Office on Sep. 26, 2017, Japanese Patent Application No. 2017-185378 filed in the Japan Patent Office on Sep. 26, 2017, Japanese Patent Application No. 2018-106516 filed in the Japan Patent Office on Jun. 1, 2018, Japanese Patent Application No. 2018-106519 filed in the Japan Patent Office on Jun. 1, 2018, Japanese Patent Application No. 2018-133719 filed in the Japan Patent Office on Jul. 13, 2018, Japanese Patent Application No. 2018-133721 filed in the Japan Patent Office on Jul. 13, 2018, Japanese Patent Application No. 2018-133722 filed in the Japan Patent Office on Jul. 13, 2018, and Japanese Patent Application No. 2018-133724 filed in the Japan Patent Office on Jul. 13, 2018, and the entire disclosure of these applications is incorporated herein by reference.

The invention claimed is:

1. A printer, comprising:

a printing portion configured to print on a print medium;

a ribbon supply shaft configured to hold an ink ribbon to be supplied to the printing portion;

a ribbon roll up shaft configured to roll up the used ink ribbon;

a printing unit provided swingably, the printing unit having a thermal head that constitutes the printing portion; and a partition member swingably provided in the printing unit, the partition member partitioning the ink ribbon and the print medium, wherein the ribbon supply shaft is provided on the partition member.

2. The printer according to claim 1, wherein the partition member is swingable between a close position to bring the ribbon supply shaft to a ribbon supply position where the ink ribbon is capable of being supplied to the printing portion, and an open position to bring the ribbon supply shaft to a ribbon replacement position where the ribbon supply shaft is attachable to and detachable from the printer.

3. The printer according to claim 2, wherein at the ribbon replacement position, the ribbon supply shaft is positioned on the lower side of the ribbon roll up shaft and on the front side of the printer more than the ribbon roll up shaft.

4. The printer according to claim 2, wherein at the ribbon replacement position, the ribbon supply shaft is positioned on the lower side of a plane containing a lower surface of the thermal head.

5. The printer according to claim 2, wherein in a state where the ribbon supply shaft is placed at the ribbon replacement position and looseness of the ink ribbon is removed, a part of the ink ribbon from the ribbon supply shaft to an end portion of the printing unit on the front side of the printer is abutted with only two points including the thermal head and the end portion of the printing unit on the front side of the printer, or abutted with only the end portion of the printing unit on the front side of the printer.

6. The printer according to claim 2, wherein when the partition member is placed at the open position, the ribbon supply shaft is exposed to an outlet port of the print medium.

7. The printer according to claim 1, wherein the ribbon supply shaft is configured to be attachable and detachable on the front side of the printer, and the ribbon roll up shaft is configured to be attachable and detachable on the upper side.

8. A printer, comprising:

a ribbon supply shaft configured to hold an ink ribbon;

a ribbon roll up shaft configured to roll up used ink ribbon;

a thermal head configured to print on a print medium; and a swingable partition member configured to partition the ink ribbon and the print medium, wherein the ribbon supply shaft is provided on the swingable partition member.

9. The printer according to claim 8, wherein the partition member is swingable between a close position to bring the ribbon supply shaft to a ribbon supply position, and an open position to bring the ribbon supply shaft to a ribbon replacement position where the ribbon supply shaft is attachable to and detachable from the printer.

10. The printer according to claim 9, wherein at the ribbon replacement position, the ribbon supply shaft is positioned on the lower side of the ribbon roll up shaft and on the front side of the printer more than the ribbon roll up shaft.

11. The printer according to claim 9, wherein at the ribbon replacement position, the ribbon supply shaft is positioned on the lower side of a plane containing a lower surface of the thermal head.

12. The printer according to claim 9, wherein in a state where the ribbon supply shaft is placed at the ribbon replacement position and looseness of the ink ribbon is removed, the part of the ink ribbon from the ribbon supply shaft to the thermal head has no bent points.

13. The printer according to claim 9, wherein when the partition member is placed at the open position, the ribbon supply shaft is exposed to an outlet port of the print medium.

14. The printer according to claim 8, wherein the ribbon supply shaft is configured to be attachable and detachable on the front side of the printer, and the ribbon roll up shaft is configured to be attachable and detachable on the upper side of the printer.

15. A printer, comprising:

a ribbon supply shaft configured to hold an ink ribbon;

a ribbon roll up shaft configured to roll up used ink ribbon;

a thermal head configured to print on a print medium; and a swingable partition member configured to partition the ink ribbon and the print medium, wherein the ribbon supply shaft is connected to the swingable partition member such that the ribbon supply shaft moves together with the swingable partition member when the swingable partition member swings to an open position.

* * * * *